US012788208B2

(12) United States Patent
Yuan et al.

(10) Patent No.: US 12,788,208 B2
(45) Date of Patent: Nov. 10, 2026

(54) GUIDE RAIL STRUCTURE AND DISHWASHER COMPRISING THE SAME

(71) Applicant: FOSHAN SHUNDE MIDEA WASHING APPLIANCES MANUFACTURING CO., LTD., Foshan (CN)

(72) Inventors: Bo Yuan, Foshan (CN); Xing Song, Foshan (CN); Shoubao Wu, Foshan (CN); Pingping Xu, Foshan (CN); Jianxun Zhao, Foshan (CN); Hongtu Zhao, Foshan (CN)

(73) Assignee: FOSHAN SHUNDE MIDEA WASHING APPLIANCES MANUFACTURING CO., LTD., Foshan (CN)

( * ) Notice: Subject to any disclaimer, the term of this patent is extended or adjusted under 35 U.S.C. 154(b) by 115 days.

(21) Appl. No.: 19/006,743

(22) Filed: Dec. 31, 2024

(65) Prior Publication Data

US 2025/0134343 A1 May 1, 2025

Related U.S. Application Data

(63) Continuation of application No. 17/950,651, filed on Sep. 22, 2022, now Pat. No. 12,207,779, which is a (Continued)

(30) Foreign Application Priority Data

Sep. 20, 2017 (CN) ..... 201710849309.1
Sep. 20, 2017 (CN) ..... 201710849329.9
(Continued)

(51) Int. Cl.
*A47L 15/42* (2006.01)

(52) U.S. Cl.
CPC ..... *A47L 15/4272* (2013.01); *A47L 15/4246* (2013.01)

(58) Field of Classification Search
None
See application file for complete search history.

(56) References Cited

U.S. PATENT DOCUMENTS 5,667,303 A 9/1997 Arens et al.
6,300,564 B1 10/2001 Moraes et al.
(Continued)

FOREIGN PATENT DOCUMENTS

CN 1400880 A 3/2003
CN 1502910 A 6/2004
(Continued)

OTHER PUBLICATIONS

Extended European search report dated Mar. 3, 2026 received in European patent Application No. 25219090.5.
(Continued)

*Primary Examiner* — Rita P Adhlakha
(74) *Attorney, Agent, or Firm* — Scully, Scott, Murphy & Presser, P.C.

(57) ABSTRACT

A guide rail structure, for use with a bowl basket and including a guide rail base having a guide rail surface on an upper side thereof. The guide rail base is provided with a plurality of side water guide grooves. Each side water guide groove has one defined in the guide rail surface and another notch arranged on a left side or a right side of the guide rail base. The plurality of side water guide grooves are arranged at an interval along an extension direction of the guide rail surface. A ratio of a groove width of each side water guide groove to a wheel diameter of the roller is less than ½, and
(Continued)

a ratio of a groove depth of each of side water guide groove defined in the guide surface to a width of the guide rail surface is less than 1.

20 Claims, 29 Drawing Sheets

Related U.S. Application Data continuation of application No. 16/824,889, filed on Mar. 20, 2020, now Pat. No. 11,490,781, which is a continuation of application No. PCT/CN2018/086013, filed on May 8, 2018.

(30) Foreign Application Priority Data

| | | |
|---|---|---|
| Sep. 20, 2017 | (CN) | 201710849770.7 |
| Sep. 20, 2017 | (CN) | 201710849809.5 |
| Sep. 20, 2017 | (CN) | 201710849817.X |
| Sep. 20, 2017 | (CN) | 201710849897.9 |
| Sep. 20, 2017 | (CN) | 201710850166.6 |
| Sep. 20, 2017 | (CN) | 201710850573.7 |
| Sep. 20, 2017 | (CN) | 201710850713.0 |
| Sep. 20, 2017 | (CN) | 201710850714.5 |
| Sep. 20, 2017 | (CN) | 201710851330.5 |
| Sep. 20, 2017 | (CN) | 201710853313.5 |
| Sep. 20, 2017 | (CN) | 201710853354.4 |
| Sep. 20, 2017 | (CN) | 201710853411.9 |
| Sep. 20, 2017 | (CN) | 201710853646.8 |
| Sep. 20, 2017 | (CN) | 201710853674.X |
| Sep. 20, 2017 | (CN) | 201710853679.2 |
| Sep. 20, 2017 | (CN) | 201710853862.2 |
| Sep. 20, 2017 | (CN) | 201710853882.X |
| Sep. 20, 2017 | (CN) | 201710853968.2 |
| Sep. 20, 2017 | (CN) | 201721210524.9 |
| Sep. 20, 2017 | (CN) | 201721211448.3 |
| Sep. 20, 2017 | (CN) | 201721211753.2 |
| Sep. 20, 2017 | (CN) | 201721211794.1 |
| Sep. 20, 2017 | (CN) | 201721211842.7 |
| Sep. 20, 2017 | (CN) | 201721218291.7 |
| Sep. 20, 2017 | (CN) | 201721218294.0 |

(56) References Cited

U.S. PATENT DOCUMENTS

| | | | | |
|---|---|---|---|---|
| 7,640,612 | B2 * | 1/2010 | Schock | A47L 15/507 8/158 |
| 2004/0201339 | A1 | 10/2004 | Dickson et al. | |
| 2005/0150523 | A1 | 7/2005 | Schock | |
| 2009/0266386 | A1 | 10/2009 | Haltmayer et al. | |
| 2011/0310015 | A1 | 12/2011 | Zucker et al. | |
| 2015/0190034 | A1 * | 7/2015 | Jeong | A47L 15/507 312/228.1 |

FOREIGN PATENT DOCUMENTS

| | | | |
|---|---|---|---|
| CN | 1987237 | A | 6/2007 |
| CN | 101161176 | A | 4/2008 |
| CN | 201102512 | Y | 8/2008 |
| CN | 101332073 | A | 12/2008 |
| CN | 201199200 | Y | 2/2009 |
| CN | 101385629 | A | 3/2009 |
| CN | 101385630 | A | 3/2009 |
| CN | 201216575 | Y | 4/2009 |
| CN | 101438951 | A | 5/2009 |
| CN | 201236829 | Y | 5/2009 |
| CN | 101568292 | A | 10/2009 |
| CN | 201505112 | U | 6/2010 |
| CN | 101980649 | A | 2/2011 |
| CN | 201836776 | U | 5/2011 |
| CN | 201859627 | U | 6/2011 |
| CN | 202096175 | U | 1/2012 |
| CN | 202103809 | U | 1/2012 |
| CN | 102415862 | A | 4/2012 |
| CN | 102512129 | A | 6/2012 |
| CN | 202604761 | U | 12/2012 |
| CN | 202818792 | U | 3/2013 |
| CN | 203226795 | U | 10/2013 |
| CN | 203348133 | U | 12/2013 |
| CN | 203400110 | U | 1/2014 |
| CN | 203477809 | U | 3/2014 |
| CN | 203835114 | U | 9/2014 |
| CN | 203898242 | U | 10/2014 |
| CN | 204146989 | U | 2/2015 |
| CN | 104433987 | A | 3/2015 |
| CN | 104586335 | A | 5/2015 |
| CN | 104688155 | A | 6/2015 |
| CN | 104716490 | A | 6/2015 |
| CN | 204363923 | U | 6/2015 |
| CN | 204467999 | U | 7/2015 |
| CN | 204578245 | U | 8/2015 |
| CN | 104905746 | A | 9/2015 |
| CN | 204618144 | U | 9/2015 |
| CN | 204883615 | U | 12/2015 |
| CN | 204931606 | U | 1/2016 |
| CN | 204950856 | U | 1/2016 |
| CN | 105310622 | A | 2/2016 |
| CN | 105395147 | A | 3/2016 |
| CN | 105452556 | A | 3/2016 |
| CN | 205094354 | U | 3/2016 |
| CN | 105534444 | A | 5/2016 |
| CN | 105662306 | A | 6/2016 |
| CN | 205359392 | U | 7/2016 |
| CN | 105852768 | A | 8/2016 |
| CN | 205458534 | U | 8/2016 |
| CN | 205501646 | U | 8/2016 |
| CN | 106377213 | A | 2/2017 |
| CN | 106440107 | A | 2/2017 |
| CN | 205957342 | U | 2/2017 |
| CN | 106466167 | A | 3/2017 |
| CN | 106963317 | A | 7/2017 |
| CN | 106985625 | A | 7/2017 |
| CN | 107028574 | A | 8/2017 |
| CN | 107044035 | A | 8/2017 |
| CN | 107049198 | A | 8/2017 |
| CN | 107174179 | A | 9/2017 |
| CN | 206469429 | U | 9/2017 |
| CN | 107348926 | A | 11/2017 |
| CN | 107374549 | A | 11/2017 |
| CN | 107411690 | A | 12/2017 |
| CN | 206921899 | U | 1/2018 |
| CN | 208355401 | U | 1/2019 |
| CN | 208355402 | U | 1/2019 |
| CN | 208355407 | U | 1/2019 |
| CN | 208355409 | U | 1/2019 |
| CN | 208355416 | U | 1/2019 |
| CN | 208481295 | U | 2/2019 |
| CN | 208625628 | U | 3/2019 |
| CN | 208659274 | U | 3/2019 |
| CN | 209712232 | U | 12/2019 |
| DE | 28 32 084 | A1 | 1/1980 |
| DE | 3222479 | C2 | 5/1988 |
| DE | 10 2007 056 706 | A1 | 5/2009 |
| EP | 0819404 | A2 | 1/1998 |
| EP | 1728461 | A1 | 12/2006 |
| EP | 2 286 709 | A1 | 2/2011 |
| EP | 2 362 044 | A2 | 8/2011 |
| EP | 2 409 631 | A2 | 1/2012 |
| EP | 2 687 142 | A2 | 1/2014 |
| EP | 2772693 | A1 | 9/2014 |
| EP | 2409631 | A3 | 5/2017 |
| GB | 1361556 | A | 7/1974 |
| GB | 2 121 833 | A | 1/1984 |
| JP | S6224046 | B2 | 5/1987 |
| JP | 2001-253100 | A | 9/2001 |
| JP | 2001253700 | A | 9/2001 |
| JP | 2007260034 | A | 10/2007 |

(56) References Cited

FOREIGN PATENT DOCUMENTS

| | | | |
|---|---|---|---|
| JP | 2010-142318 | A | 7/2010 |
| KR | 10-2007-0008821 | A | 1/2007 |
| KR | 10-2012-0112993 | A | 10/2012 |
| KR | 10-2013-0135877 | A | 12/2013 |
| WO | 03/041556 | A1 | 5/2003 |
| WO | 2008/067352 | A2 | 6/2008 |

OTHER PUBLICATIONS

Office Action dated Apr. 30, 2026 received in European Patent Application No. 23200653.6.
Extended European Search Report dated Dec. 8, 2023 received in European Patent Application No. EP 23200653.6.
Extended European Search Report dated Dec. 8, 2023 received in European Patent Application No. EP 23200656.9.
Notice of Allowance dated Sep. 18, 2024 received in U.S. Appl. No. 17/950,651.
First Office Action dated Mar. 22, 2019 received in Chinese Patent Application No. CN 201710850166.6.
First Office Action dated Mar. 26, 2019 received in Chinese Patent Application No. CN 201710850573.7.
First Office Action dated Mar. 22, 2019 received in Chinese Patent Application No. Cn 201710853674.X.
First Office Action dated Mar. 5, 2019 received in Chinese Patent Application No. CN 201710849329.9.
First Office Action dated Mar. 27, 2019 received in Chinese Patent Application No. Cn 201710849817.X.
First Office Action dated Feb. 3, 2019 received in Chinese Patent Application No. CN 201710849809.5.
First Office Action dated Feb. 3, 2019 received in Chinese Patent Application No. CN 201710853968.2.
Second Office Action dated Aug. 5, 2019 received in Chinese Patent Application No. CN 201710850714.5.
First Office Action dated Feb. 2, 2019 received in Chinese Patent Application No. CN 201710850713.0.
First Office Action dated Apr. 17, 2019 received in Chinese Patent Application No. CN 201710853862.2.
Written Opinion of the International Searching Authority dated Aug. 21, 218 received in International Patent Application No. PCT/CN2018/086013.
Second Office Action dated Jun. 28, 2019 received in Chinese Patent Application No. CN 201710853411.9.
Second Office Action dated Aug. 5, 2019 received in Chinese Patent Application No. CN 201710853968.2.
Third Office Action dated Apr. 23, 2020 received in Chinese Patent Application No. CN 201710850573.7.
Third Office Action dated Apr. 24, 2020 received in Chinese Patent Application No. CN 201710849809.5.
Extended European Search Report dated Nov. 6, 2020 received in European Patent Application No. EP 18859446.9.
Office Action dated Jan. 31, 2022 received in United States Patent Application No. U.S. Appl. No. 16/824,889.
Notice of Allowance dated Jun. 28, 2022 received in United States Patent Application No. U.S. Appl. No. 16/824,889.
Notification to Grant Patent Right for Invention dated Jan. 20, 2020 received in Chinese Patent Application No. CN 201710850713.0.
Notification to Grant Patent Right for Invention dated Dec. 18, 2020 received in Chinese Patent Application No. CN 201710849809.5.
Office Action dated Dec. 9, 2022 received in European Patent Application No. EP 18859446.9.
International Search Report dated Aug. 21, 2018 received in International Application No. PCT/CN2018/086013.
Fourth Office Action dated Sep. 23, 2020 received in Chinese Patent Application No. CN 201710849809.5.
Second Office Action dated Sep. 25, 2019 received in Chinese Patent Application No. Cn 201710849817.X.
Dismissing Decision dated Nov. 13, 2019 received in Chinese Patent Application No. CN 201710853862.2.
Dismissing Decision dated Dec. 25, 2020 received in Chinese Patent Application No. CN 201710850573.7.
Second Office Action dated Aug. 21, 2019 received in Chinese Patent Application No. CN 201710853862.2.
Second Office Action dated Aug. 20, 2019 received in Chinese Patent Application No. CN 201710850573.7.
Dismissing Decision dated Jun. 22, 2020 received in Chinese Patent Application No. CN 201710850714.5.
Notice of Second Review Opinion dated Apr. 25, 2023 received in Chinese Patent Application No. CN 201710849309.1.
Second Office Action dated Aug. 12, 2019 received in Chinese Patent Application No. CN 201710850166.6.
Second Office Action dated Aug. 13, 2019 received in Chinese Patent Application No. Cn 201710853674.X.
Third Office Action dated Feb. 3, 2020 received in Chinese Patent Application No. Cn 201710853674.X.
Second Office Action dated Aug. 12, 2019 received in Chinese Patent Application No. CN 201710849809.5.
Second Office Action dated Jul. 10, 2019 received in Chinese Patent Application No. CN 201710850713.0.
Dismissing Decision dated Apr. 24, 2020 received in Chinese Patent Application No. Cn 201710849817.X.
Notice of First Review Opinion dated Feb. 3, 2019 received in Chinese Patent Application No. CN 201710850714.5.
Second Office Action dated Aug. 19, 2019 received in Chinese Patent Application No. CN 201710849329.9.
Notice of First Review Opinion dated Feb. 28, 2023 received in Chinese Patent Application No. CN 201710853679.2.
Third Office Action dated Apr. 2, 2020 received in Chinese Patent Application No. CN 201710850714.5.
Notice of First Review Opinion dated Mar. 1, 2023 received in Chinese Patent Application No. CN 201710849770.7.
Notice of First Review Opinion dated Mar. 1, 2023 received in Chinese Patent Application No. CN 201710853354.4.
First Office Action dated Mar. 1, 2019 received in Chinese Patent Application No. CN 201710853411.9.
Notice of First Review Opinion dated Mar. 1, 2023 received in Chinese Patent Application No. Cn 201710853882.X.
Notice of First Review Opinion dated Feb. 9, 2023 received in Chinese Patent Application No. CN 201710849309.1.
Notice of First Review Opinion dated Feb. 11, 2023 received in Chinese Patent Application No. CN 201710853646.8.
Notice of First Review Opinion dated Mar. 1, 2023 received in Chinese Patent Application No. CN 201710853313.5.
Notice of First Review Opinion dated Mar. 1, 2023 received in Chinese Patent Application No. CN 201710851330.5.
Dismissing Decision dated Apr. 21, 2020 received in Chinese Patent Application No. CN 201710853674.X.
Fourth Office Action dated Oct. 12, 2020 received in Chinese Patent Application No. CN 201710850573.7.

* cited by examiner

GUIDE RAIL STRUCTURE AND DISHWASHER COMPRISING THE SAME

CROSS-REFERENCE TO RELATED APPLICATIONS

This application is a continuation application of U.S. application Ser. No. 17/950,651 filed on Sep. 22, 2022, now pending, which is a continuation application of U.S. application Ser. No. 16/824,889 filed on Mar. 20, 2020, which is a continuation application of International Application No. PCT/CN2018/086013 with an international filing date of May 8, 2018, which claims priority of Chinese Patent Applications No. 201710850713.0, 201721211842.7, 201721211753.2, 201710853882.X, 201710853968.2, 201710850166.6, 201710853862.2, 201721211448.3, 201710853646.8, 201710849897.9, 201710853354.4, 201710853679.2, 201710849309.1, 201721218291.7, 201721218294.0, 201710851330.5, 201710849809.5, 201710849817.X, 201710849770.7, 201710853674.X, 201710853411.9, 201710849329.9, 201710850573.7, 201721211794.1, 201710850714.5, 201721210524.9 and 201710853313.5 filed on Sep. 20, 2017, the contents of which are incorporated herein by reference in their entirety for all purposes. No new matter has been introduced.

BACKGROUND

The application pertains to the technical field of dishwashers, and particularly to a guide rail structure and a dishwasher comprising the same.

The overflow structure of dishwashers in the prior art has the following technical problems: during the overflow, the pollutants (such as, rice grains, minced meat, food residues, etc.) easily enter the overflow channel directly, which causes clogging easily. At the same time, the pollutants are easily attached to the inlet surface of overflow cover. Under the premise that the overflow cover is not removed, it can not be visually known that whether there is any pollutant entering the overflow cover from the inlet surface. It can only be recognized when the pollutants become rotted and smelly, which renders it not easy to clean up in time.

DETAILED DESCRIPTION OF EMBODIMENTS

Certain embodiments of the present application will be described in detail below, with reference to FIGS. 1 to 90.

Figure 2:
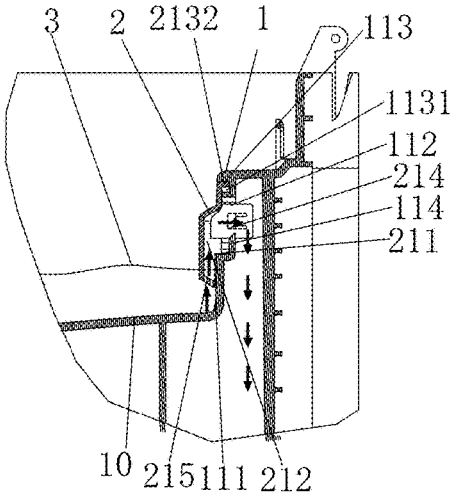
FIG. 2 is a cross-sectional view of the partial structure of the base component according to embodiment 1 of the present application.
Figure 3:
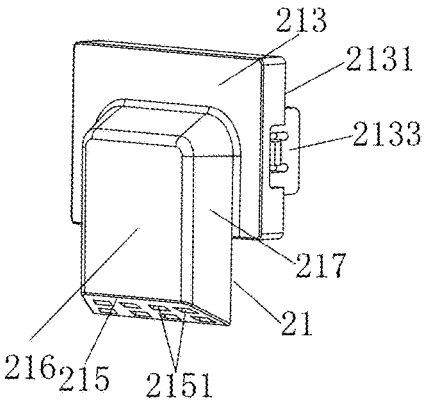
FIG. 3 is a structural schematic diagram of an overflow cover of the base component according to embodiment 1 of the present application.

Embodiment 1: Referring to FIGS. 1 to 3, the base component of this embodiment include a base 1 and an overflow cover 2, the overflow cover 2 includes an overflow cover body 21, and the overflow cover 21 is arranged with an overflow port 211 and a mounting portion 2131, the overflow cover body 21 has an overflow chamber 212, and the base 1 has an overflow hole 112 and a fixed connection portion 113 that is docked with the mounting portion 2131. The overflow port 211 and the overflow hole 112 are in communication with the overflow chamber 212 to form an overflow channel 214 between the overflow cover body 21 and the base 1; one side of the overflow cover 2, adjacent to the upper surface 10 of base 1, is provided with a water inlet plate 215 communicating with the overflow port 211, and the water inlet plate 215 is arranged with a plurality of filter holes 2151. For example, the overflow cover 2 has the overflow chamber 212, and has the functions of splashing prevention and flow guidance after being installed on the base 1. At the same time, due to the arrangement of the water inlet plate 215, the water inlet plate 215 is provided with a plurality of filter holes 2151, the pollutants or residues are trapped to prevent the pollutants from directly entering the overflow channel 214 and to prevent the overflow channel 214 from being blocked.

Optionally, the overflow cover body 21 includes a cover plate 216, an extension wall 217 connected to the cover plate 216, a mounting plate 213 and a water inlet plate 215 connected to the extension wall 217; the water inlet plate 215, the extension wall 217, and the cover plate 216 are jointly enclosed to the overflow chamber 212; a mounting portion 2131 is provided on the mounting plate 213. In this way, the water inlet plate 215, the extension wall 217, and the cover plate 216 together form the overflow chamber 212, which can conveniently and quickly connect the overflow cover 21 and the base 1 and enable the overflow cover 2 to have a good function of water splashing prevention as a whole.

In this embodiment, the mounting portion 2131 includes a fastening block 2132 extended from the mounting plate 213, and the fixed connection portion 113 includes a fastening groove 1131 fitted with the fastening block 2132 to dock with. By fitting the fastening groove 1131 with the fastening block 2132, the overflow cover 2 can be securely connected to the base 1. Further, a convex rib 2133 may be provided on the mounting plate 213. The convex rib 2133 can be fitted at the overflow port 211, and a through hole is configured on the convex rib 2133, thereby enhancing the tightness of connection with the base 1. The water inlet plate 215, the extension wall 217, and the cover plate 216 together form the overflow chamber 212 that is flared. Both the extension wall 217 and the water inlet plate 215 are formed on the cover plate 216 obliquely. Both the extension wall 217 and the water inlet plate 215 are inclined 15-20 degrees away from the overflow chamber 212.

Embodiment 2: Referring to FIGS. 4 to 8, the base component further include a water distribution component 4, and the water distribution component 4 includes a water distribution cover 42 and a water distribution pipeline communicating with the water distribution cover 42; the water distribution pipeline penetrates the base 1; one end of the water distribution pipeline is connected to a water outlet 422, and the other end penetrates the base 1 and communicates with the spray arms at different positions. The water distribution cover 42 includes a water distribution cover body 420. The water distribution cover body 420 is provided with a water inlet 421 and the water outlet 422. The water distribution cover body 420 has a water distribution chamber 43, and the water inlet 421 and the water outlet 422 are both connected with the water distribution chamber 43 to form a water flow channel in the water distribution cover body 420. The water inlet 421 and the water outlet 422 are provided on different sides of the water distribution cover body 420. On the outer wall of the water distribution cover body 420, a first inclined surface 424 is formed by one side of the water inlet 421 obliquely facing toward the water outlet 422; a second inclined surface 426 is formed on the inner wall of the water distribution chamber 43, and the second inclined surface 426 corresponds to the first inclined surface 424 so as to form a water flow channel with a variable cross section inside the water distribution cover body 420.

Figure 4:
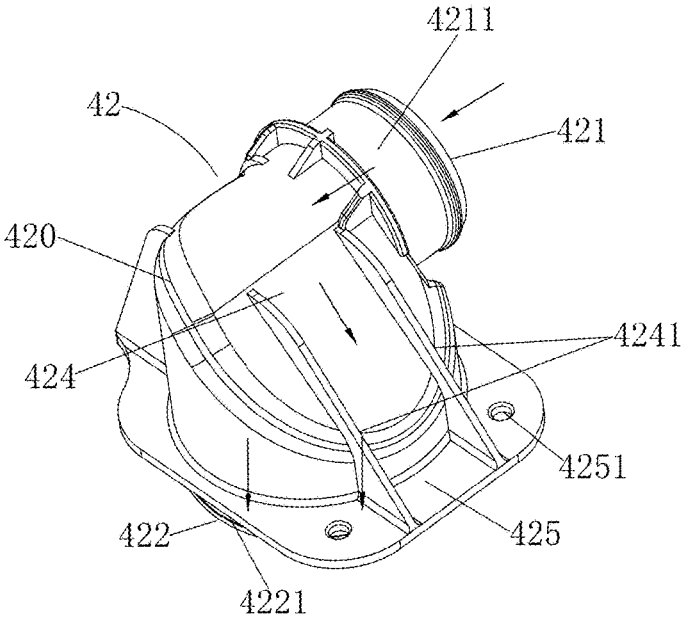
FIG. 4 is a structural schematic diagram of the water distribution cover of the base component according to embodiment 2 of the present application.
Figure 5:
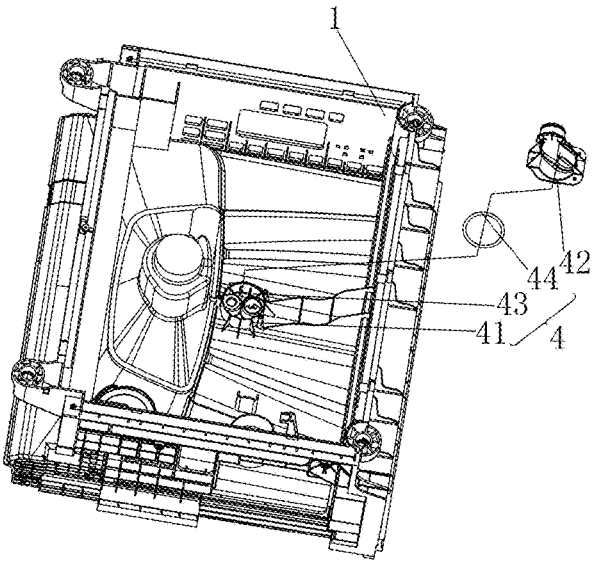
FIG. 5 is a structural exploded schematic diagram of the base component according to embodiment 2 of the present application.
Figure 6:
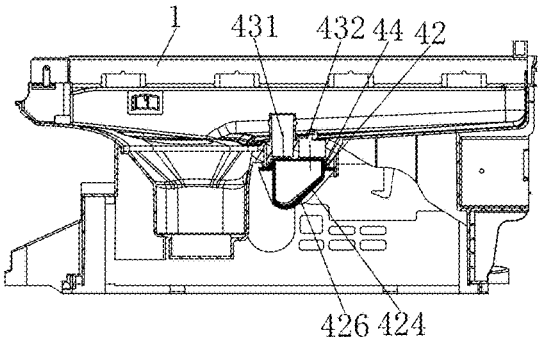
FIG. 6 is a structural sectional view of the base component according to embodiment 2 of the present application.
Figure 7:
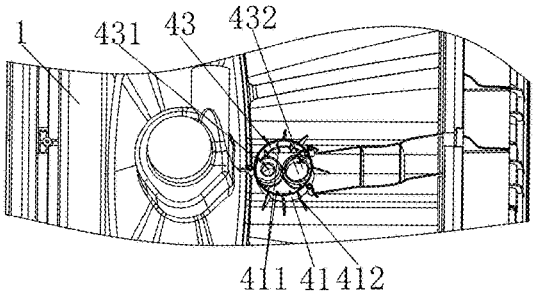
FIG. 7 is a first schematic diagram of a partial structure of base component according to embodiment 2 of the present application.
Figure 8:
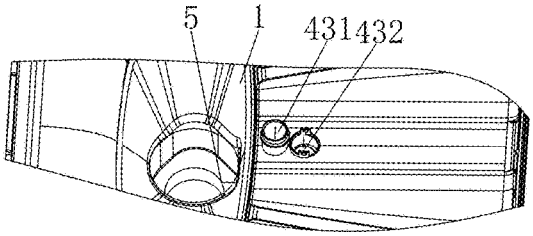
FIG. 8 is a second schematic diagram of a partial structure of base component according to embodiment 2 of the present application.

Optionally, referring to FIGS. 4 to 6, a reinforcing rib 4241 is provided on the first inclined surface 424 and extends from one side of the water inlet 421 to the side of the water outlet 422; an upper end of the reinforcing rib 4241 is provided on the first inclined surface 424. The lower end of the reinforcing rib 4241 is connected to the outer peripheral wall of the water distribution cover body 420. By means of the provided reinforcing rib 4241, the volume of the inner chamber can be reduced and water can be prevended from remaining in the water distribution chamber 43. At the same time, it also helps to strengthen the water distribution cover body 420 and ensures the overall performance of the water distribution cover 42. The water inlet 421 is formed at the outer peripheral wall of the water distribution cover body 420. The water inlet 421 is provided with a first extension portion 4211 extending laterally outwardly from the outer peripheral wall of the water distribution cover body 420. The water outlet 422 is formed at the bottom of the water distribution cover body 420. The water outlet 422 is provided with a second extension portion 4221 extending longitudinally outwardly from the bottom of the water distribution cover body 420; the inclined surface is inclined from the first extension portion 4211 toward one side of the second extension portion 4221.

The water distribution pipeline includes a first water distribution pipeline 431 and a second water distribution pipeline 432 which are arranged in parallel. A connection housing 41 is provided on the base 1 and located outside the first water distribution pipeline 431 and the second water distribution pipeline 432. The connection housing 41 is docked with the water outlet 422 to form a sealed chamber; a sealing ring 44 is provided at the interface between the water distribution cover body 420 and the connection housing 41. By integrating the water distribution component 4 on the base 1, the structure is compact. At the same time, the water distribution cover 42 and the connection housing 41 are sealedly connected through the sealing ring 44 so that the water distribution cover 42 and the connection housing 41 on the base 1 are assembled and sealed together with good sealing.

Optionally, a plurality of rib plates 411 are provided on an inner wall of the connection housing 41, and the plurality of rib plates 411 are distributed on both sides of the first water distribution pipeline 431 and the second water distribution pipeline 432.

Embodiment 3: Referring to FIGS. 5 to 8, the water distribution component 4 includes a connection housing 41 connected to the base 1 and a water distribution cover 42 connected to the connection housing 41. A water distribution chamber 43 is formed between the water distribution cover 42 and the connection housing 41, and the water distribution chamber 43 communicates with at least two water distribution pipelines. One end of each water distribution pipeline is arranged in the water distribution chamber 43 and the other end penetrates the base 1 and communicates with spray arms at different positions. The water distribution cover 42 is connected to the connection housing 41 in a sealed manner. By integrating the water distribution component 4 on the base 1, the structure is compact. At the same time, the water distribution cover 42 and the connection housing 41 are connected in a sealed manner, so that the water distribution cover 42 and the water distribution chamber 43 on the base 1 are assembled and sealed together with good sealing. The water flow is divided into two or more channels. The number of water distribution pipelines in the water distribution chamber 43 is not limited. Different water distribution pipelines can be connected to the spray arms at different locations, and which can be arranged according to the water demand of each channel. It is convenient for the washing pump to drive each spray arm to rotate according to actual needs, which helps to reduce water consumption.

In the embodiment, the water distribution pipeline includes a first water distribution pipeline 431, a second water distribution pipeline 432, and a third water distribution pipeline which are arranged in parallel. The first water distribution pipeline 431 is connected to the lower spray arms, and the second water distribution pipeline 432 is connected to the middle spray arms, the third water distribution pipeline is connected to the upper spray arms; the cross-sectional area ratio of the first water distribution pipeline 431, the second water distribution pipeline 432, and the third water distribution pipeline is 1:3:4.

Embodiment 4: Referring to FIGS. 9 to 13, the water distribution component 4 includes a water distribution cover 42 and a water distribution pipeline connected to the water distribution cover 42; the water distribution cover 42 includes a water distribution cover body 420, and the water distribution cover body 420 includes a water distribution chamber 43, and a water distribution cover body 420 is provided with at least two water outlets, each of which is connected to the water distribution chamber 43 respectively; the water distribution pipeline penetrates the base 1 and is arranged to be at least two sections, and one end of each section of the water distribution pipeline is connected to each water outlet in a sealed manner respectively, the other end of each section of the water distribution pipeline penetrates the base 1 and communicates with spray arms at different locations. By integrating water distribution component 4 on the base 1, the structure is compact.

Figure 11:
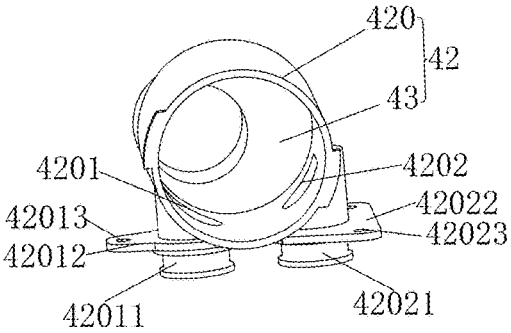
FIG. 11 is a structural schematic diagram of the water separation cover of the base component according to embodiment 4 of the present application.
Figure 12:
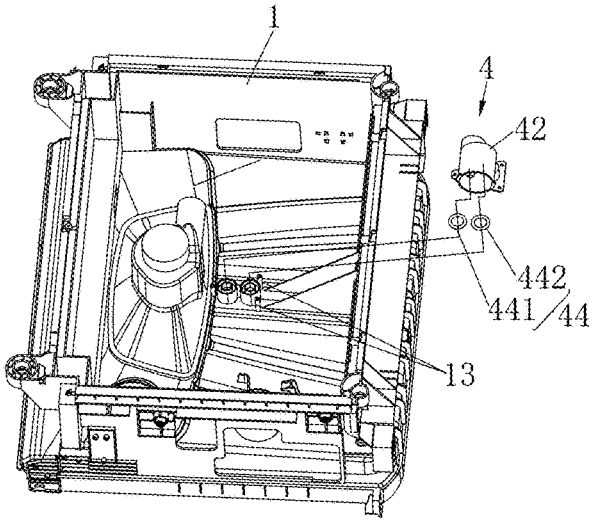
FIG. 12 is a structural schematic exploded view of the base component according to embodiment 4 of the present application.
Figure 13:
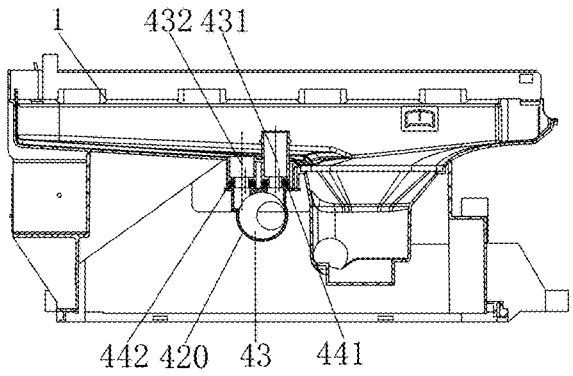
FIG. 13 is a structural cross-sectional view of base component according to embodiment 4 of the present application.

Referring to FIG. 11, the water distribution port includes a first water distribution port 4201 and a second water distribution port 4202. Both the first water distribution port 4201 and the second water distribution port 4202 are connected to the water distribution chamber 43. The water distribution pipeline includes a first water distribution pipeline 431 and a second water distribution pipeline 432, which are arranged in parallel. The first water distribution pipeline 431 is hermetically connected to the first water distribution port 4201; the second water distribution pipeline 432 is hermetically connected to the second water distribution port 4202; the cross-sectional area ratio of the flow channel of the first water distribution pipeline 431 and the second water distribution pipeline 432 is 1:5~2:7. Further, the middle spray arms and the upper spray arms can also be combined to use one channel of water. When the middle spray arms and the upper spray arms are combined to use one channel of water, the cross-sectional areas ratio of the first water distribution pipeline 431 and the combined middle and upper spray arms water channels (not shown) is 1:5. In addition, when the first water distribution pipeline 431 is connected to the lower spray arms, and the second water distribution pipeline 432 is connected to the upper spray arms, the cross-sectional area ratio of the first water distribution pipeline 431 that drives the lower spray arms and the second water distribution pipeline 432 that drives the upper spray arms is 2:7.

Figure 9:
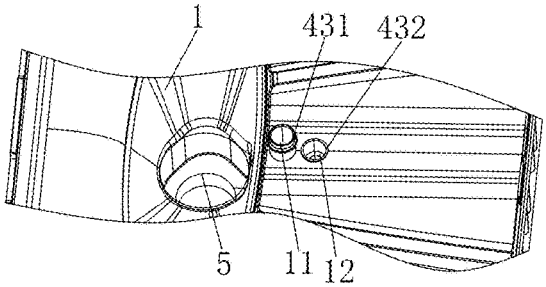
FIG. 9 is a first schematic diagram of a partial structure of base component according to embodiment 4 of the present application.
Figure 10:
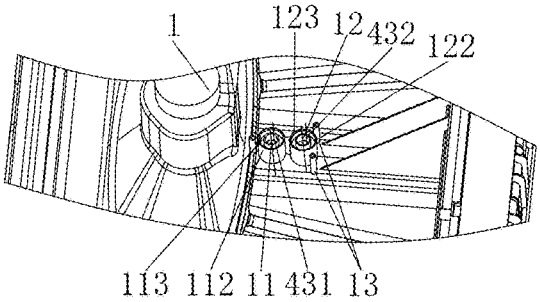
FIG. 10 is a second schematic diagram of the partial structure of the base component according to embodiment 4 of the present application.

Referring to FIG. 9, the base 1 is provided with a first perforation 11 and a second perforation 12 penetrating through the base 1; the first water distribution pipeline 431 extends above and below the base 1 from the first perforation 11 along the longitudinal direction of the base 1, respectively; the second water distribution pipeline 432 extends above and below the base 1 from the second perforation 12 along the longitudinal direction of the base 1, respectively; a first sealing shell 112 is provided outside the first water distribution pipeline 431 and below the base 1, and a second sealing shell 122 is provided outside the second water distribution pipeline 432 and below the base 1. The first sealing shell 112 is connected to the first sealing tube hermetically. The second sealing shell 122 is connected to the second sealing shell 122 hermetically.

Optionally, a first sealing chamber 113 is formed between the first sealing shell 112 and the first water distribution pipeline 431, a second sealing chamber 123 is formed between the second sealing shell 122 and the second water distribution pipeline 432. One end of the first water distribution pipeline 431 is arranged in the first sealing chamber 113 and the other end penetrates the base 1 and communicates with the lower spray arms. One end of the second water distribution pipeline 432 is arranged in the second sealing chamber 123 and the other end penetrates the base 1 and communicates with the middle spray arms. Alternatively, the other end of the second water distribution pipeline 432 is connected to the upper spray arms; or the other end of the second water distribution pipeline 432 is connected to the middle spray arms and the upper spray arms at the same time.

Referring to FIG. 11, a first connection pipe 42011 is connected to the first water distribution port 4201, a second connection pipe 42021 is connected to the second water distribution port 4202, and a first connection plate 42012 is extended on the outer periphery of the first connection pipe 42011. A second connection plate 42022 is extended on the outer periphery of the second connection pipe 42021, a first connection hole 42013 is provided on the first connection plate 42012, a second connection hole 42223 is provided on the second connection plate 42022, a positioning column 13 is on the base 1, and the positioning column 13 fits with a first connection hole 42013 and a second connection hole 42223, the first connection plate 42012 is in contact with the first sealing shell 112, and the second connection plate 42022 is in contact with the second sealing shell 122.

In the embodiment, the water distribution port includes the first water distribution port 4201, the second water distribution port 4202, and the third water distribution port, and the first water distribution port 4201, the second water distribution port 4202, and the third water distribution port are all connected to the water distribution chamber 43; the water distribution pipeline includes the first water distribution pipeline 431, the second water distribution pipeline 432, and the third water distribution pipeline; one end of the first water distribution pipeline 431 is hermetically connected to the first water outlet 4201, and the other end is connected to the lower spray arms; one end of the second water distribution pipeline 432 is hermetically connected to the second water distribution port 4202, and the other end is connected to the middle spray arms. One end of the third water distribution pipeline is hermetically connected to the third water distribution port, and the other end is connected to the upper spray arms. The cross-sectional area ratio of the first water distribution pipeline 431, the second water distribution pipeline 432, and the third water distribution pipeline is 1:3:4.

Figure 14:
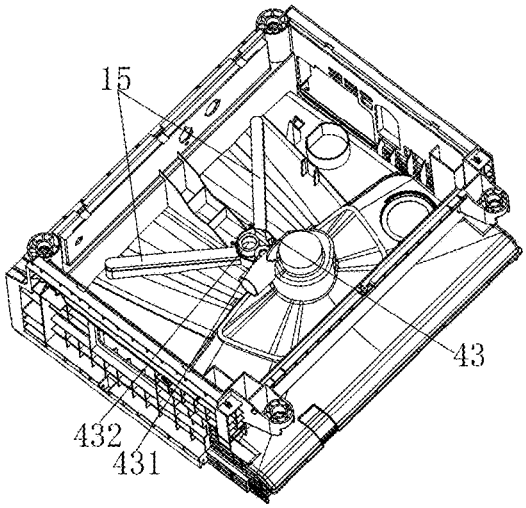
FIG. 14 is a first structural schematic diagram of base component according to embodiment 5 of the present application.
Figure 15:
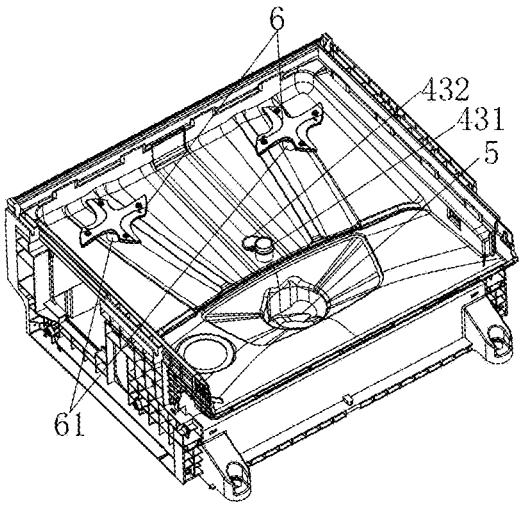
FIG. 15 is a second structural schematic diagram of the base component according to embodiment 5 of the present application.

Embodiment 5: Referring to FIGS. 14 to 15, the base component further includes a spray arm 6, and the base 1 is provided with a flow guidance channel 15. One end of the flow guidance channel 15 is in communication with the water distribution chamber 43 and the other end is in communication with the spray arm 6. The water distribution chamber 43 locates at the side of a water cup 5, the flow guidance channel 15 extends from the outer wall of the water distribution chamber 43 toward the rear end of the base 1 and communicates with the spray arm 6 at the rear end of the base 1. A spray arm seat 61 is provided between the spray arm 6 and the flow guidance channel 15. The spray arm seat 61 penetrates the base 1. The spray arm 6 is connected to the top of spray arm seat 61 and above the base 1 to spray water out of the spray arm seat 61. The flow guidance channel 15 is connected to the bottom of the spray arm seat 61 and below the base 1 to guide the water of the water distribution chamber 43 into the spray arm seat 61.

Figure 16:
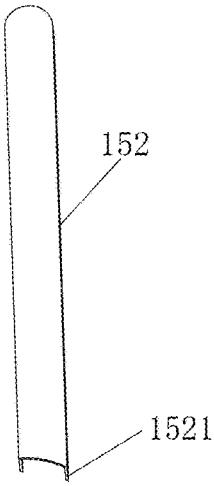
FIG. 16 is a structural schematic diagram of the upper channel plate of the base component according to the embodiment 5 of the present application.

The flow guidance channel 15 includes a lower channel plate 151 and an upper channel plate 152 connected to the lower channel plate 151; the lower channel plate 151 and the upper channel plate 152 enclose into the inner chamber together. For example, referring to FIG. 16, the upper channel plate 152 is in an arch shape, and the upper channel plate 152 is welded to the lower channel plate 151. A connector 1521 may also be provided at one end of the upper channel plate 152 to facilitate the welding of the upper channel plate 152 and the lower channel plate 151. Furthermore, it is ensured that the upper channel plate 152 and the lower channel plate 151 closely cooperate to form the flow guidance channel 15 that is closed. Further, two flow guidance channels 15 are provided. One end of each two flow guidance channels 15 is in communication with the water distribution chamber 43. The other ends of the two flow guidance channels 15 are respectively connected to two spray arm seats 61 and the spray arm seats 61 are connected to two spray arms 6, respectively; and the two spray arms 6 are arranged on both sides of the base 1, respectively.

Figure 17:
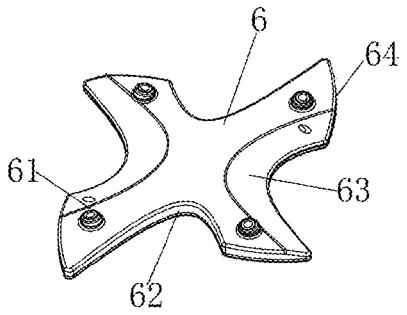
FIG. 17 is a structural schematic diagram of the spray arms of the base component according to embodiment 5 of the present application.

Optionally, referring to FIG. 14 and FIG. 17, the two flow guidance channels 15 are distributed in a V shape on the base 1. The spray arms 6 are in the cruciform shape, and the center of the spray arms 6 is connected to the spray arm seat 61. The cruciform design helps to disperse the water flow in the spray arms 6 and enhance the cleaning effect. Furthermore, the ends of spray arms 6 are set to be arc-shaped, which have arc-shaped ends 64. Such design is convenient for force loading when the spray arms 6 spray water, which reduces the overall volume of the spray arms 6, saving the use space of dishwasher. It is worth noting that small spray arms 6 can be installed on the spray arm seat 61, which can further conveniently clean the corner area of the rear end of base seat. For example, the spray arms 6 have a spray chamber 62, and the spray chamber 62 is in communication with the spray arm seat 61. The spray arms 6 are provided with spray holes 61, and water flows out from the spray holes 61. In addition, the spray arms 6 can also include a gradient section 63.

Embodiment 6: Referring to FIGS. 18 to 21, the water distribution component 4 includes a water distribution cover 42, a water distribution pipeline connected to the water distribution cover 42, a water distribution mechanism 45 arranged in the water distribution cover 42, and a sealing cover 46 connected to the water distribution cover 42 and used for the sealing water distribution mechanism 45. The water distribution cover 42 has a water distribution chamber 43, the water distribution mechanism 45 is arranged in the water distribution chamber 43, and the water distribution cover 42 is provided with at least two water distribution ports, each of which communicates with the water distribution chamber 43, respectively; the water distribution pipeline penetrates the base 1 and is arranged to have at least two pipeline sections, one end of each pipeline section communicates with each water distribution port; the water distribution mechanism 45 includes a wheel supportive mechanism 451 installed in the water distribution chamber 43, a rotating shaft 452 connected to the wheel supportive mechanism 451, an impeller 453 fitted on the rotating shaft 452 and rotating around the rotating shaft 452, and a water distribution plate 454 connected to the impeller 453. The water distribution plate 454 is driven by the impeller 453 to rotate to open or close the water distribution port.

Optionally, referring to FIG. 11, the water distribution port includes a first water distribution port 4201 and a second water distribution port 4202, and the first water distribution port 4201 and the second water distribution port 4202 both communicate with the water distribution chamber 43; the water distribution pipeline includes a first water distribution pipeline 431 and a second water distribution pipeline 432, which are arranged in parallel. The first water distribution pipeline 431 is hemetically connected with the first water distribution port 4201; the second water distribution pipeline 432 is hemetically connected with the second water distribution port 4202.

Further, the water distribution plate 454 includes a first water distribution plate 4541 for blocking the first water distribution pipeline 431 and a second water distribution plate 4542 for blocking the second water distribution pipeline 432. The first water distribution plate 4541 and the second water distribution plate 4542 are arranged at intervals. When the impeller 453 rotates, the first water distribution plate 4541 and the second water distribution plate 4542 can be rotated at the same time.

Figure 18:
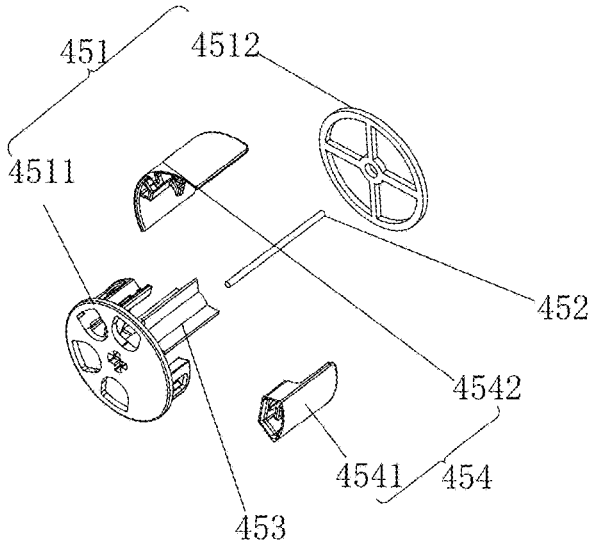
FIG. 18 is a structural schematic exploded view of the water distribution mechanism of the base component according to embodiment 6 of the present application.
Figure 19:
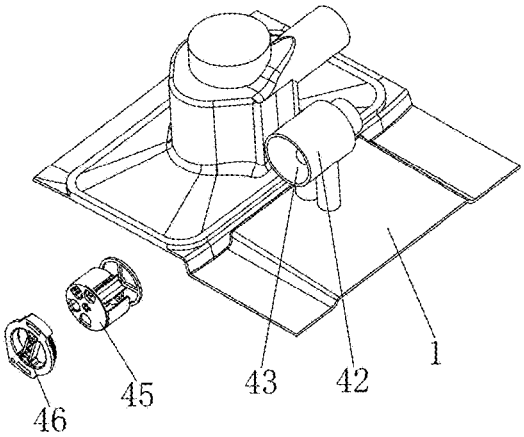
FIG. 19 is a schematic exploded view of the partial structures of the base component of embodiment 6 of the present application.
Figure 20:
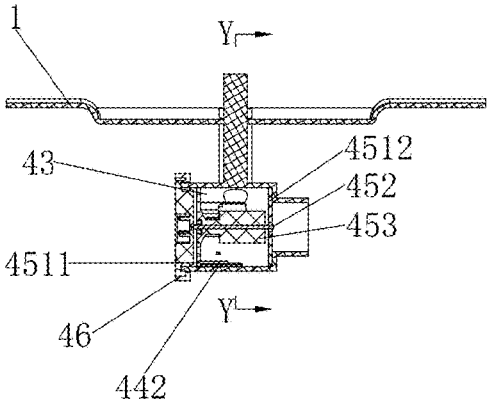
FIG. 20 is a cross-sectional view taken along lines Y-Y in FIG. 21.
Figure 21:
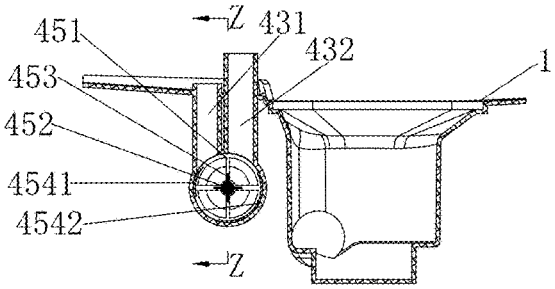
FIG. 21 is a cross-sectional view taken along lines Z-Z in FIG. 20.
Figure 22:
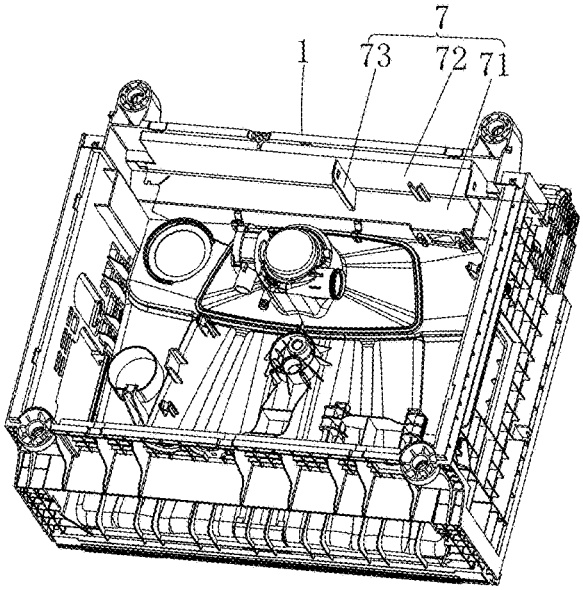
FIG. 22 is a structural schematic diagram of base component according to embodiment 7 of the present application.

Optionally, referring to FIGS. 18, 20, and 21, the wheel supportive mechanism 451 includes a first support portion 4511 connected to one end of the rotating shaft 452 and located at the sealing cover 46, and a second support portion 4512 connected to the other end of the rotating shaft 452. The impeller 453 is fitted on the rotating shaft 452 and is located between the first support portion 4511 and the second support portion 4512. The water distribution plate 454 is connected to the first support portion 4511 and is located outside the impeller 453. The water distribution plate 454 extends along the axial direction of the impeller 453 and toward one side of the second support portion 4512.

Optionally, a connector is provided on the first water distribution plate 4541 and/or a second water distribution plate 4542, a connection port is provided on the connector, and a connection block is arranged on the first support portion 4511 for inserting into the connection port. A connector is provided on the first water distribution plate 4541 and/or a second water distribution plate 4542, and a connector is provided on the first water distribution plate 4541; or, a connector is provided on the second water distribution plate 4542; or, the first water distribution plate 4541 and the second water distribution plate 4542 are both provided with a connector.

Embodiment 7: In this embodiment, the base component further includes an electric control box 8, and an installation structure 7 for installing the electric control box 8 is provided on the base 1. The installation structure 7 includes a bottom plate 71, side plates 72 provided on the bottom plate 71, a mounting plate 73 connected to the bottom plate 71 and the side plate 72. The bottom plate 71, the side plate 72, and the mounting plate 73 collectively define an installation space for installing the electric control box 8. The bottom plate 71 has a support surface 711, and the side plate 72 has a first positioning surface 721, the mounting plate 73 has a second positioning surface 7311, the support surface 711, the first positioning surface 721, and the second positioning surface 7311 are connected to each other; the first positioning surface 721 is provided with an inserting portion 722 for inserting the electrical control box 8 to the side plate 72 along the longitudinal direction of the side plate 72 in order to position a first side surface 81 of the electric control box 8, and the second positioning surface 7311 is provided with a latching portion 7312 for latching the electric control box 8 along the lateral direction of the side plate 72 to the mounting plate 73 in order to position a second side surface 82 of the electric control box 8; the inserting portion 722 and the latching portion 7312 fits with the electric control box 8 to position the electric control box 8 in the installation space. The inserting portion 722 and the latching portion 7312 facilitate the integration of the electric control box 8 on the base 1 and make installation and removal of the electric control box 8 simple.

Figure 23:
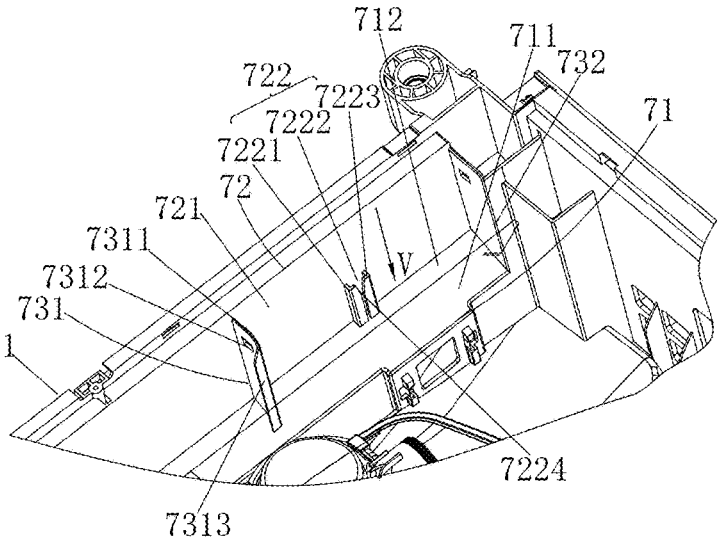
FIG. 23 is a schematic diagram of a partial structure of base component according to embodiment 7 of the present application.
Figure 24:
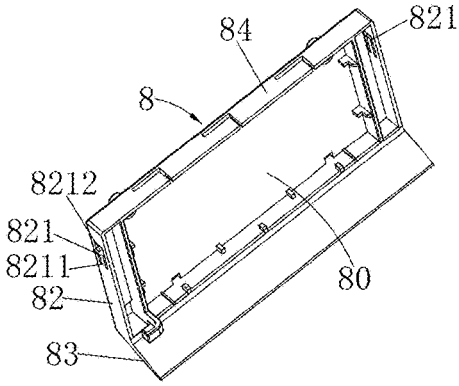
FIG. 24 is a first structural schematic diagram of an electric control box of base component according to embodiment 7 of the present application.
Figure 25:
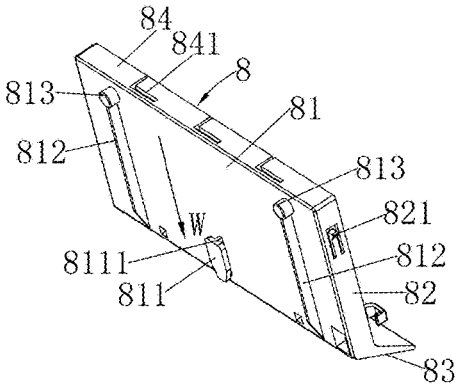
FIG. 25 is a second structural schematic diagram of an electric control box of base component of embodiment 7 of the present application.

Optionally, referring to FIGS. 23 to 25, the inserting portion 722 is arranged adjacent to the connection between the first positioning surface 721 and the support surface 711; the latching portion 7312 is arranged away from the connection between the second positioning surface 7311 and the support surface 711. At the same time, since the inserting portion 722 is arranged adjacent to the connection area between the first positioning surface 721 and the support surface 711, the latching portion 7312 is arranged away from the connection area between the second positioning surface 7311 and the support surface 711, which helps to balance the force loading of electrical control box 8 and thus stabilizing the electric control box 8 and avoiding vibration of the electric control box 8.

Figure 1:
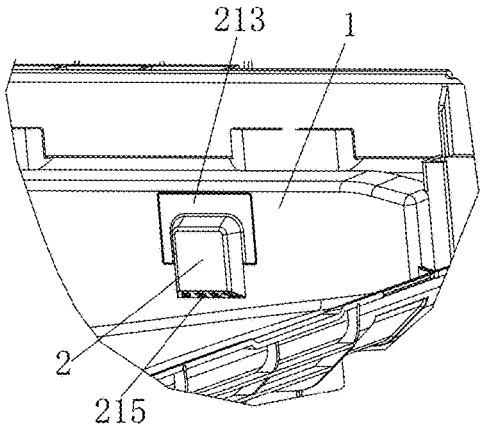
FIG. 1 is a schematic diagram of a partial structure of the base component according to embodiment 1 of the present application.

Referring to FIG. 1, the inserting portion 722 includes a first positioning protrusion 7221 and a second positioning protrusion 7223 opposite to the first positioning protrusion 7221. A plugging slot 7222 between the first positioning protrusion 7221 and the second positioning protrusion 7223 is formed for inserting into the electric control box 8.

Optionally, a connection platform 712 is further provided on the support surface 711 and located at the connection between the support surface 711 and the first positioning surface 721; the first positioning protrusion 7221 and the second positioning protrusion 7223 are both provided along the longitudinal extension of the side plate 72. Both the lower end of the first positioning protrusion 7221 and the lower end of the second positioning protrusion 7223 are in contact with the connection platform 712.

Optionally, a chamfered portion 7224 is provided on the first extension plate and/or the second extension plate and is away from the connection area between the first positioning surface 721 and the support surface 711. The latching portion 7312 is arranged as a latching hole, which penetrates the second positioning surface 7311 to latch the electric control box 8. A bent portion 2313 is arranged on the first mounting plate 731 and/or the second mounting plate 732 at one end portion away from the side plate 72 and is bent toward one side away from the inserting portion 722.

Referring to FIG. 24 and FIG. 25, the electric control box 8 includes a box body 80 having the first side surface 81, the second side surface 82, a top surface 84, and a bottom surface 83, and the first side surface 81 corresponds to the first positioning surface 721 on the base 1, the second side surface 82 corresponds to the second positioning surface 7311 on base 1, and the bottom surface 83 corresponds to the support surface 711 on the base 1. The first side surface 81 of the electric control box 8 is provided with a guide block 811 that fits with the inserting portion 722 for positioning; the second side surface 82 of the electric control box 8 is provided with a buckle 821 that fits with the latching portion 7312 to position. Support ribs 812 are also provided on the first side surface 81 of the electric control box 8 and located on both sides of the guide block 811 to fit with the first positioning surface 721 for positioning. Each support rib 812 extends along the longitudinal direction of the first side surface 81, and one end of the support rib 812 is connected to a support post 813. A notch 841 penetrating the box body 80 is also provided at the top surface 84, and the cross section of the notch at the top surface 84 of the electric control box 8 is L-shaped.

The guide block 811 includes a guide rib 8111 extending along a longitudinal direction of the first side surface 81 and used for inserting with the inserting portion 722, and the guide rib 8111 is provided with a chamfer. Through the provided guide rib 8111, the guide rib 8111 fits with the insertion groove 7222, and can be quickly inserted into the side plate 72.

Figure 26:
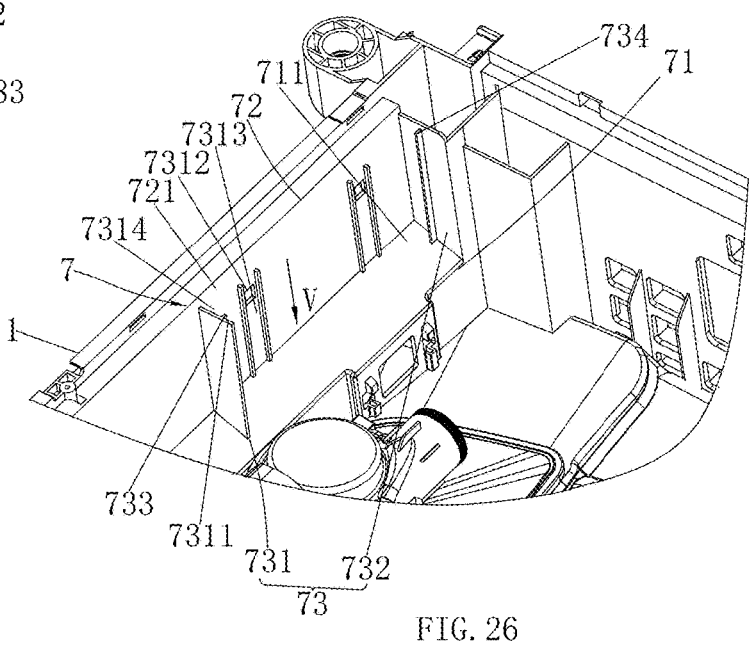
FIG. 26 is a partial structural schematic diagram of the base component according to the embodiment 8 of the present application.
Figure 27:
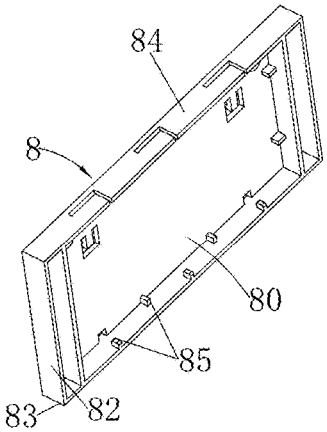
FIG. 27 is a first structural schematic diagram of the electric control box of the base component according to the embodiment 8 of the present application.
Figure 28:
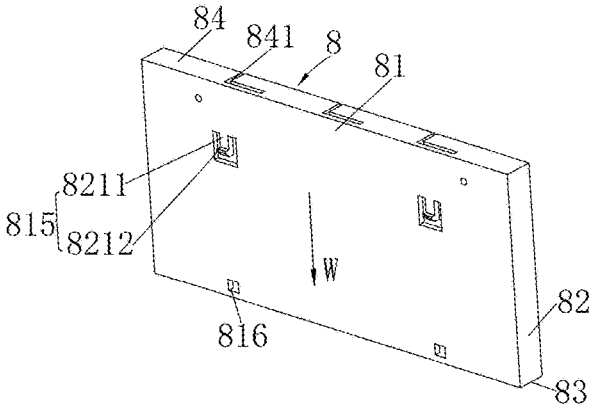
FIG. 28 is a second structural schematic diagram of the electronic control box of the base component according to the embodiment 8 of the present application.

Embodiment 8: Referring to FIGS. 26 to 28, an installation structure 7 for installing an electric control box 8 is provided on the base 1; the installation component 7 includes a bottom plate 71, a side plate 72 provided on the bottom plate 71, and a mounting plate 73 connecting the bottom plate 71 and the side plate 72. The bottom plate 71, the side plate 72, and the mounting plate 73 collectively define an installation space for installing the electric control box 8. The bottom plate 71 has a support surface 711, the side plate 72 has a first positioning surface 721, and the mounting plate 73 has a second positioning surface 7311. The support surface 711, the first positioning surface 721, and the second positioning surface 7311 are connected to each other; the first positioning surface 721 is provided with a latching portion 7312 for engaging with the electric control box 8 and a first groove body 7313 extending longitudinally along the side plate 72 and configured to support the first side surface 81 of the electric control box 8, the second positioning surface 7311 is provided with a second groove body 7314 for receiving the second side surface 82 of the electric control box 8. The first groove body 7313 and the second groove body 7314 fit with the electric control box 8 so that the electric control box 8 slides into the installation space along the longitudinal direction of the side plate 72 and is engaged with the latching portion 7312. By providing the latching portion 7312 and the first groove body 7313 at the first positioning surface 721 and the second groove body 7314 at the second positioning surface 7311, the installation space is arranged to facilitate the installation of the electrical control box 8.

Optionally, the first positioning surface 721 is provided with at least two support ribs; each support rib is provided along the longitudinal direction of the side plate 72, and a first groove body 7313 is formed between each two support ribs, and the first groove body 7313 is arranged inside the latching portion 7312. The mounting plate 73 includes a first mounting plate 731 and a second mounting plate 732 opposite to each other; the first mounting plate 731, the second mounting plate 732, the bottom plate 71, and the side plate 72 collectively define an installation space, both the first mounting plate 731 and the second mounting plate 732 have a second positioning surface 7311; a second groove body 7314 is provided on the second positioning surface 7311. The first mounting plate 731 and the second mounting plate 732 are provided to facilitate the arrangement of the second groove body 7314 and guidance of the second side surface 82 of the electric control box 8.

Optionally, a first protrusion 733 is provided on the first mounting plate 731, and the first protrusion 733 extends along the longitudinal direction of the first mounting plate 731; a second protrusion 734 is provided on the second mounting plate 732, the second protrusion 734 is extended along the longitudinal direction of the second mounting plate 732; both the first protrusions 733 and the second protrusions 734 could form second groove body with 7314 with the side plate 72. In addition, the lower ends of the first protrusions 733 and/or the second protrusions 734 abut on the support surface 711. The lower ends of the first protrusions 733 abut on the support surface 711; or the lower ends of the second protrusions 734 abut on the support surface 711; or the lower ends of both the first protrusions 733 and the second protrusions 734 abut on the support surface 711.

The difference between this embodiment and the electric control box 8 of the embodiment 7 is that the first side surface 81 of the electric control box 8 is provided with a buckle 815 that fits with a slot to position, the second side surface 82 of the electric control box 8 slides in the second groove body 7314 fitly.

Referring to FIG. 28, a gap penetrating the first side surface 81 is provided at the first side surface 81. The buckle 815 includes a connection base 8211 extending downwardly from the upper end of the gap and a latching protrusion 8212 connected to the other end of the connection base 8211. The latching protrusion 8212 is arranged obliquely toward a side of the connection base 8211. In addition, a square hole 816 penetrating the first side surface 81 is also provided at the first side surface 81 to facilitate assembly. Further, a connection block 85 may be provided on the inner bottom surface of the electric control box 8. The connection block 85 is a protrusion extending upward along the inner bottom surface of the electric control box 8. The connection blocks 85 are plural and arranged at intervals.

Embodiment 9: Referring to FIGS. 29 to 33, an installation structure 7 for installing an electric control box 8 is provided on base 1; the installation structure 7 includes a bottom plate 71, a side plate 72 provided on the bottom plate 71, and a mounting plate 73 connecting bottom plate 71 and a side plate 72. The mounting plate 73 includes a first installation plate 731 and a second installation plate 732 opposite to each other. The first installation plate 731 and the second installation plate 732 collectively define an installation space for installing the electrical control box 8. The bottom plate 71 has a first support surface 71*a*, the side plate 72 has a second support surface 72*a*, the first installation plate 731 has a first limiting surface 731*a*, and the second installation plate 732 has a second limiting surface 732*a*. The first limiting surface 731*a*, the first support surface 71*a*, and the second support surface 72*a* are connected to each other. The second limiting surface 732*a*, the first support surface 71*a*, and the second support surface 72*a* are connected to each other, and the first limiting surface 731*a* and the second limiting surface 732*a* are parallel. A first sliding groove 731*b* is provided on the first limiting surface 731*a* and extends along the longitudinal direction of the first installation plate 731; a first latching portion 731*c* is provided in the first sliding groove 731*b*; a second sliding groove 732*b* is provided on the second limiting surface 732*a* and extends along the longitudinal direction of the second installation plate 732. A second latching portion 732*c* is provided in the second sliding groove 732*b*. The first sliding groove 731*b* and the second sliding groove 732*b* are matched with the electric control box 8 so that the electric control box 8 slides into the installation space along the first sliding groove 731*b* and the second sliding groove 732*b*. The two sides of the electric control box 8 are latched with the first latching portion 731*c* and the second latching portion 732*c*, respectively.

Figure 29:
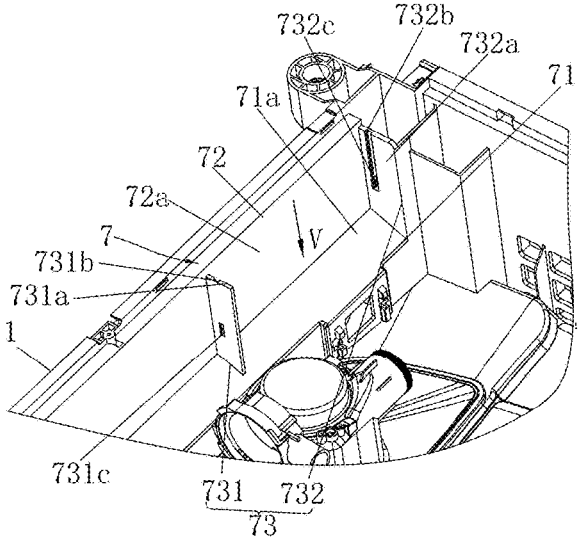
FIG. 29 is a first schematic diagram of the partial structure of the base component of the embodiment 9 of the present application.
Figure 30:
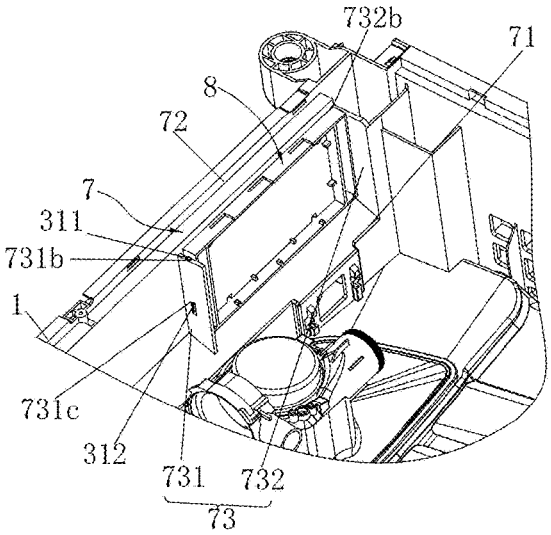
FIG. 30 is a second schematic diagram of the partial structure of the base component of the embodiment 9 of the present application.
Figure 31:
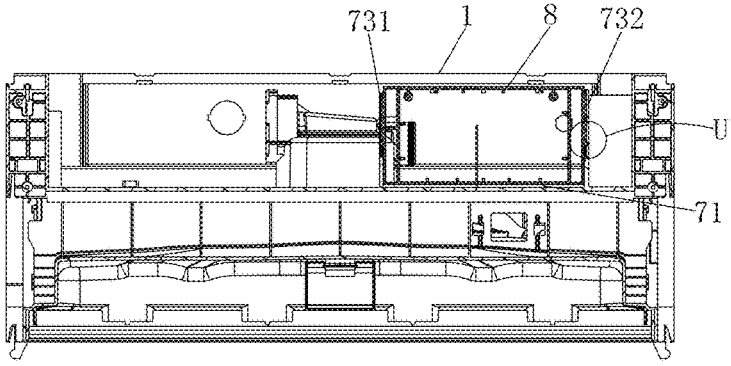
FIG. 31 is a side view of the base component of the embodiment 9 of the present application.

Optionally, referring to FIGS. 29 to 30, the first latching portion 731*c* is arranged as a first latching hole penetrating the first sliding groove 731*b*, and the second latching portion 732*c* is arranged as a second latching hole penetrating the second sliding groove 732*b*. The first latching hole and the second latching hole are arranged opposite to each other. The upper end of the first slide groove 731*b* penetrates the top surface 84 of the first installation plate 731, and the upper end of the second slide groove 732*b* penetrates the top surface 84 of the second intallation plate 732. The first slide groove 731*b* and the second slide groove 732*b* are oppositely arranged, so that it helps to smoothly guide the electric control box 8 and locate it more accurately to avoid vibration of the electric control box 8.

Figure 32:
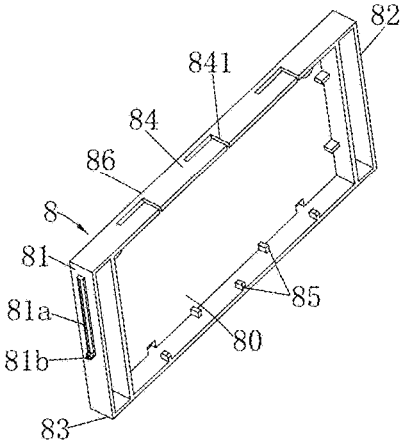
FIG. 32 is a structural schematic diagram of the electric control box of the base component of the embodiment 9 of the present application.
Figure 33:
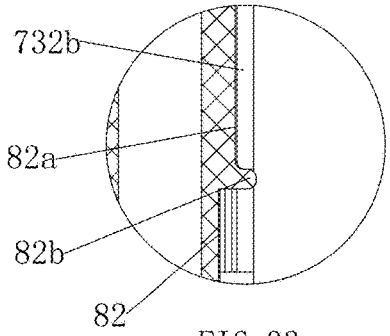
FIG. 33 is an enlarged schematic view of a partial structure at U in FIG. 32.

Referring to FIG. 32, the electric control box 8 includes a box body 80 having a first side surface 81, a second side surface 82 opposite to the first side surface 81, a third side surface 86 connecting the first side surface 81 and the second side surface 82, a top surface 84 connecting the first side surface 81, the second side surface 82 and the third side surface 86, and a bottom surface 83 connecting the first side surface 81, the second side surface 82, and the third side surface 86. The first side surface 81 corresponds to the first limiting surface 731*a* on the base 1, the second side surface 82 corresponds to the second limiting surface 732*a* on the base 1, the third side surface 86 corresponds to the second support surface 72*a* on the base 1, and the bottom surface 83 corresponds to the first support surface 71*a* on the base 1. Optionally, the first side surface 81 of the electric control box 8 is provided with a first guide rib 81*a* that fits with the first sliding groove 731*b* and a first positioning protrusion 81*b* connected to one end of the first guide rib 81*a* and engaged with the first latching portion 731*c*; the second side surface 82 of the electric control box 8 is provided with a second guide rib 82*a* that fits with the second sliding groove 732*b*, and also provided with a second positioning protrusion 82*b* connected to one end of the second guide rib 82*a* and engaged with the second latching portion 732*c*.

Embodiment 10: Referring to FIGS. 34 to 41, the base 1 is provided with an installation structure 7 for installing an electric control box 8. The installation structure 7 includes a bottom plate 71, a side plate 72 provided on the bottom plate 71, and a mounting plate 73 connecting the bottom plate 71 and the side plate 72. The bottom plate 71, the side plate 72, and the mounting plate 73 jointly define an installation space for installing the electric control box 8. The bottom plate 71 has a first support surface 71*a*, the side plate 72 has a second support surface 72*a*, and the mounting plate 73 has a limiting surface. The first support surface 71*a*, the second support surface 72*a*, and the limiting surface are connected to each other. The first support surface 71*a* is provided with a fastening portion for fastening with the electric control box 8 to locate the bottom surface 83 of the electric control box 8. A slide groove for accommodating the side surfaces of the electric control box 8 is provided on the limiting surface and extends along the longitudinal direction of the mounting plate 73. The slide groove fits with the electric control box 8 so that the electric control box 8 slides into the installation space along the slide groove.

Optionally, the fastening portion is arranged as a holding groove 7*a* penetrating the bottom surface 83 of the first support surface 71*a*.

Figure 34:
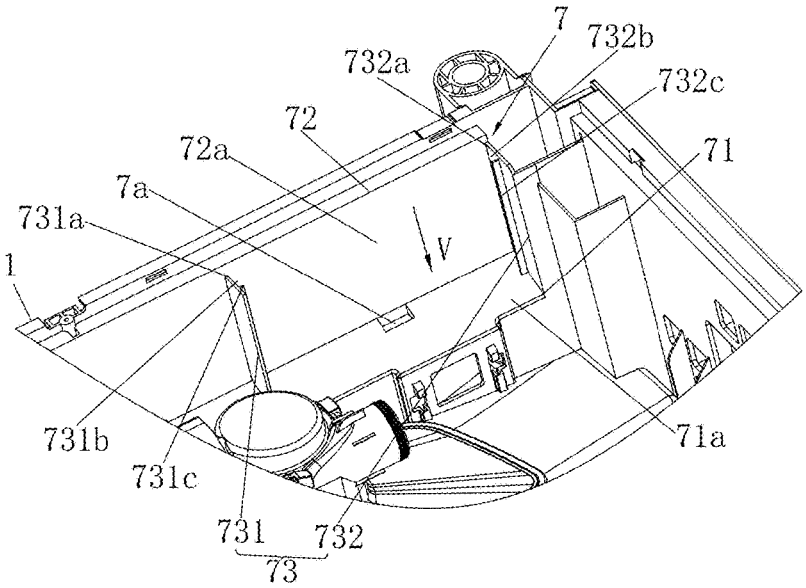
FIG. 34 is a first schematic diagram of a partial structure of the base component according to embodiment 10 of the present application.
Figure 39:
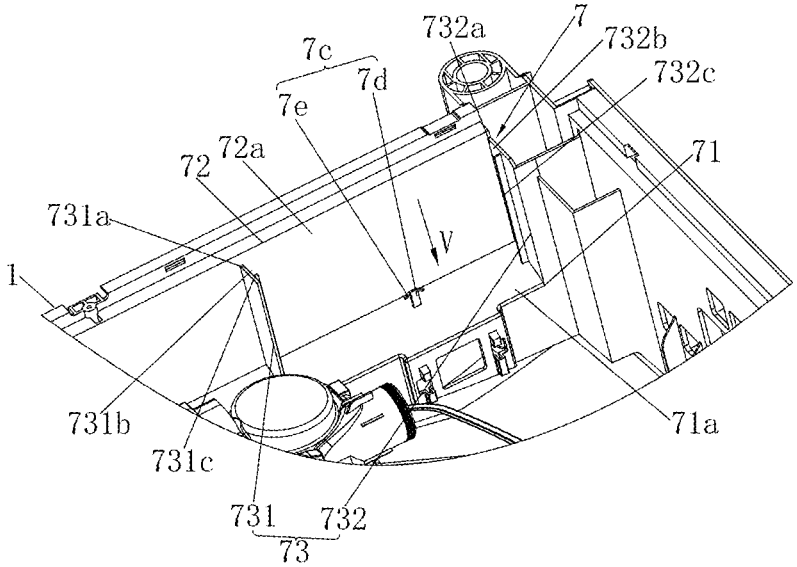
FIG. 39 is a fourth schematic diagram of a partial structure of the base component according to embodiment 10 of the present application.

Referring to FIG. 34 and FIG. 39, the mounting plate 73 includes a first mounting plate 731 and a second mounting plate 732 opposite to each other; the first mounting plate 731, the second mounting plate 732, the bottom plate 71 and the side plate 72 collectively define an installation space. The first mounting plate 731 has a first limiting surface 731*a*, and the second mounting plate 732 has a second limiting surface 732*a*. The first limiting surface 731*a* extends along the longitudinal direction of the first mounting plate 731 for receiving the first slide groove 731*b* of a first side surface 81 of the electric control box 8. The second limiting surface 732*a* extends along the longitudinal direction of the second mounting plate 732 for receiving the second slide groove 732*b* of a second side surface 82 of the electric control box 8.

Further, referring to FIGS. 34 and 39, a first protrusion 731*c* is provided on the first mounting plate 731, and the first protrusion 731*c* extends along the longitudinal direction of the first mounting plate 731; a second protrusion 732*c* is provided on the second mounting plate 732, and the second protrusion 732*c* extends along the longitudinal direction of the second mounting plate 732; a first slide groove 731*b* is formed between the first protrusion 731*c* and the side surface, and a second slide groove 732*b* is formed between the second protrusion 732*c* and the side surface.

Figure 35:
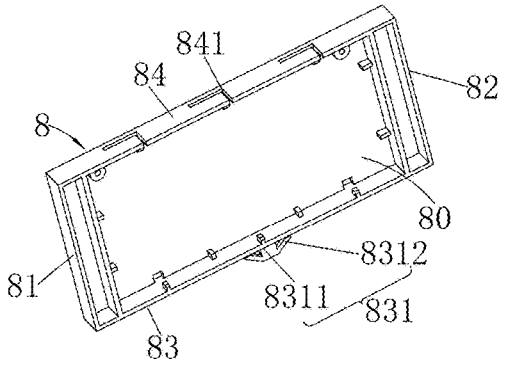
FIG. 35 is a first structural schematic diagram of the electric control box of the base component according to the embodiment 10 of the present application.
Figure 36:
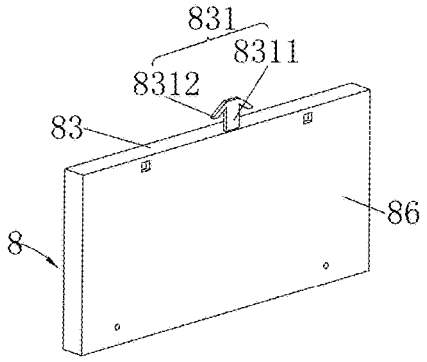
FIG. 36 is a second structural schematic diagram of the electric control box of the base component according to the embodiment 10 of the present application.
Figure 37:
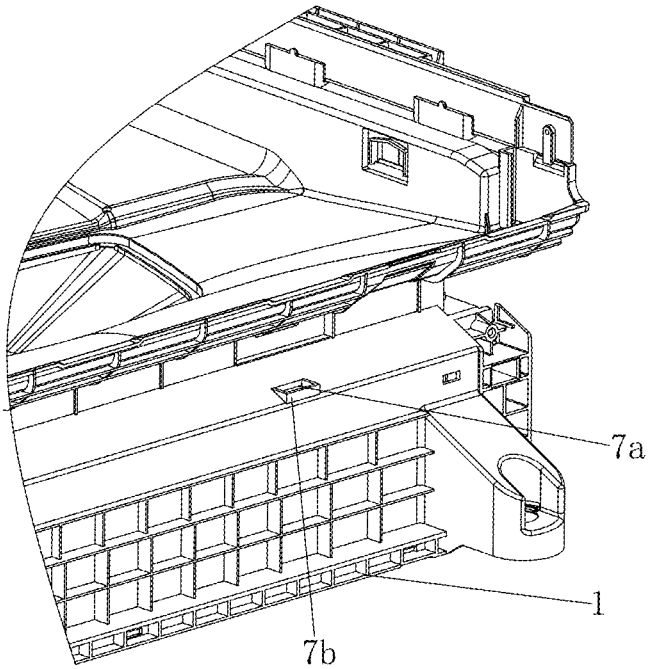
FIG. 37 is a second schematic diagram of a partial structure of the base component according to embodiment 10 of the present application.
Figure 38:
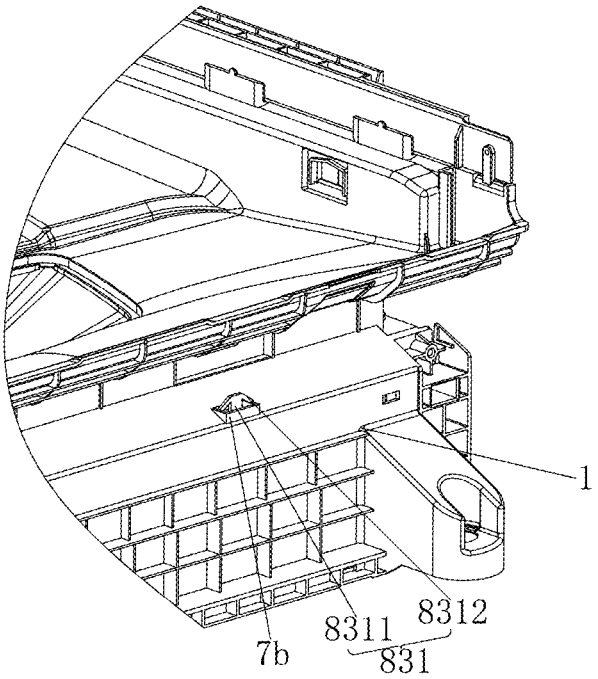
FIG. 38 is a third schematic diagram of a partial structure of the base component according to embodiment 10 of the present application.

Referring to FIGS. 35 to 36, the electric control box 8 includes a box body 80. The box body 80 has the first side surface 81, the second side surface 82, a top surface 84, a bottom surface 83, and a third side surface 86. The first side surface 81 corresponds to the first limiting surface 731*a* of the base 1. The second side surface 82 corresponds to the second limiting surface 732*a* of the base 1, the bottom surface 83 corresponds to the first support surface 71*a* of the base 1, and the third side surface 86 corresponds to the second support surface 72*a* of the base 1. Optionally, the bottom surface 83 of the electric control box 8 is provided with a holding buckle 831 that fits with the holding groove 7*a* to position; the holding buckle 831 includes a connecting shaft 8311 connected to the bottom surface 83 of the electric control box 8 and a holding block 8312 connected to the other end of the connecting shaft 8311 and is used to engage with the fastening portion, so as to stabilize the electric control box 8 in the installation space by fitting the holding groove 7*a* with the holding buckle 831. In addition, a notch 841 penetrating the box body 80 is provided at the top surface 84, and the cross section of the notch 841 at the top surface 84 of the electric control box 8 is L-shaped.

Referring to FIG. 39, another embodiment of the fastening portion is a hook 7*c* connected to the first support surface 71*a* and used to fasten the electric control box 8. The hook 7*c* includes a vertical rod 7*d* connected to the first support surface 71*a* and a guide block 7*e* connected to the other end of the vertical rod 7*d* and used to fasten the electric control box 8. The guide block 7*e* is arranged obliquely toward one side of the vertical rod 7*d*.

Figure 40:
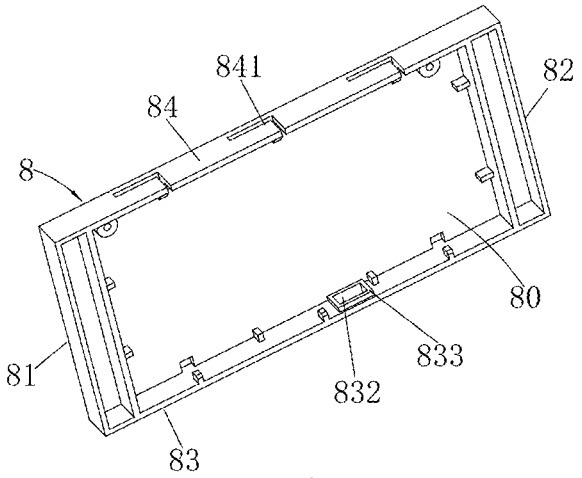
FIG. 40 is a third structural schematic diagram of the electric control box of the base component according to the embodiment 10 of the present application.
Figure 41:
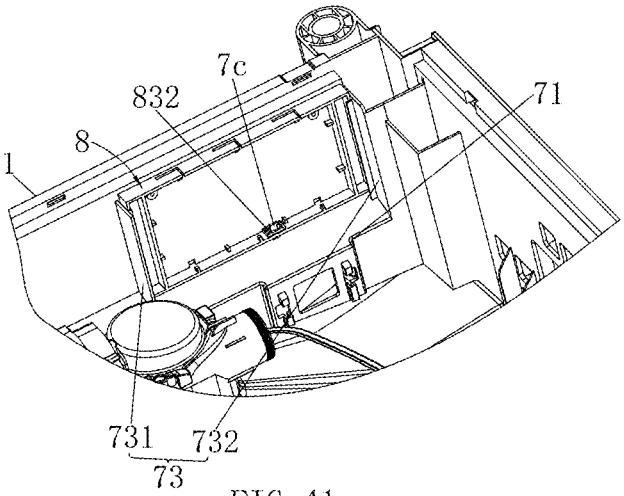
FIG. 41 is a fifth schematic diagram of a partial structure of the base component according to embodiment 10 of the present application.
Figure 42:
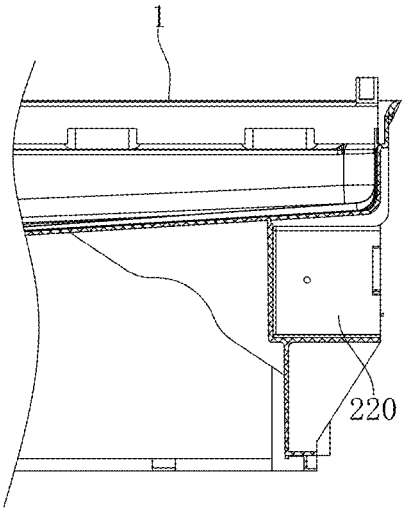
FIG. 42 is a structural cross-sectional view of the base component according to embodiment 11 of the present application.
Figure 43:
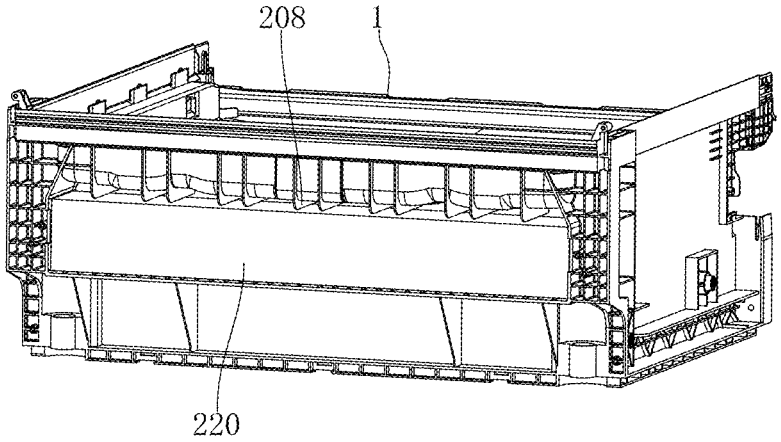
FIG. 43 is a structural schematic diagram of the base component according to embodiment 11 of the present application.

Referring to FIG. 40, the electric control box 8 includes a box body 80 having a first side surface 81, a second side surface 82, a top surface 84, a bottom surface 83, and a third side surface 86. The first side surface 81 corresponds to the first limiting surface 731*a* of the base 1, the second side surface 82 corresponds to the second limiting surface 732*a* of the base 1, the bottom surface 83 corresponds to the first support surface 71*a* of the base 1, and the third side surface 86 corresponds to the second support surface 72*a* of the base 1. Optionally, the bottom surface 83 of the electric control box 8 is provided with a fastening hole 832 penetrating the bottom surface 83 and fitting with the fastening portion for positioning, and a periphery of the fastening hole 832 is provided with a hole positioning platform 833.

Embodiment 11: Referring to FIGS. 42 to 49, the base component also includes a counterweight 220, and a rear end of base 1 is provided with an installation groove 202 that matches with the shape of the counterweight 220. The installation groove 202 includes a groove bottom wall 203, a groove top wall 204, a groove inner wall 205 and two groove side walls 206. Two sides of the base 1 are provided with screw installation holes 207 which penetrate the two groove side walls 206 respectively and communicate with the installation groove 202. The counterweight 220 is provided with counterweight screw holes 222 at both ends in the length direction. The counterweight 220 is arranged in the installation groove 202. The counterweight 220 and the surfaces of the counterweight 220 corresponding to the groove bottom wall 203, the groove top wall 204, the groove inner wall 205 and the groove side wall 206 abut the groove bottom wall 203, the groove top wall 204, the groove inner wall 205 and the groove side wall 206, respectively. The counterweight screws hole 222 corresponds to the position of the screw installation hole 207 and the locking screw 225 is lockingly connected to the counterweight screws hole 222 through the screw installation hole 207.

Figure 44:
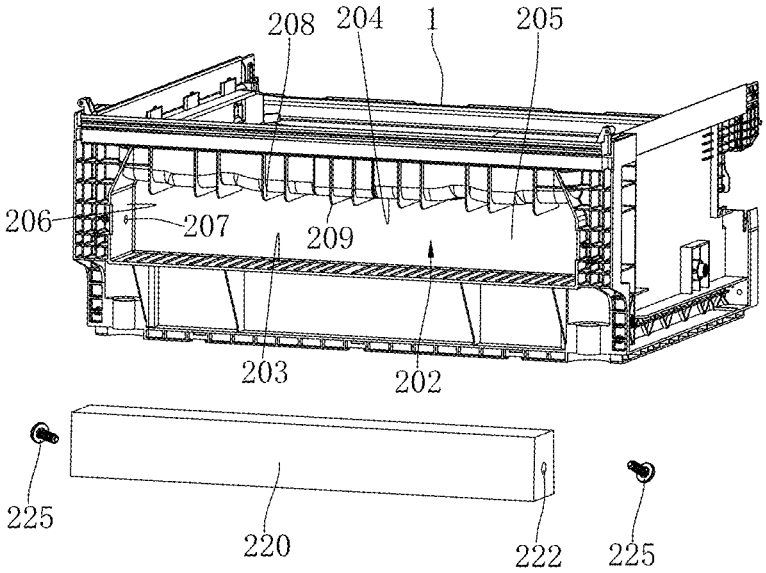
FIG. 44 is a structural exploded diagram of the base component according to embodiment 11.
Figure 45:
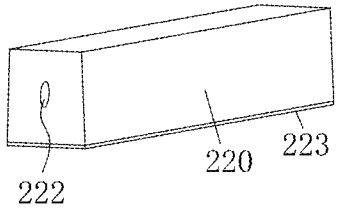
FIG. 45 is a structural schematic diagram of the counterweight of the base component according to the embodiment 11 of the present application.

Referring to FIG. 44, the groove top wall 204 is provided with a plurality of abutting ribs 208 protruding toward the groove bottom wall 203. Each of the abutting ribs 208 is arranged at intervals along the longitudinal direction of the groove top wall 204, and each of the abutting ribs 208 abuts on the top of the counterweight 220. An arc-shaped chamfer 209 is provided at the front end of each abuting rib 208.

Figure 46:
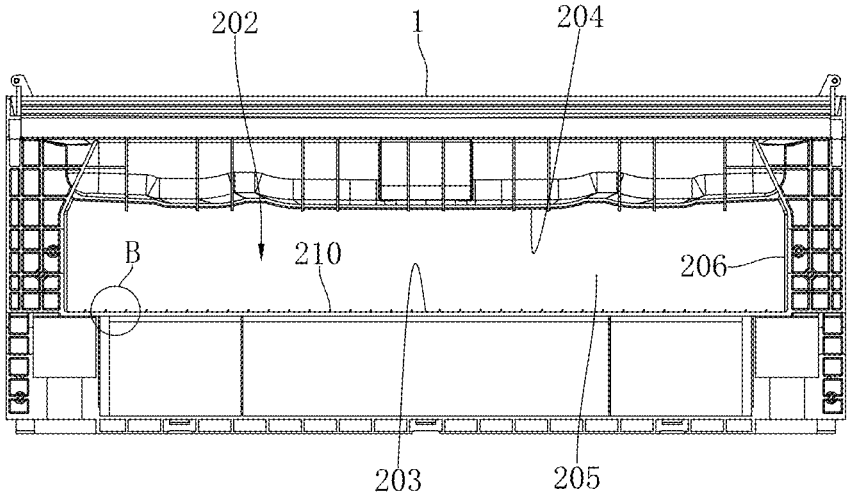
FIG. 46 is the first structural diagram of the base of the base component according to the embodiment 11 of the present application.
Figure 48:
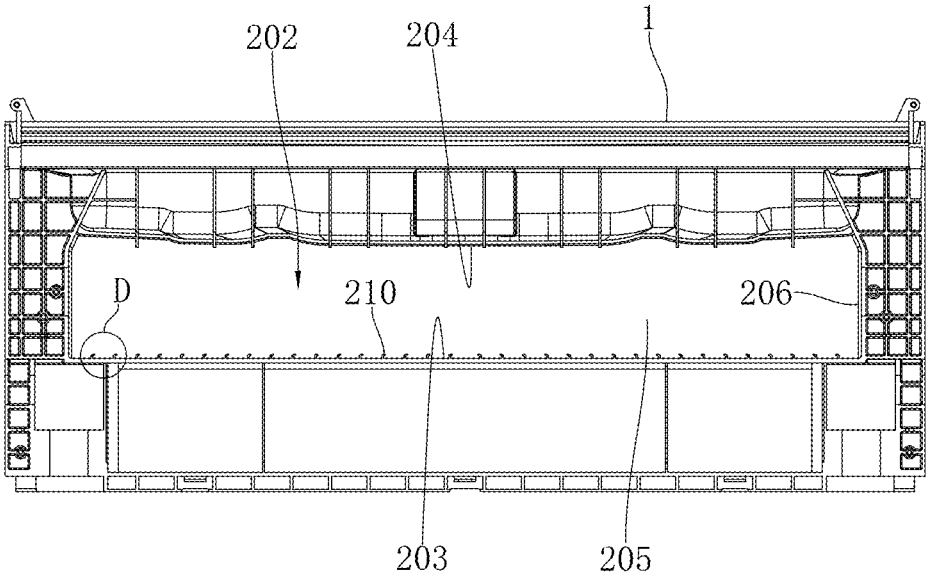
FIG. 48 is the second structural diagram of the base of the base component according to the embodiment 11 of the present application.

Referring to FIGS. 46 and 48, the groove bottom wall 203 is provided with a plurality of buffer ribs 210 facing the groove top wall 204. Each buffer rib 210 is arranged at intervals along the longitudinal direction of the groove bottom wall 203, and each of the buffer ribs 210 abuts the bottom of the counterweight 220.

Figure 47:
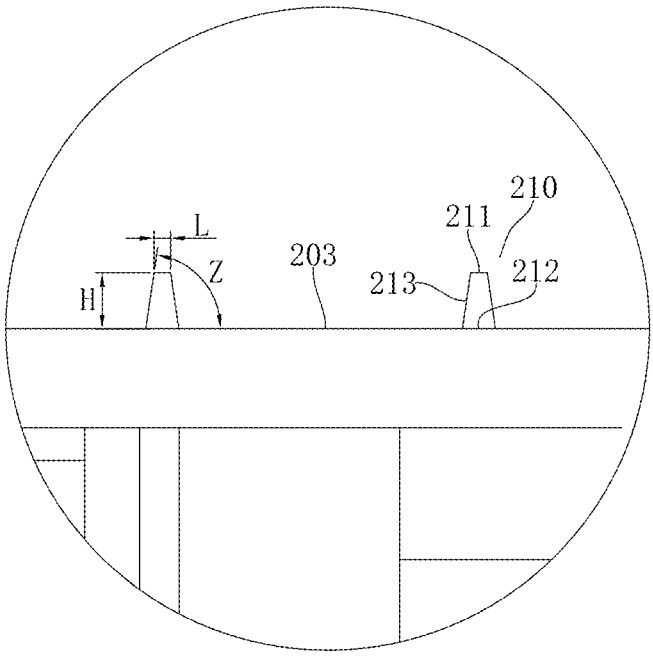
FIG. 47 is an enlarged schematic diagram of the partial structure at B in FIG. 46.

Referring to FIGS. 46 to 47, the first embodiment of the buffer rib 210 is that the buffer rib 210 includes an upper bottom edge 211, a lower bottom edge 212, and a waist edge 213 connected between the upper bottom edge 211 and the lower bottom edge 212. The width L of the upper bottom edge 211 is 0.4 mm to 0.9 mm, the distance H between the upper bottom edge 211 and the lower bottom edge 212 is 2 mm to 5 mm, and the included angle Z between the waist edge 213 and the lower bottom edge 212 is 75°~85°.

Figure 49:
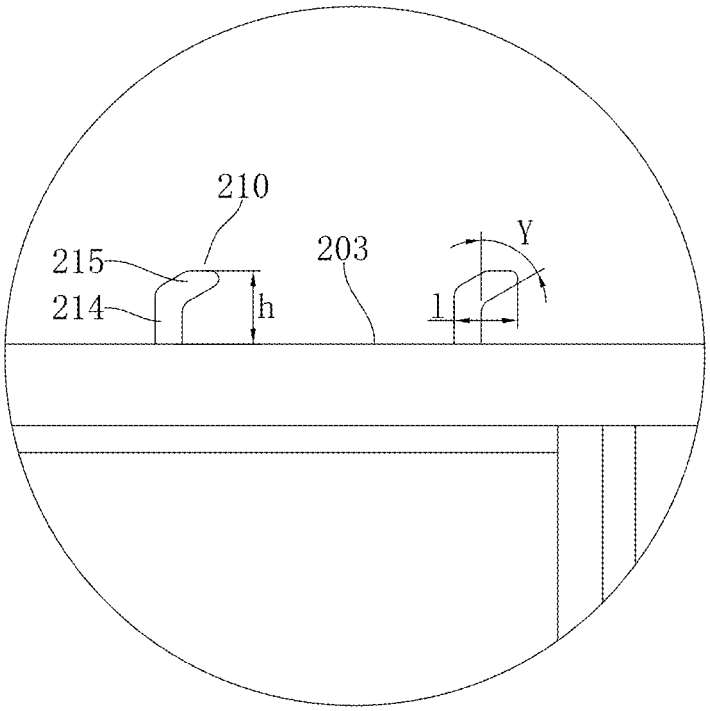
FIG. 49 is an enlarged schematic diagram of the partial structure at D in FIG. 48.

Referring to FIGS. 48 to 49, a second embodiment of the buffer rib 210 is that the buffer rib 210 includes a lower buffer rib portion 214 and an upper buffer rib portion 215, and the upper buffer rib portion 215 extends obliquely upward from the top of the lower buffer rib portion 214. The included angle Y between the upper buffer rib portion 215 and the lower buffer rib portion 214 is 35°~70°.

Further, referring to FIGS. 48 to 49, in the second embodiment of the buffer rib 210 of this embodiment, the upper buffer rib portion 215 includes a top surface (not shown), and the lower buffer rib portion 214 includes a bottom surface (not shown), the distance h between the top surface and the bottom surface is 3 mm to 7 mm, and the distance 1 from the end of the upper buffer rib portion 215 to the side end of the lower buffer rib portion 214 opposite to extending direction of the upper buffer rib portion 215 is 4 mm to 10 mm. Referring to FIG. 4, the surface of the counterweight 220 is provided with a buffer cushion 223.

Figure 50:
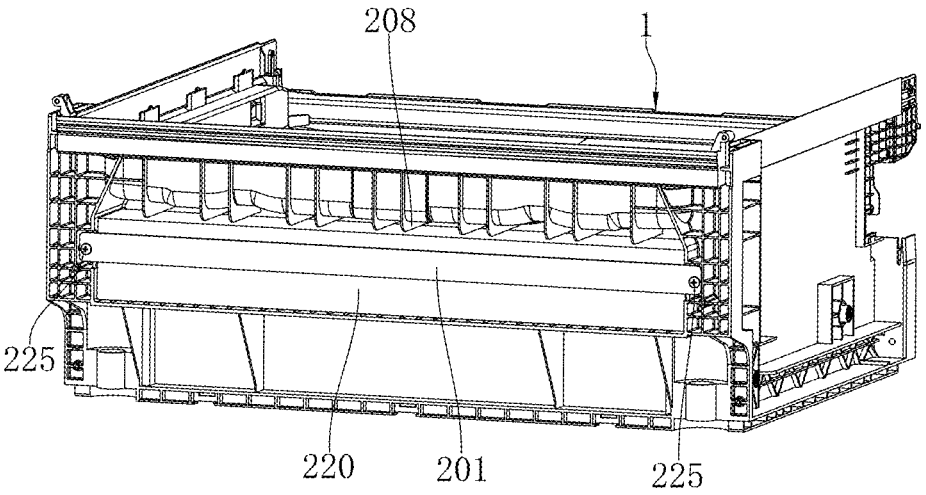
FIG. 50 is a structural schematic diagram of the base component according to the embodiment 12 of the present application.
Figure 51:
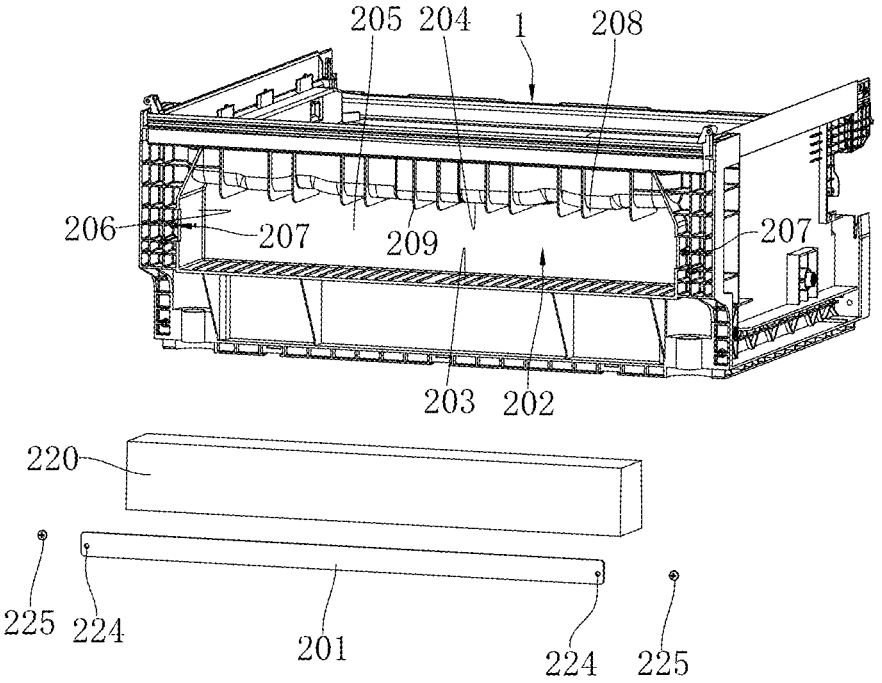
FIG. 51 is the structural exploded schematic diagram of the base component according to the embodiment 12 of the present application.

Embodiment 12: Referring to FIGS. 50 to 51, the base component further includes a counterweight 220, and the rear end of base 1 is provided with an installation groove 202 that matches with the shape of the counterweight 220. The installation groove 202 includes a groove bottom wall 203 and a groove top wall 204, a groove inner wall 205 and two groove side walls 206. The counterweight 220 is accommodated in the installation groove 202 and the surfaces of the counterweight 220 corresponding to the groove bottom wall 203, the groove top wall 204, the groove inner wall 205 and the groove side wall 206 abut the groove bottom wall 203, the groove top wall 204, the groove inner wall 205, and the groove side wall 206, respectively. The base component also include a strip stopper 201, the opposite ends of the strip stopper 201 are installed on the base 1 and prevent the counterweight 220 from coming out of the installation groove 202.

Further, the rear end of base 1 located on both sides in the longitudinal direction of the installation groove 202 is provided with a stopper installation hole 207, and the strip stopper 201 is provided with a stopper positioning hole 224 near the two ends in the longitudinal direction. The strip stopper 201 is arranged outside the opening of the installation groove 202 and spans to both sides of the installation groove 202 along the longitudinal direction of the installation groove 202. The two stopper positioning holes 224 correspond to the two stopper installation holes 207. The stopper positioning holes 224 and the stopper installation holes 207 are lockingly connected by locking screw 225 passing through the stopper positioning holes 224 and the stopper installation holes 207.

Figure 52:
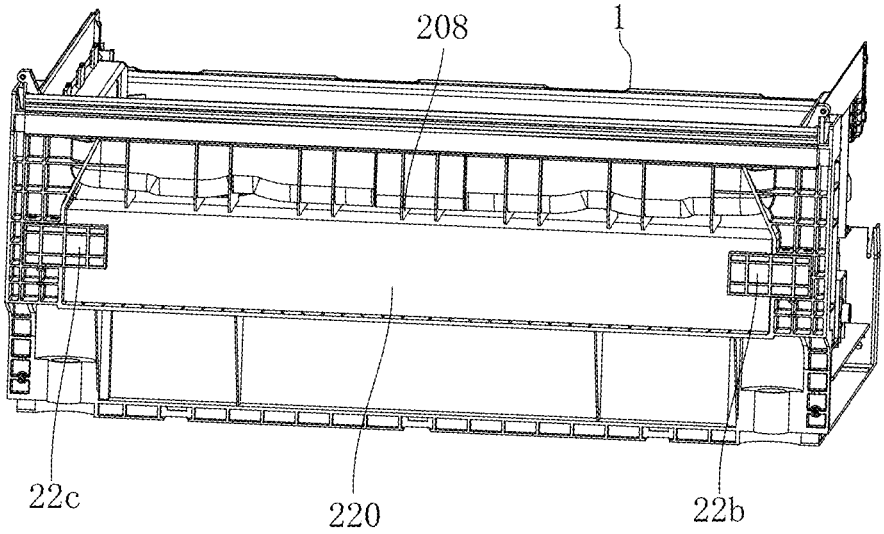
FIG. 52 is the structural schematic diagram of the base component according to the embodiment 13 of the present application.
Figure 53:
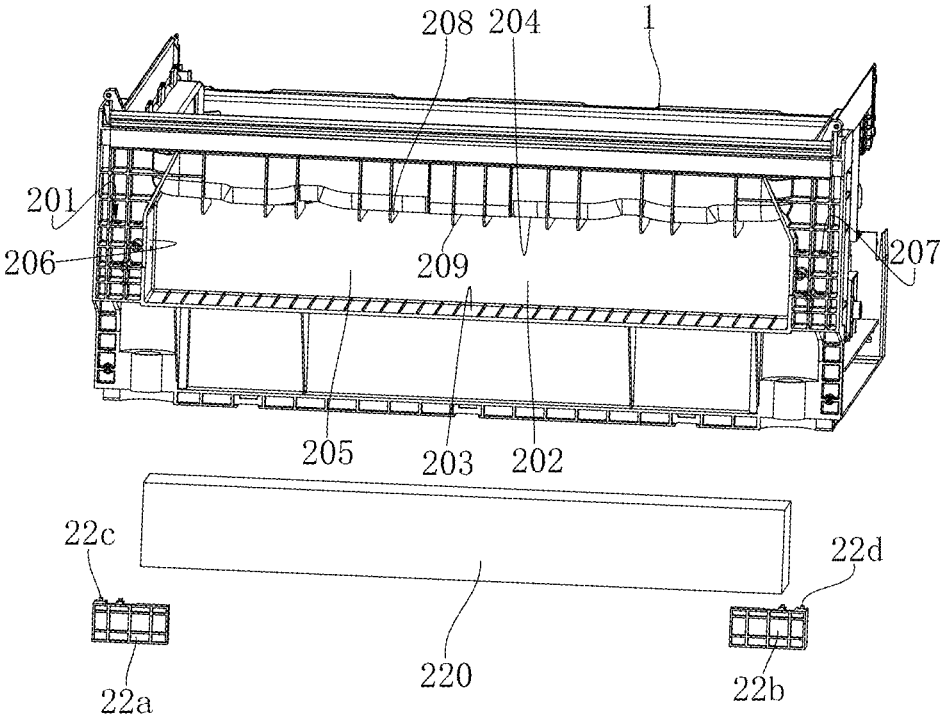
FIG. 53 is a structural schematic exploded diagram of the base component according to the embodiment 13 of the present application.

Embodiment 13: Referring to FIGS. 52 to 53, the base component of this embodiment further include a counterweight 220, and a rear end of base 1 is provided with an installation groove 202 matched with the shape of the counterweight 220, and the counterweight 220 is arranged within the installation groove 202; the base component also include a first block **22*a* and a second block 22*b*, the first block 22*a* includes a first fixed end and a first free end, the second block 22*b* includes a second fixed end and a second free end. The first fixed end and the second fixed end are fixed to the rear end of base 1, and the first free end and the second free end both extend toward the opening of the installation groove 202 and are oppositely arranged to jointly limit the counterweight 220 from coming out of the installation groove 202. The counterweight 220 is installed in the installation groove 202, so that the counterweight 220 is restricted in five directions by the groove of the installation groove 202. The first block 22*a* and the second block 22*b* are fixed to the left and right sides of the opening of the installation groove 202, thus the counterweight 220 can be limited in six directions, and the installation of counterweight 220** is stable and reliable.

Further, the first fixed end of the first block **22*a* may be fixed to the left side of the rear end of the base 1, and the first free end extends toward the opening of the installation groove 202 for restricting the left end of the counterweight 220 from coming out of the installation groove 202, and the second fixed end of the second block 22*b* is fixed to the right side of the rear end of the base 1, and the second free end extends toward the opening of the installation groove 202 for limiting the right end of the counterweight 220 from coming out of the installation groove 202**.

Further, the first block **22*a* is fixed to the left side of the rear end of the base 1 and extends toward the opening of the installation groove 202 to limit the left end of the counterweight 220 from coming out of the installation groove 202. The second block 22*b* is fixed to the right side of the rear end of the base 1 and extends toward the opening of the installation groove 202 to limit the right end of the counterweight 220 from coming out of the installation groove 202**.

Referring to FIGS. 52 to 53, in this embodiment, the left side of the rear end of the base 1 is provided with at least one left lock groove 201', and the first fixed end of the first block **22*a* is provided with a left buckle 22*c* corresponding to the position of each left lock groove 201'. Each left buckle 22*c* is engaged to each left lock groove 201' correspondingly; the right side of the rear end of the base 1 is provided with at least one right lock groove 207, and the second fixed end of the second block 22*b* is provided with each right buckle 22*d* corresponding to the positions of the right lock groove 207, and each right buckle 22*d* is engaged to each right lock groove 207** correspondingly.

Embodiment 14: Referring to FIGS. 54 to 57, the base component further include a counterweight 220, and a rear end of the base 1 is provided with an installation groove 202 matched with the shape of the counterweight 220 and a rocking cover 22*f* located at one side of the installation groove 202 and flexibly connected to the base 1 for covering the opening of the installation groove 202. The installation groove 202 includes a groove bottom wall 203, a groove top wall 204, a groove inner wall 205, and two groove side walls 206. The counterweight 220 is arranged in the installation groove 202. The surfaces of counterweight 220, corresponding to the positions of the groove bottom wall 203, the groove top wall 204, the groove inner wall 205 and the groove side wall 206, abut the groove bottom wall 203, the groove top wall 204, the groove inner wall 205 and the groove side wall 206, respectively. The rocking cover 22*f* covers the opening of the installation groove 202 and is connected to the base 1 fixedly. For the base component of this embodiment, during assembly, the counterweight 220 is installed in the installation groove 202, and then the rocking cover 22*f* is rotating until the rocking cover 22*f* covers the opening of the installation groove 202, and then the rocking cover 22*f* and the base 1 are fixedly connected. In this way, the opening of the installation groove 202 is covered by the rocking cover 22*f* to prevent the counterweight 220 from coming out of the installation groove 202 or slag dropping. In combination with the groove bottom wall 203, the groove top wall 204, the groove inner wall 205, and the two groove side walls 206 of the installation groove 202, the counterweight 220 is restricted in five directions, so that the counterweight 220 can be restricted in six directions and the installation of the counterweight 220 is stable and reliable.

Figure 54:
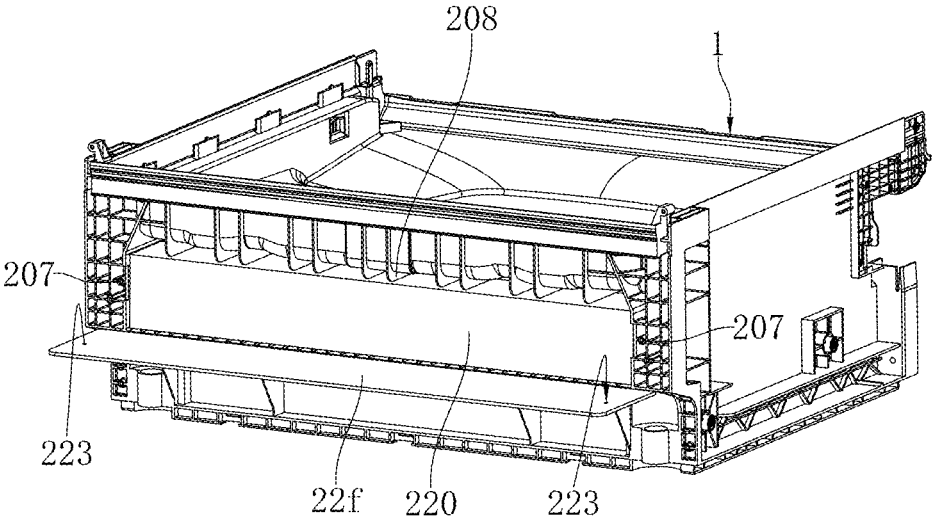
FIG. 54 is a schematic structural diagram of the base component according to the embodiment 14 of the application.
Figure 55:
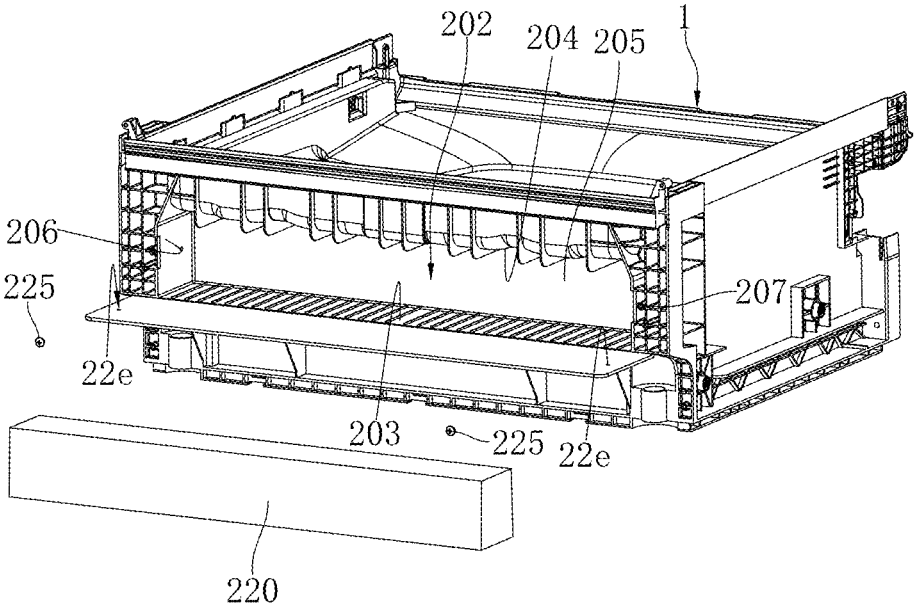
FIG. 55 is a schematic structural exploded diagram of the base component according to the embodiment 14 of the present application.

Referring to FIGS. 54 to 55, the rear end of the base 1 located on both sides of the installation groove 202 in the longitudinal direction is provided with rocking cover installation holes 207. The rocking cover 22*f* is provided with rocking cover positioning holes 22*e* near the two ends in the longitudinal direction. Two rocking cover positioning holes 22*e* correspond to the positions of the two rocking cover installation holes 207 and are lockingly connected to the rocking cover installation holes 207 through the locking screws 225. The locking screw 225 passes through the rocking cover positioning hole 22*e* and the rocking cover installation holes 207 and the rocking cover positioning hole 22*e* and the rocking cover installation holes 207 are connected by lock.

Figure 56:
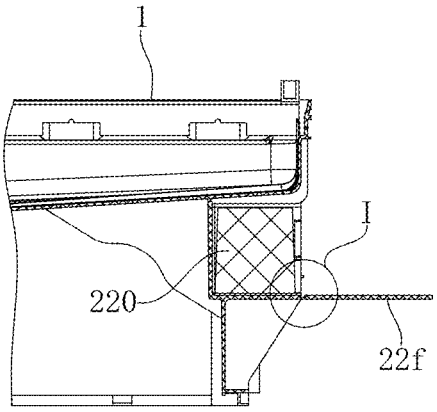
FIG. 56 is a structural cross-sectional schematic diagram of the base component according to the embodiment 14 of the present application.
Figure 57:
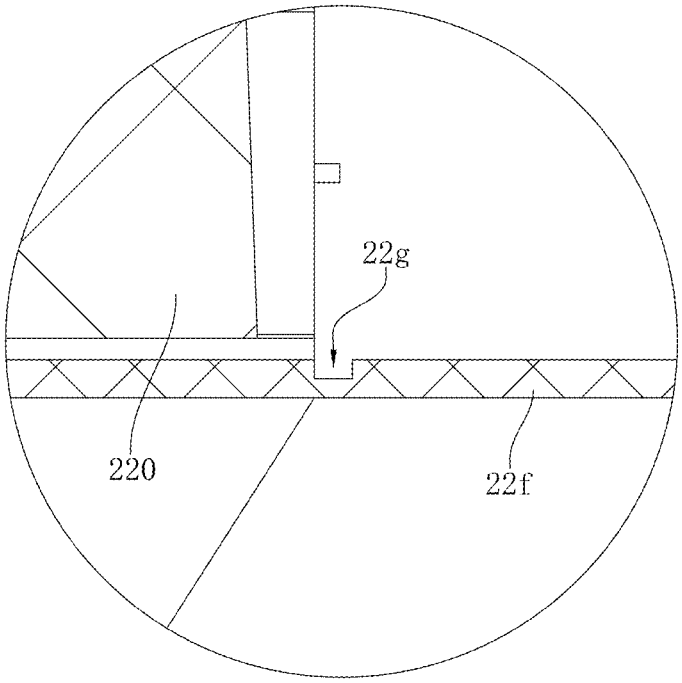
FIG. 57 is an enlarged schematic diagram of a partial structure at I in FIG. 55.

Referring to FIGS. 55 to 57, the rocking cover 22*f* can be connected to the side edge near the groove bottom wall 203 of the base 1 rotatably. The rocking cover 22*f* is formed with base 1 integrally, and a bending groove 22*g* is provided at the connection between the rocking cover 22*f* and the base 1 to facilitate rotation of the rocking cover 22*f* relative to base 1.

Figure 58:
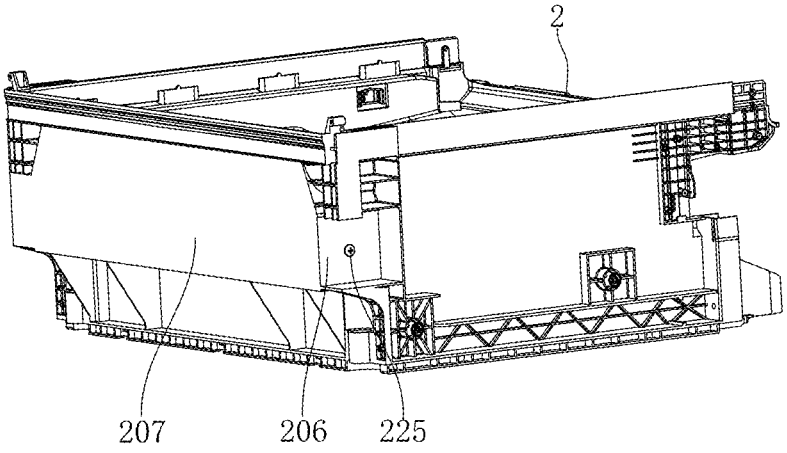
FIG. 58 is a structural schematic diagram of base component according to embodiment 15 of the present application.
Figure 59:
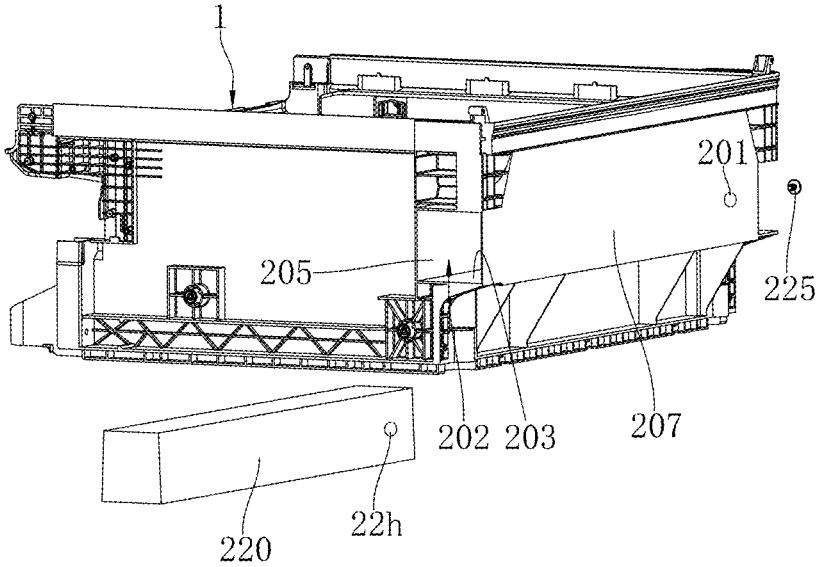
FIG. 59 is a schematic structural exploded diagram of base component according to embodiment 15 of the present application.

Embodiment 15: Referring to FIGS. 58 to 59, the base component also includes a counterweight 220, and on the one side between the front end and the rear end of the base 1, the installation groove 202 is provided near the rear end of the base 1 with a side opening. The shape of counterweight 220 matches with that of the installation groove 202, the installation groove 202 includes a groove bottom wall 203, a groove top wall 204, a groove inner wall 205, a groove outer wall 207, and a groove side wall 206. The counterweight 220 extends into the installation groove 202 from the side opening, and the side ends of the counterweight 220 opposite to the side opening abut with the groove side wall 206; the base component also include locking screws 225, the side ends of the counterweight 220 opposite to the side opening are provided with counterweight screw holes 22*h*, and the groove side wall 206 is provided with a base positioning hole 201". The locking screw 225 passes through the base positioning hole 201" and are tightly connected with the counterweight screw hole 22*h* to restrict the counterweight 220 from coming out of the installation groove 202. In the base component of this embodiment, during assembly, the counterweight 220 is inserted into the installation groove 202 from the side opening of the installation groove 202, so that the wall surface of the installation groove 202 limits the counterweight 220 in five directions, and then the locking screw 225 passes through the base positioning hole 201" and the counterweight screw hole 22*h* defined on the side end of counterweight 220 to lock the connection, so that the counterweight 220 can be prevented from coming out of the side opening of installation groove 202, thus the counterweight 220 is restricted in the sixth direction and the installation of counterweight 220 is stable and reliable.

Figure 60:
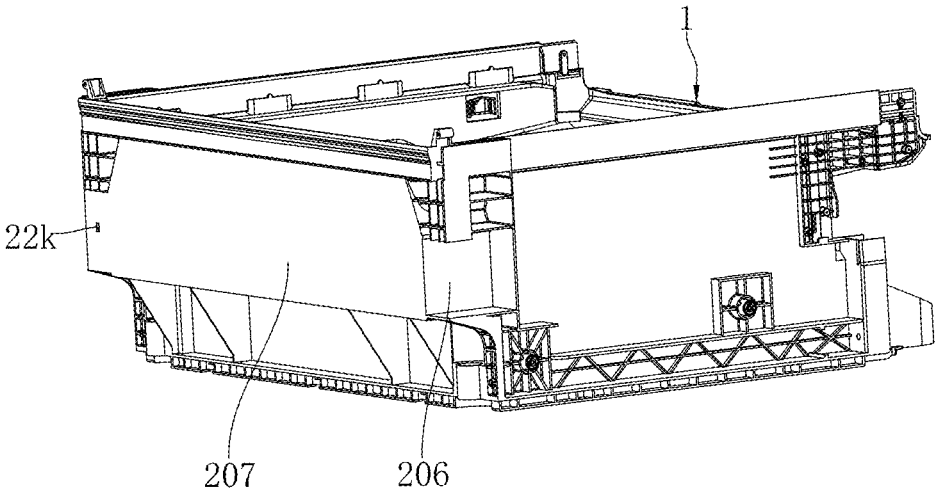
FIG. 60 is a structural schematic diagram of base component according to embodiment 16 of the present application.
Figure 61:
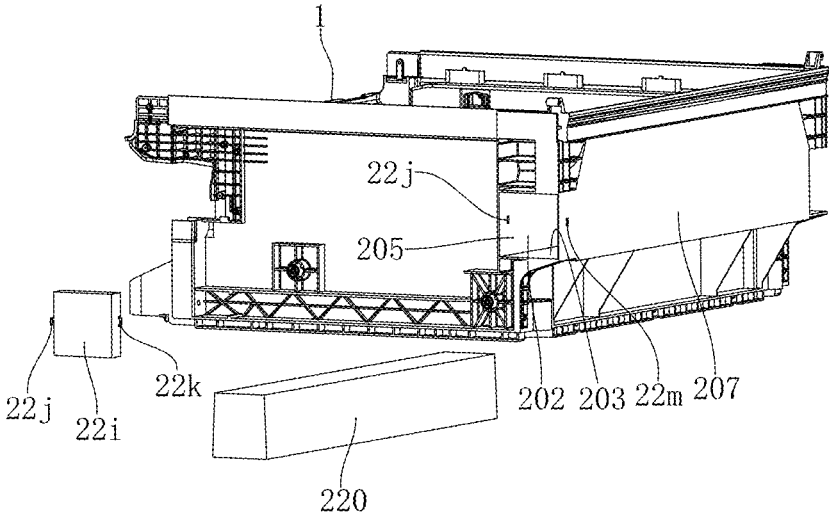
FIG. 61 is a schematic exploded view of a base component according to an embodiment 16 of the present application.

Embodiment 16: Referring to FIGS. 60 to 61, the base component also includes a counterweight 220, and on the one side between the front end and the rear end of the base 1, the installation groove 202 is provided near the rear end of the base 1 with a side opening. The shape of counterweight 220 matches with that of the installation groove 202, the counterweight 220 is accommodated and restricted in the installation groove 202; the base component also include a sealing cover 22*i*, the shape of the sealing cover 22*i* matches the shape of the side opening, and the sealing cover 22*i* seals the side opening and connects with base 1 fixedly to restrict the counterweight 220 from coming out of the installation groove 202. In the base component of this embodiment, during assembly, the counterweight 220 is installed in the installation groove 202, and the sealing cover 22*i* seals the side opening of the installation groove 202, and then the sealing cover 22*i* and the base 1 are further connected fixedly, so that the counterweight 220 is restricted by the wall surface of the installation groove 202 in five directions. In addition, the sealing cover 22*i* cover the side opening of the installation groove 202 and connects with the base 1 fixedly which can restrict the counterweight 220 in the sixth direction, and the installation of the counterweight 220 is stable and reliable. As the shape of the counterweight 220 is compatible with the shape of the installation groove 202, there is no need to arrange any protrusion and groove, thus the structure is simpler.

Referring to FIG. 61, the opposite sides of the installation groove 202 close to the side opening are respectively provided with a first lock groove 22*rl* and a second lock groove 22*rm*, and the opposite sides of the sealing cover 22*i* are provided with a first buckle 22*j* and a second buckle 22*k*, respectively. The first buckle 22*j* is engaged with the first lock groove 22*rl*, and the second buckle 22*k* is engaged with the second lock groove 22*rm*. The first buckle 22*j* can be connected to the first lock groove 22*rl* and the second buckle 22*k* can be connected to the second lock groove 22*rm*, which allows the sealing cover 22*i* to be connected to the base 1 detachably.

Figure 62:
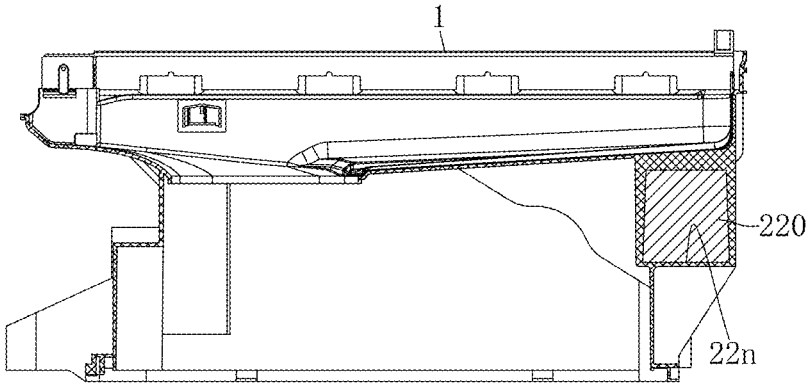
FIG. 62 is a structural schematic cross-sectional diagram of the base component according to the embodiment 17 of the present application.

Embodiment 17: Referring to FIG. 62, the base component also include a counterweight 220, the base 1 is injection molded by molten plastic placed in a mold, and the counterweight 220 is provided in the mold and integrated with the base 1 by injection molding. An installation chamber 22*n* for accommodating the counterweight 220 is formed inside the base 1 near its rear end. The base 1 is integrated in the mold by molten plastic, and counterweight 220 is placed in the mold before production. In this way, when the base 1 is injection molded, the counterweight 220 is integrated with the base 1, and the counterweight 220 is restricted to the installation chamber 22*n* formed inside the base 1 near its rear end, so that the counterweight 220 is sealed in the installation chamber 22*n* to form an integrated component.

Figure 63:
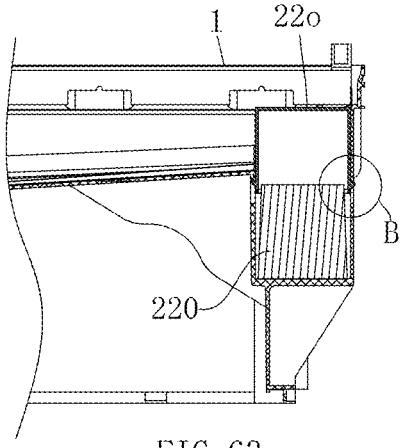
FIG. 63 is a structural schematic cross-sectional diagram of the base component according to the embodiment 18 of the present application.
Figure 64:
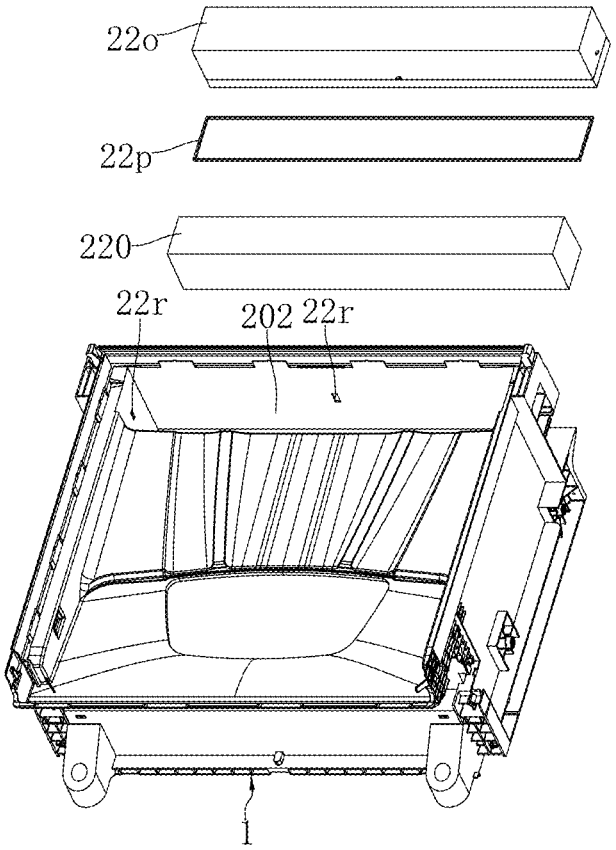
FIG. 64 is a structural exploded diagram of the base component according to embodiment 18 of the present application.
Figure 65:
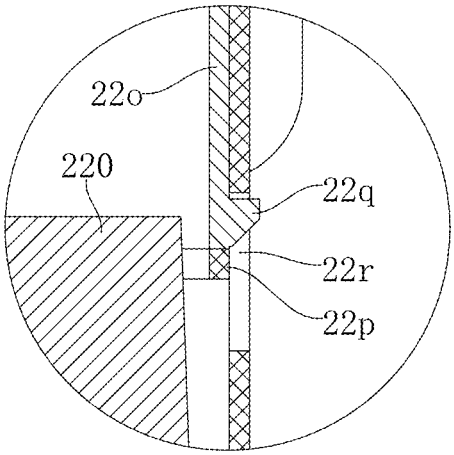
FIG. 65 is an enlarged schematic diagram of the partial structure at B in FIG. 63.

Embodiment 18: Referring to FIGS. 63 to 65, the base component also includes a counterweight 220. The base 1 is provided with an installation groove 202 near the rear end of the base 1 and extending from the top of the base 1 toward the bottom of the base 1. The shape of the installation groove 202 fits with that of the counterweight 220, and the counterweight 220 is contained within the installation groove 202. The base component also includes a sealing ring 22*p* and a cover plate 220. The cover plate 220 seals the opening of the installation groove 202 and is fixedly connected to the base 1 to restrict the counterweight 220 from coming out of the installation groove 202, and the seal ring 22*p* is clamped between the cover plate 220 and the counterweight 220.

Referring to FIG. 3 and FIG. 5, a plate buckle 22*q* is provided on a peripheral side of the cover plate 220, and a plate groove 22*r* fastened to the plate buckle 22*q* is provided at a position of the groove wall of the installation groove 202 corresponding to the plate buckle 22*q*. By using the plate buckle 22*q* and the plate groove 22*r* to engage with each other, not only can the interconnected cover plate 220 and the base 1 be connected stably, but the subsequent removal of the cover plate 220 can be quickly completed, which can achieve quick and convenient detachable connection with strong practicability.

Figure 66:
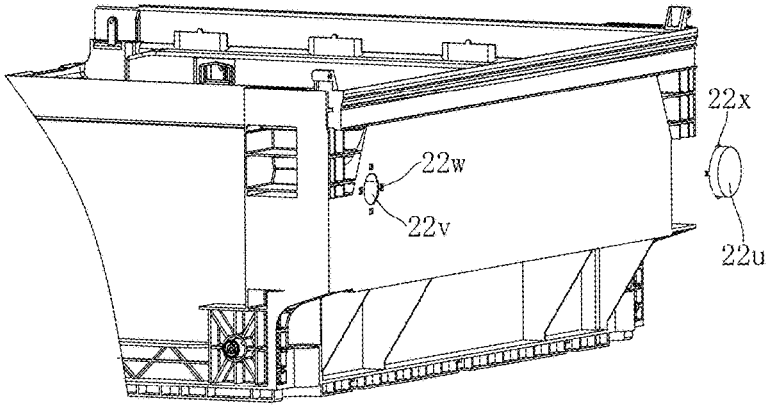
FIG. 66 is a schematic diagram of the partial structure of the base component according to embodiment 19 of the present application.
Figure 67:
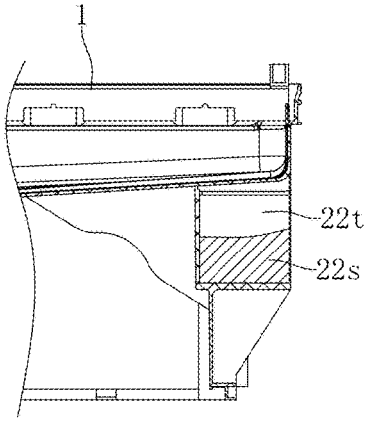
FIG. 67 is a structural cross-sectional diagram of the base component according to embodiment 19 of the present application.

Embodiment 19: Referring to FIGS. 66 to 67, the base component further include a counterweight body 22*s*, a counterweight chamber 22*t* is formed inside the base 1 near the rear end thereof, and an injection port 22*v* communicating with the counterweight chamber 22*t* is provided on the base 1, the counterweight body 22*s* is injected into the counterweight chamber 22*t* through the injection port 22*v*; the base component also include a sealing fixed cover 22*u*, which seals the injection port 22*v* and is fixedly connected to the base 1 to restrict the discharge of the counterweight body 22*s* from the injection port 22*v* to outside of the counterweight chamber 22*t*.

In this embodiment, one of the connection methods of the sealing fixed cover 22*u* and the base 1 is that a plurality of fixing lock groove 22*w* are provided on the periphery of the injection port 22*v* on the base 1. A fixing buckle 22*x* engaged with the fixing lock groove 22*w* is provided on the position of the sealing fixed cover 22*u* corresponding to the fixing lock groove 22*w*. The engagement of the fixing lock groove 22*w* and the fixing buckle 22*x* not only can ensure a stable connection between the sealing fixed cover 22*u* and the base 1, but also make it very convenient for assembly and disassembly, which facilitates subsequent maintenance.

Figure 68:
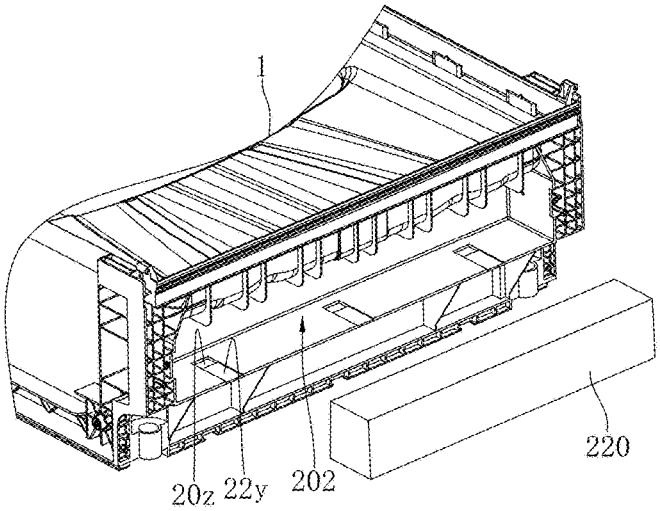
FIG. 68 is a structural exploded diagram of base component according to embodiment 20 of the present application.
Figure 69:
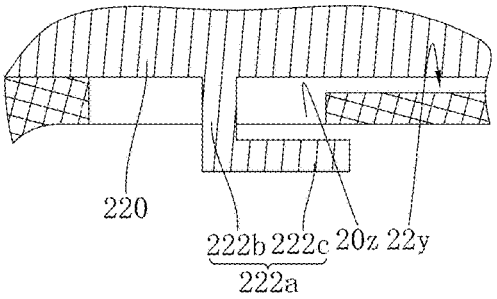
FIG. 69 is a schematic cross-sectional diagram of the partial structure of base component according to embodiment 20 of the present application.

Embodiment 20: Referring to FIGS. 68 to 69, the base component further includes a counterweight 220, and the rear end of base 1 is provided with an installation groove 202 matched with the shape of the counterweight 220. The installation groove 202 includes a groove bottom wall 203. At least one groove bottom slideway 22*y* extending from the outer end of the groove bottom wall 203 toward the inner end of the groove bottom wall 203 is provided on the groove bottom wall 203. The end of the groove bottom slideway 22*y* is provided with an installation groove 22*z*. An installation hook 222*a* corresponding to the position of the groove bottom slideway 22*y* is provided on the bottom of the counterweight 220. The installation hook 222*a* slides along the groove bottom slideway 22*y* to accommodate and restrict the counterweight 220 within the installation groove 202, and the installation hook 222*a* and the installation groove 22*z* are engaged to restrict the counterweight 220 from coming out of the installation groove 202.

Referring to FIGS. 68 to 69, each installation hook 222*a* includes a vertical post 222*b* and a horizontal slide 222*c*. The vertical post 222*b* is located at the bottom of the counterweight 220 and is vertically connected to the counterweight 220. The horizontal slide 222*c* is vertically connected to the bottom end of the vertical post 222*b*. The horizontal slide 222*c* extends toward the outer end of the counterweight 220. The horizontal slide 222*c* can play a guiding role, that is, the size of the horizontal slide 222*c* is adapted to the size of the groove bottom slideway 22*y*, so that when the horizontal slide 222*c* is fitted on the groove bottom slideway 22*y*, the horizontal slide 222*c* is capable of sliding along extending direction of the groove bottom slideway 22*y*, thereby driving the entire counterweight 220 toward the inside of the installation groove 202 until the counterweight 220 fits within the installation groove 202.

Figure 70:
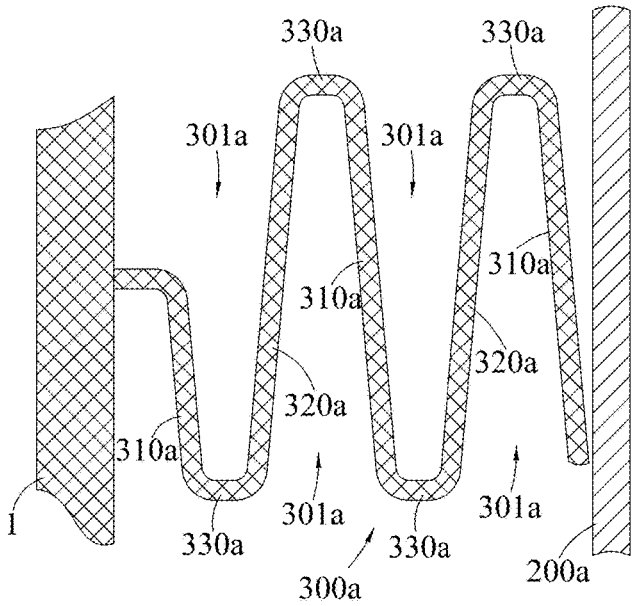
FIG. 70 is a schematic cross-sectional diagram of a top support mechanism of base component according to embodiment 21 of the present application.
Figure 71:
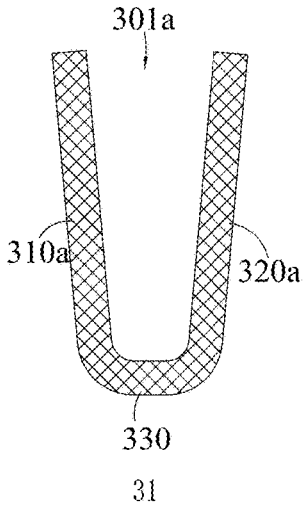
FIG. 71 is a schematic cross-sectional diagram of a partial structure of the top support mechanism of the base component according to embodiment 21 of the present application.

Embodiment 21: Referring to FIGS. 70 to 71, the base component further includes an outer plate 200*a* located outside the base 1 at intervals, and a top support mechanism 300*a* connected to the outside of the base 1 and used to support the outer plate 200*a*. Among them, base 1 may be made of plastic materials, such as PP; and the outer plate 200*a* is used as the appearance mechanism of the dishwasher, and is provided on the opposite sides of the base 1 or on the periphery of base 1. The top support mechanism 300*a* includes a first top support plate 310*a* and a second top support plate 320*a*, which are connected end to end and extend from the base 1 to the outer plate 200*a* with elastic recovery. At least one first top support plate 310*a* and one second top support plate 320*a* are provided, in which any two adjacent first support plates 310*a* and second top support plates 320*a* are arranged at an angle and form a V-shaped spacing groove 301*a*, and the opening directions of the spacing grooves 301*a* are parallel to the outer plate 200*a*.

During the clamping test, the outer plate 200*a* receives an external force toward the base 1 and squeezes the top support mechanism 300*a*. Among them, since any two adjacent first top support plates 310*a* and second top support plates 320*a* are formed into a V-shaped spacing groove 301*a* with lateral cross section, and the opening direction of the spacing groove 301*a* is parallel to the outer plate 200*a*. In a pair of adjacent first and second top support plates 310*a* and 320*a*, at least one of the first top support plate 310*a* or the second top support plate 320*a* is staggered with the outer plate 200*a*.

Further, referring to FIGS. 70 and 71, at least one pair of adjacent first and second top support plates 310*a* and 320*a*, in which both the first and second top support plates 310*a* and 320*a* are staggered with the outer plate 200*a*.

Referring to FIG. 70 and FIG. 71, at least one pair of adjacent first and second top support plates 310*a* and 320*a*, in which the first and second top support plates 310*a* and 320*a* are arranged symmetrically to the plane, parallel to outer plate 200*a* and passing through the intersection of the first and second top support plates.

Referring to FIGS. 70 and 71, the top support mechanism 300*a* includes at least one first connection plate 330*a*, and any two adjacent first and second top support plates 310*a* and 320*a* pass through the first connection plate 330*a* and the first connection plate 330*a* is perpendicular to the outer plate 200*a*. Since the first top support plate 310*a* and the second top support plate 320*a* are arranged at an angle, the intersection of the first top support plate 310*a* and the second top support plate 320*a* has a concave tip structure.

Figure 72:
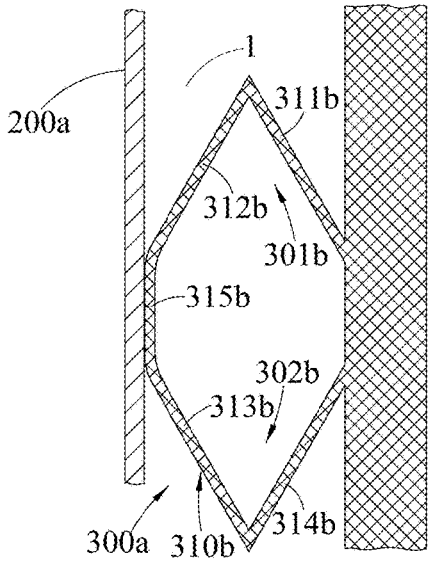
FIG. 72 is a schematic cross-sectional diagram of the top support mechanism of the base component according to embodiment 22 of the present application.

Embodiment 22: Referring to FIG. 72, the base component further includes an outer plate 200*a* located at an outside of the base 1 at intervals, and a top support mechanism 300*a* connected to the outside of the base 1 and used to support the outer plate 200*a*. Among them, the outer plate 200*a* is used as the appearance mechanism of the dishwasher, and is provided on the opposite sides of the base 1 or on the periphery of the base 1. In this embodiment, the top support mechanism 300*a* includes a top support tube 310*b*, and the top support tube 310*b* includes a first top support plate 311*b*, a second top support plate 312*b*, a third top support plate 313*b*, and a fourth top support plate 314*b* with each having elastic recovery. The first top support plate 311*b* and the second top support plate 312*b* are arranged at an angle, and form a first V-shaped spacing groove 301*b*, and the third top support plate 313*b* and the fourth top support plate 314*b* are arranged at an angle and form a second V-shaped spacing groove 302*b*, the opening directions of the first spacing groove 301*b* and the second spacing groove 302*b* are opposite to each other, and are parallel to the outer plate 200*a*, plate edges of the first top support plate 311*b* and the fourth top support plate 314*b* facing the base 1 together form a first side edge, and plate edges of the third top support plate 313*b* and the second top support plate 312*b* facing the outer plate 200*a* together form a second side edge, and the first side edge is connected to the base 1.

Referring to FIG. 72, in this embodiment, the top support tube 310*b* includes a fifth overlap plate 315*b* connecting the second top support plate 312*b* and the third top support plate 313*b*, and the fifth overlap plate 315*b* is arranged in parallel with the outer plate 200*a*.

Further, referring to FIG. 72, in this embodiment, the first top support plate 311*b* and the fourth top support plate 314*b* are arranged at an interval, the first top support plate 311*b* and the fourth top support plate 314*b* are connected through the base 1, and the cross section of top support tube 310*b* shows opening-ring shaped.

Referring to FIG. 72, in this embodiment, the first top support plate 311*b* and the fourth top support plate 314*b* is arranged symmetrically to the reference plane, which passes through the midpoint of the fifth overlap plate 315*b* and perpendicular to the fifth overlap plate 315*b*. The second top support plate 312*b* and the third top support plate 313*b* is arranged symmetrically to the reference plane, which passes through the midpoint of the fifth overlap plate 315*b* and perpendicular to the fifth overlap plate 315*b*. When performing the clamping test, the first top support plate 311*b* and the second top support plate 312*b* will generate a first interaction force between the outer plates 200*a* and the base 1, and the third top support plate 313*b* and the fourth top support plate 314*b* will generate a second interaction force between the outer plates 200*a* and base 1.

In this embodiment, the top support tube 310*b* includes a first connection plate (not shown) for connecting the first top support plate 311*b* and the second top support plate 312*b*, and the first connection plate is arranged perpendicularly to the outer plate 200*a*. Since the first top support plate 311*b* and the second top support plate 312*b* are arranged at an angle, the intersection of the first top support plate 311*b* and the second top support plate 312*b* has a concave tip structure. In this way, when the first top support plate 311*b* and the second top support plate 312*b* is deformed, the internal stress of the concave tip structure at the intersection of the first top support plate 311*b* and the second top support plate 312*b* is relatively large. The concave tip structure at the intersection is prone to break, and the adjacent first top support plates 311*b* and second top support plates and 312*b* pass a first connection plate to avoid the occurrence of concave tip structure between the first top support plates 311*b* and second top support plates 312*b* and thus solving the problem that the intersection of the first top support plate 311*b* and the second top support plate 312*b* is easily to break.

Further, both the first top support plate 311*b* and the second top support plate 312*b* are connected to the first connection plate by a circular arc, which avoids a concave tip structure between the first top support plate 311*b* and the first connection plate, and reduces the possibility of breakage between the first top support plate 311*b* and the first connection plate, and also avoids the concave tip structure between the second top support plate 312*b* and the first connection plate, reducing the possibility of breakage between the second top support plate 312*b* and the first connection plate. Both circular arc between the first top support plate 311*b*, the second top support plate 312*b* and the first connection plate are two ¼ circular arc.

In this embodiment, the top support tube 310*b* includes a second connection plate (not shown) for connecting the third top support plate 313*b* and the fourth top support plate 314*b*, and the second connection plate is arranged perpendicularly to the outer plate 200*a*. Since the third top support plate 313*b* and the fourth top support plate 314*b* are arranged at an angle, the intersection of the third top support plate 313*b* and the fourth top support plate 314*b* has a concave tip structure.

Further, both the third top support plate 313*b* and the fourth top support plate 314*b* are connected to the second connection plate by a circular arc, which avoids the concave tip structure between the third top support plate 313*b* and the second connection plate, and reduces the possibility of breakage between the third top support plate 313*b* and the second connection plate and also avoids the concave tip structure between the fourth top support plate 314*b* and the second connection plate, and reduces the possibility of breakage between the fourth top support plate 314*b* and the second connection plate.

Embodiment 23: Refer to FIGS. 73 to 76, particularly, FIG. 73, the guide rail structure 100*c* of the base component is used in combination with the bowl basket 200*c*. The bowl basket 200*c* includes a bowl frame 210*c* for carrying a bowl and a roller 220*c* connected to the bowl frame 210*c*, the direction of the scroll axis of the roller 220*c* is from left to right. The guide rail structure 100*c* includes a guide rail base 110*c*. The guide rail base 110*c* is usually integrated with the base of the dishwasher. In this way, the connection strength between the guide rail base 110*c* and the base is increased, and the guide rail base 110*c* is made of plastic material. The guide rail base 110*c* has a guide rail surface 111*c* located on the upper side thereof and arranged linearly in the front-rear direction. The guide rail surface 111*c* is arranged parallel to the horizontal plane. The guide rail base 110*c* is provided with a plurality of side water guide groove 112*c*. In this embodiment, there are nine side water guide groove 112*c*. One notch of the side water guide groove 112*c* is arranged on the guide rail surface 111*c* and the other one is arranged on the left or right side of the guide rail base 110*c*. Each side water guide groove 112*c* is arranged at intervals along the extending direction of the guide rail surface 111*c*. The ratio of the groove width of the side water guide groove 112*c* to the wheel diameter of the roller 220*c* is less than ½, and the ratio of the groove depth of the side water guide groove 112*c* in the guide rail surface 111*c* to the width of the guide rail surface 111*c* is less than 1. When the roller 220*c* passes the side water guide groove 112*c*, it will not fall to the side water guide groove 112*c*. When there is dishwashing water on the guide rail surface 111*c*, the water will flow out from the side water guide groove 112*c*, wherein the guide rail surface 111*c* is provided with a plurality of side water guide grooves 112*c*, and each side water guide groove 112*c* is arranged at intervals along the extension direction of guide rail surface 111*c*. When the dishwashing water is in any pair of adjacent side water guide groove 112*c*, the longest flow path of the dishwashing water flowing to the side water guide groove 112*c* is the distance between the pair of adjacent side water guide grooves 112*c*.

Figure 73:
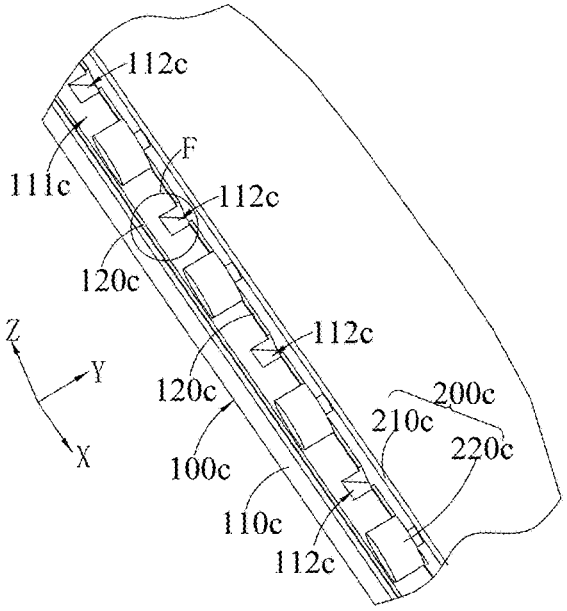
FIG. 73 is an overall structural diagram of the guide rail structure of the base component according to embodiment 23 of the present application.
Figure 74:
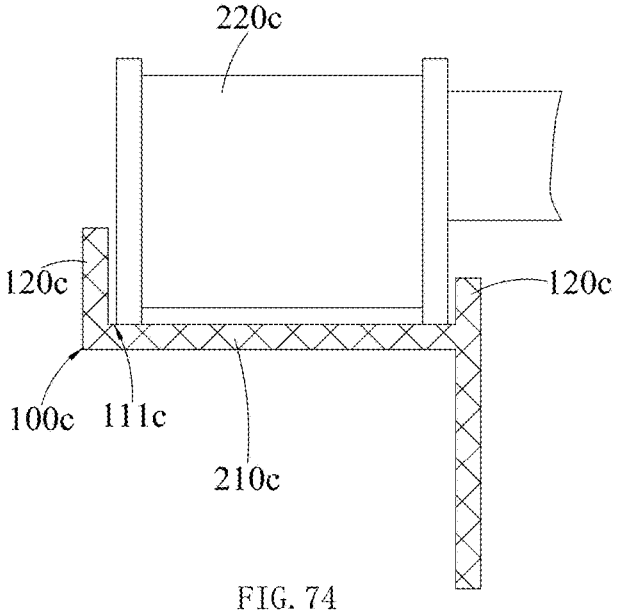
FIG. 74 is a cross-sectional diagram of the guide rail structure of the base component according to embodiment 23 of the present application.
Figure 75:
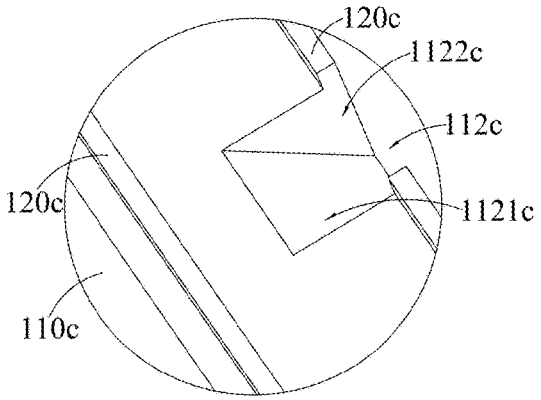
FIG. 75 is an enlarged schematic diagram of the partial structure at F in FIG. 74.
Figure 76:
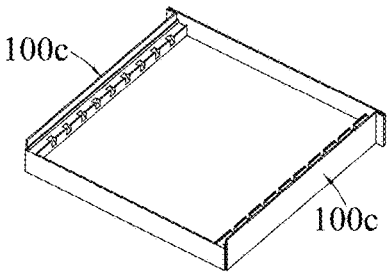
FIG. 76 is a use state diagram of a guide rail structure of base component according to an embodiment 23 of the present application.

Referring to FIGS. 73 and 75, the ratio of the groove depth of any side water guide groove 112*c* in the guide rail surface 111*c* to the width of the guide rail surface 111*c* is less than ½. A spacing between any adjacent two of the plurality of side water guide grooves 112*c* is greater than the wheel diameter of the roller 220*c*. A non-slip soft rubber layer may be laid on the guide rail surface 111*c*.

Referring to FIG. 73, the guide rail structure 100*c* includes a pair of limiting stoppers 120*c* connected to the guide rail base 110*c* and located on the guide rail surface 111*c*. The extension directions of the two limiting stoppers 120*c* are parallel to the extension direction of the guide rail surface 111*c*. The spacing between the two limiting stoppers 120*c* is slightly greater than or equal to the wheel width of the roller 220*c*. The two limiting stoppers 120*c* collectively limit the roller 220*c* to ensure that the roller 220*c* moves linearly along the guide rail surface 111*c*. In actual use, the bowl basket 200*c* includes a rotating shaft for connecting the roller 220*c* and the basket. The height of the limiting stoppers 120*c* is smaller than the distance between the rotating shaft and the guide rail surface 111*c*, in order to avoid contacting with the rotating shaft. The two limiting stoppers 120*c* may be cut off when passing through the plurality of side water guide grooves. Each of the plurality of side water guide grooves 112*c* may be collectively formed by a groove bottom wall surface 1121*c* which is in a flat shape and two groove side wall surfaces 1122*c* which are oppositely arranged in flat shapes, and both the two groove side wall surfaces 1122*c* may be perpendicular to the groove bottom wall surface 1121*c*. The groove bottom wall surface 1121*c* may be parallel to the extension direction of the guide rail surface. An angle formed between the groove bottom wall surface 1121*c* and the horizontal plane is between 60 degrees and 70 degrees.

Embodiment 24: Referring to FIGS. 77 to 80, the hanging structure in this embodiment is used to hang a motor 100*d* on an installation base (not shown). The motor 100*d* includes a main body 110*d* and two sets of hanging pillar groups 120*d* connected to the outside of the main body 110*d* and arranged at intervals. The two sets of hanging pillar groups 120*d* each include a pair of the first hanging post 121*d* and the second hanging post 122*d* both connected to the outside of the main body 110*d* and extending backward in a horizontal plane. The two hanging posts 121*d* and 122*d* are arranged in parallel. The hanging structure includes a hanging base 200*d* connected to the installation base and a hanging member 300*d*. The hanging member 300*d*, made of a flexible soft rubber material is connected to the hanging base 200*d* and used to hang the motor 100*d*. The hanging member 300*d* is located below the hanging base 200*d*. In this embodiment, the hanging member 300*d* is made of silicone and PVC soft rubber materials.

Further, each of the base disk hook 220*d* includes a hook connection portion 221*d* formed by being connected to the disk body 210*d* and extending downward, and a hook support portion 222*d* formed by connecting the free end of the hook connection portion 221*d* and extending to one side. The two hook support portions 222*d* extends in opposite directions, and through a hook hole 3101*d*, respectively.

Furthermore, each of the base disk hooks 220*d* includes a hook portion 223*d* connected to the free end of the hook support portion 222*d* and extending upward. Due to the presence of the hook portion 223*d*, the connection arm 310*d* is further restricted from being detached from the hook support portion 222*d*.

Figure 77:
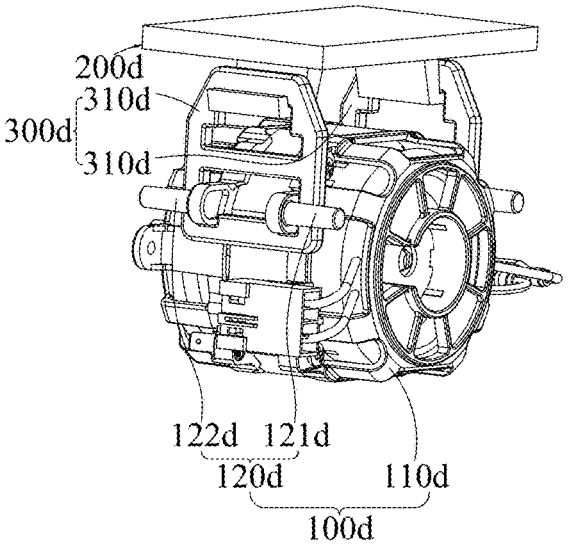
FIG. 77 is a perspective view of the use state of the hanging structure of the base component according to embodiment 24 of the present application.
Figure 78:
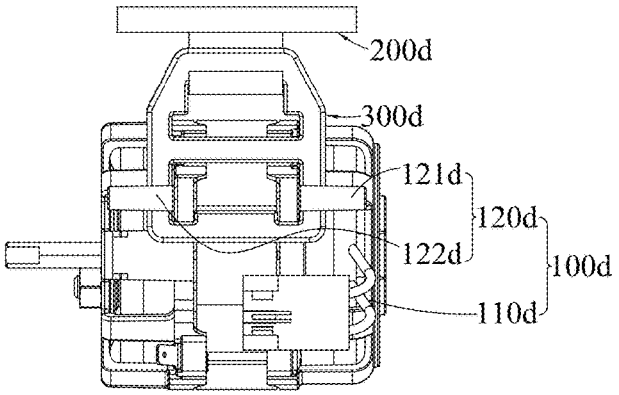
FIG. 78 is a side view of the use state of the hanging structure of the base component according to embodiment 24 of the present application.
Figure 79:
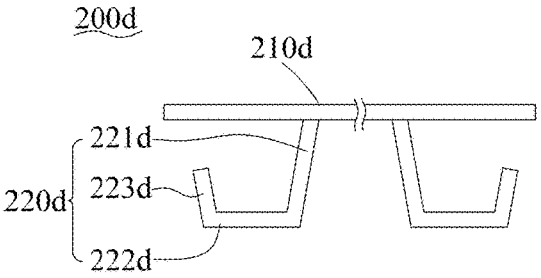
FIG. 79 is a front view of the use state of the hanging chassis of the hanging structure of the base component according to embodiment 24 of the present application.
Figure 80:
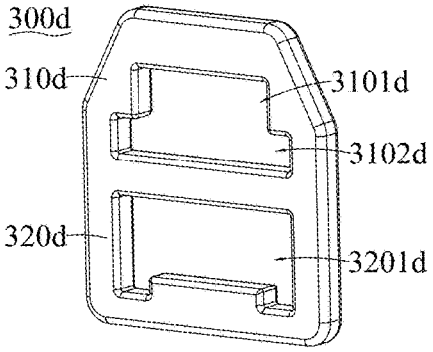
FIG. 80 is a perspective view of a hanging member of the hanging structure of the base component according to embodiment 24 of the present application.

Referring to FIGS. 77 to 78, each of the hook support portions 222*d* is arranged in a flat plate shape, parallel to the horizontal plane. The plate width of the hook support portion 222*d* in the direction perpendicular to the opening direction of the hook hole 3101*d* is slightly larger than or equal to a hole width of the hook hole 3101*d* in parallel to the hook support portions 222*d*. The hole width of the hook hole 3101*d* in the direction perpendicular to the plate surface of the hook support portion 222*d* is greater than the plate thickness of the hook support portion 222*d*. The hook support portion 222*d* and the connection arm 310*d* are in surface contact, and the contact surface is parallel to the water surface.

Referring to FIGS. 77 to 78, the connection arm 310*d* is provided with a via hole 3102*d* which is arranged in parallel with the hook hole 3101*d* and is located below the hook hole 3101*d* and communicating with the hook hole 3101*d*. The hole width of the via hole 3102*d* in a direction parallel to the hook support portion 222*d* is larger than the hole width of the hook hole 3101*d* in a direction parallel to the hook support portion 222*d*.

Referring to FIGS. 77 to 78, the hanging body includes an intermediate connection arm 310*d* for connecting the two connection arms 310*d*, and the intermediate connection arm 310*d* is connected to an end of the two connection arms 310*d* facing away from the hanging base 200*d*.

Figure 81:
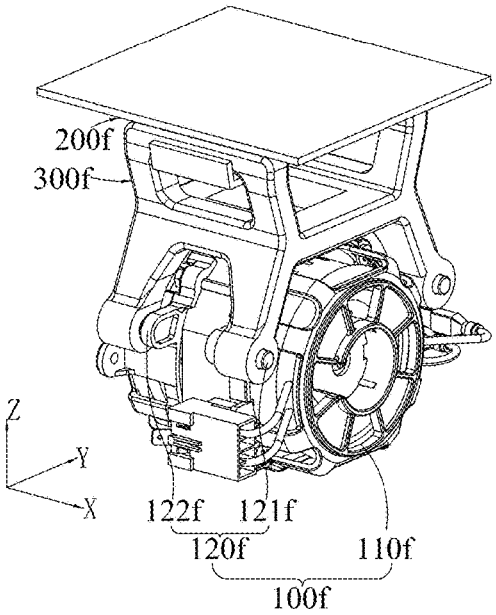
FIG. 81 is a side view of the use state of the hanging structure of the base component according to embodiment 25 of the present application.
Figure 82:
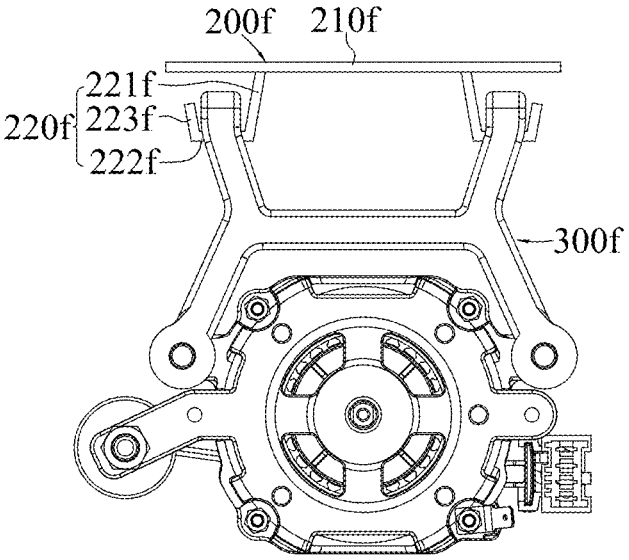
FIG. 82 is a front view of the use state of the hanging chassis of the hanging structure of the base component according to embodiment 25 of the application.
Figure 83:
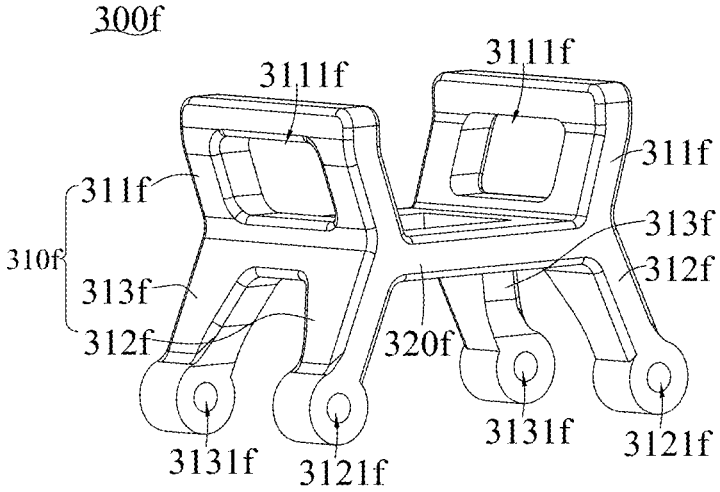
FIG. 83 is a perspective view of the hanging members of the hanging structure of the base component of according to embodiment 25 of the present application.

Embodiment 25: Referring to FIGS. 81 to 83, a hanging structure is used to hang a motor 100*f* on an installation base, wherein the motor 100*f* includes a main body 110*f* and two sets of hanging post groups 120*f* that are connected to the outside of the main body 110*f* and arranged at intervals. The two sets of hanging post groups 120*f* each include a pair of first hanging post 121*f* and a second hanging post 122*f* which are connected to the outside of the main body 110*f* and extend in a horizontal direction in opposite directions. The two first hanging posts 121*f* are arranged in parallel. Among them, the hanging structure includes a hanging chassis 200*f* connected to the installation base and a hanging body 300*f* connected to the hanging chassis 200*f* and used for hanging the motor 100*f* and made of flexible soft rubber material. The hanging body 300*f* is located on the lower side of the hanging chassis 200*f*.

Referring to FIG. 81, the distance between the openings of the first hanging hole 3121*f* and the second hanging hole 3131*f* opposite to each other is smaller than the distance between the free end of the first hanging post 121*f* and the free end of the second hanging post 122*f*.

Referring to FIG. 81 to FIG. 82, the hanging chassis 200*f* includes a disk body 210*f* connected to the installation base and a pair of base disk hooks 220*f* connected to the disk body 210*f* and arranged at an interval. Two hanging connection portions 311*f* are each provided with a hook hole 3111*f* that matches a corresponding base disk hooks 220*f*.

Further, each base disk hook 220*f* includes a hook connection portion 221*f* formed by being connected to the disk body 210*f* and extending downward, and a hook support portion 222*f* formed by being connected to the free end of the hook connection portion 221*f* and extending to one side. The two hook support portions 222*f* is formed to extend in the opposite direction, two hook support portions 222*f* pass through a hook hole 3111*f*, respectively. As the hook support portion 222*f* is formed to extend in the opposite direction, the hook support portion 222*f* is restricted from hook support portion 222*f*. During the assembly process, a certain external force is applied to the hanging connection portion 311*f*, forcing the hanging connection portion 311*f* to undergo a certain deformation, so the hook hole 3111*f* is fitted to the hook support portion 222*f*.

Furthermore, each base disk hook 220*f* includes a hook portion 223*f* formed by connecting to the free end of the hook support portion 222*f* and extending upward.

Referring to FIG. 81, each of the hook support portion 222*f* is arranged in a flat plate shape, parallel to the horizontal plane. The plate width of the hook support portion 222*f* in the direction perpendicular to the opening direction of the hook hole 3111*f* is slightly larger than or equal to the hole width of the hook hole 3111*f* in the direction parallel to the hook support portion 222*f*. The hole width of the hook hole 3111*f* in the direction perpendicular to the plate surface of the hook support portion 222*f* is greater than the plate thickness of the hook support portion 222*f*.

Referring to FIG. 81, the hanging body 300*f* includes an intermediate connection arm 320*f* for connecting the two hanging connection portions 311*f*, and the intermediate connection arm 320*f* is connected to an end of the two hanging connection portions 311*f* facing away from the hanging chassis 200*f*.

Embodiment 26: Referring to FIGS. 84 to 90, an embodiment of the present application also provides a dishwasher, which includes a liner and the above-mentioned base component. The liner is arranged above the base and is connected to the base component. Because the dishwasher of the embodiment of the present application uses the above-mentioned base component, the structural design of the base component can be more simplified, and the assembly efficiency of the dishwasher's base component is higher.

Figure 84:
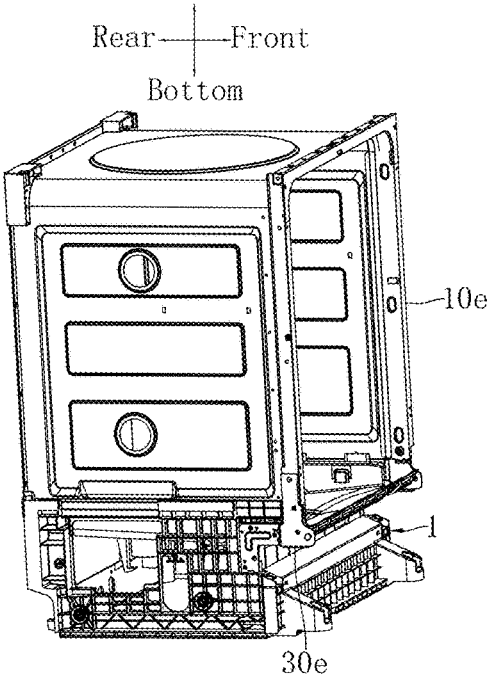
FIG. 84 is a first structural schematic diagram of a dishwasher provided in embodiment 26 of the present application.
Figure 85:
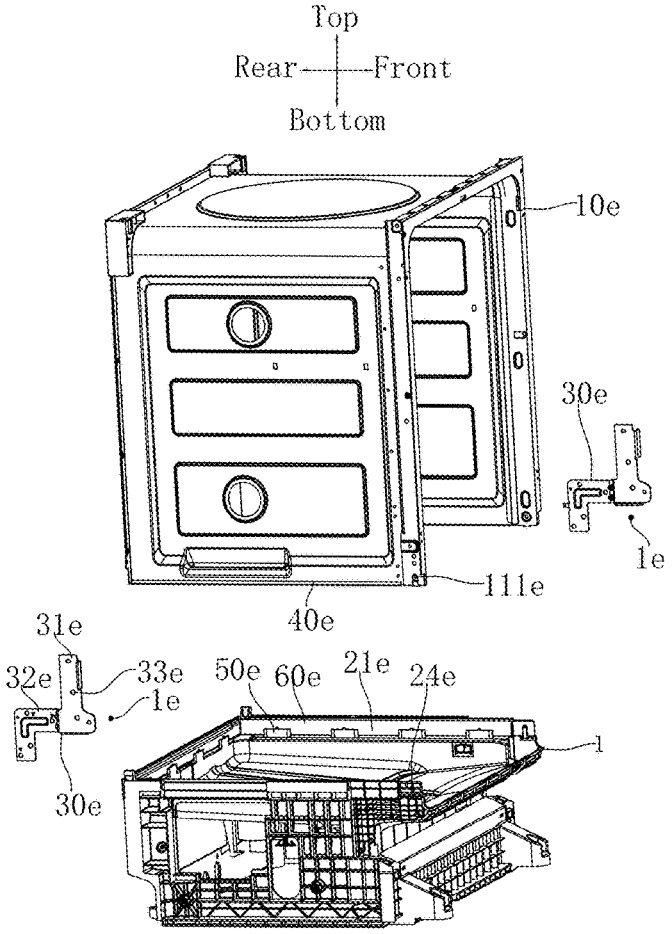
FIG. 85 is a structural exploded schematic diagram of the dishwasher provided in embodiment 26 of the present application.
Figure 86:
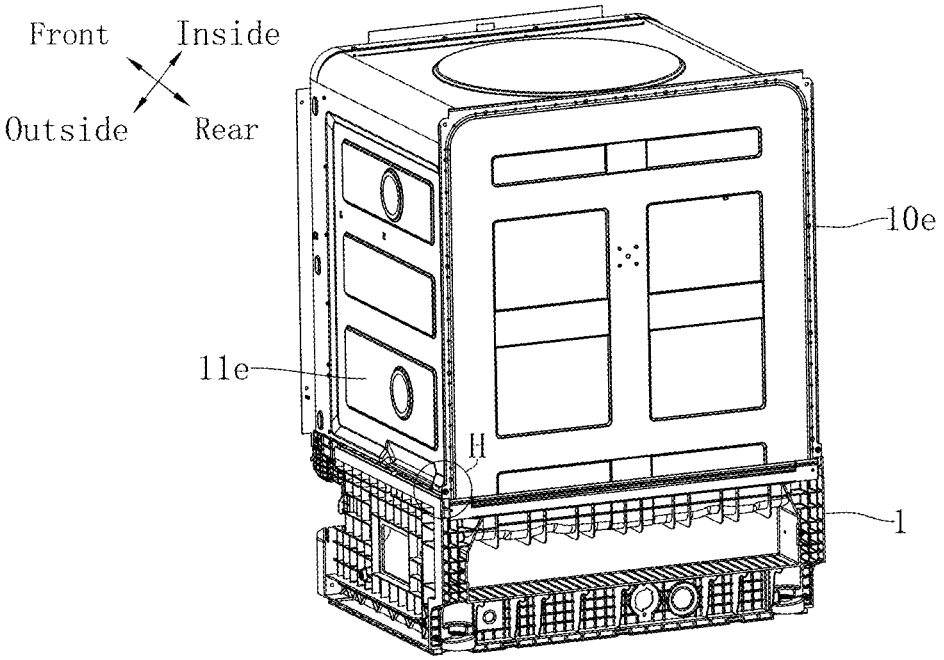
FIG. 86 is a second structural schematic diagram of a dishwasher provided in embodiment 26 of the present application.

Referring to FIGS. 84 to 85, the dishwasher further includes a hinge support mechanism 30*e* and a hinge screw 1*e*. The hinge support mechanism 30*e* includes a vertical plate 31*e* and a cross-folded plate 32*e* connected to each other. The liner 10*e* includes a side plate 11*e*. The side plate 11*e* is provided with a liner fastening hole 111*e* at the place close to the front end of side plate 11*e*. The side of the base 1 is provided with a base fastening hole 24*e* corresponding to the position of the liner fastening hole 111*e*. The vertical plate 31*e* is provided with a hinge fastening hole 33*e*. A hinge screw 1*e* sequentially passes through the liner fastening holes 111*e*, the base fastening holes 24*e*, and the hinge fastening holes 33*e* to fasten the side plates 11*e*, the base 1 and the hinge support mechanism 30*e*. The vertical plate 31*e* extends upward and is connected with the liner 10*e* fixedly. The horizontal folded plate 32*e* is connected to the rear end of the vertical plate 31*e* and extends toward the rear end of the base 1 and is fixedly connected to the side of the base 1. The arrangement of the hinge support mechanism 30*e* can effectively prevent the front end of the liner 10*e* and the front end of the base 1 from being deformed by the pressure.

Referring to FIG. 85, the hinge support mechanism 30*e* includes a vertical plate 31*e* and a cross-folded plate 32*e* connected to each other, and a hinge fastening hole 33*e* is arranged in the vertical plate 31*e*. The hinge support mechanism 30*e* has a substantially Z shape, in which a portion of the horizontal folded plate 32*e* and the vertical plate 31*e* of the hinge support mechanism 30*e* connected to the horizontal folded plate 32*e* is arranged in a hinge positioning groove (not shown) of the base 1. Another part of the vertical plate 31*e* extends upward and is provided outside the side plate 11*e* of the liner 10*e*.

Figure 87:
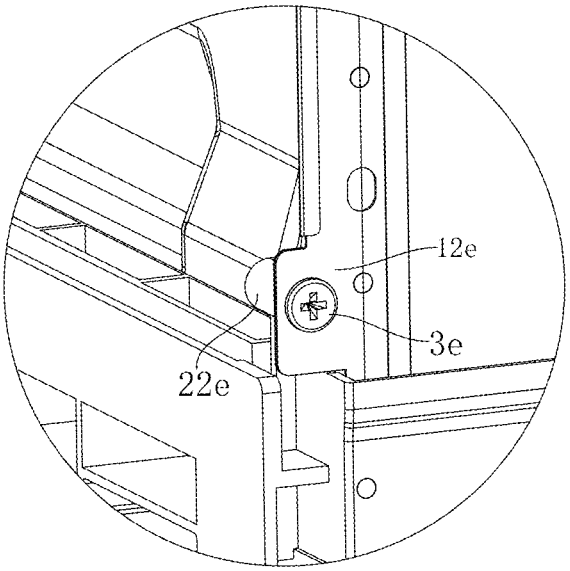
FIG. 87 is an enlarged schematic diagram of the partial structure at H in FIG. 85.
Figure 88:
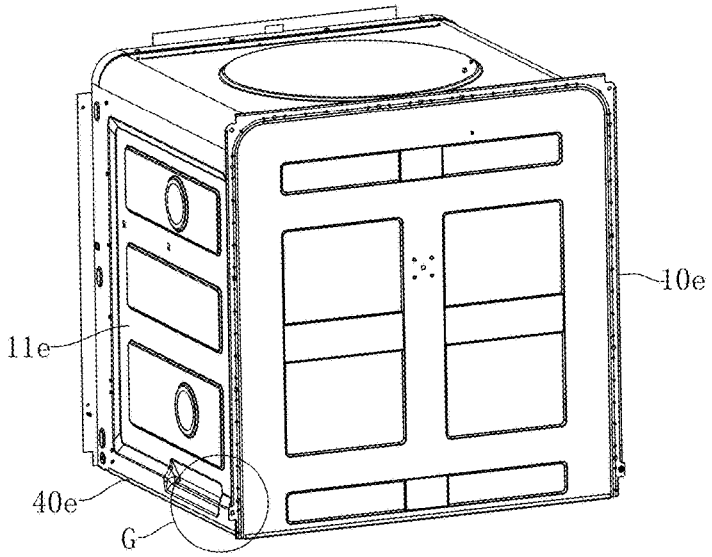
FIG. 88 is a structural schematic diagram of the inner liner of the dishwasher provided in embodiment 26 of the present application.
Figure 89:
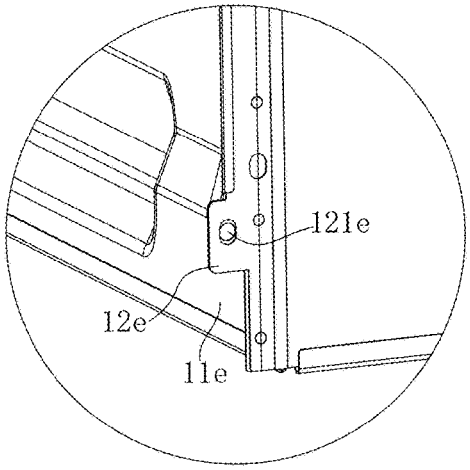
FIG. 89 is an enlarged schematic diagram of the partial structure at G in FIG. 88.

Referring to FIG. 87, the top of the base 1 near the rear end of the base 1 is convexly provided with an upwardly extending installation protrusion 22*e*, and the side plate 11*e* near the rear end of the side plate 11*e* is extended with a connection plate 12*e* corresponding to the position of the installation protrusion 22*e*. The installation protrusion 22*e* is provided with a base installation hole (not shown). The connection plate 12*e* is provided with a liner installation hole 121*e* corresponding to the position of the base installation hole, and the connection plate 12*e* passes through the liner installation holes 121*e* and the base installation holes through an axial screw 3 to fasten the installation protrusion 22*e*.

Referring to FIG. 85, the bottom of the side plate 11*e* is provided with an inserting mechanism 40*e* inserted into the base groove 21*e*.

Referring to FIGS. 9 and 17, the top of the base 1 is provided with a positioning protrusion 50*e* and a guide protrusion 60*e* with interval arrangement. A base groove 21*e* is formed between the positioning protrusion 50*e* and guide protrusion 60*e*. The base groove 21*e* includes a bottom mounting surface 23 formed on the top of base 1, the first side mounting surface 51 formed on the positioning protrusion 50*e*, and the second side mounting surface 61 formed on the guide protrusion 60*e*; the side plate 11*e* is in contact with the first side mounting surface 51, and each inserting mechanism 40*e* is in contact with the bottom mounting surface 23 and the second side mounting surface 61.

Figure 90:
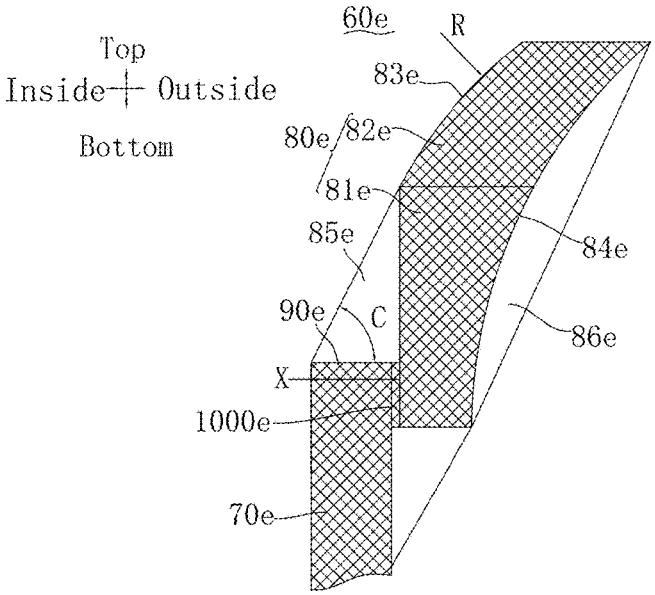
FIG. 90 is a structural cross-sectional diagram of a guide protrusion of a base of a dishwasher provided in embodiment 26 of the present application.

Referring to FIG. 90, the guide protrusion 60*e* includes a limiting plate 70*e* and a guide plate 80*e*. The top of the limiting plate 70*e* is connected to the top of the base 1 and is arranged in a vertical direction. The guide plate 80*e* includes a support portion 81*e* and a guide portion 82*e*. The support portion 81*e* is connected to the outside the limiting plate 70*e*. An anti-deformation step 90*e* is formed between the inner surface of the support portion 81*e* and the top surface of the limiting plate 70*e*. The guide portion 82*e* extends upward from the top surface of the support portion 81*e*, and a guide arc surface 83*e* is formed on the inner side surface of the guide portion 82*e* from the top end surface of the guide portion 82*e* to the bottom end surface of the guide portion 82*e*.

Further, the arc center of the guide arc surface 83*e* (that is, the circle center of the circle to which the guide arc surface 83*e* belongs) is located outside the limiting plate 70*e* and the guide plate 80*e*.

Further, referring to FIG. 90, the support portion 81*e* of the guide plate 80*e* in this embodiment is connected to the outside of the limiting plate 70*e*, that is, the support portion 81*e* of the guide plate 80*e* is not directly connected to the outside of the limiting plate 70*e*. There is a connection portion 1000*e* having a certain thickness between the inner surface of the support portion 81*e* of the guide plate 80*e* near the bottom end surface of the support portion 81*e* and the partial outer surface of the limiting plate 70*e* near the top surface of the limiting plate 70*e*. In which, in order to better display the connection portion 1000*e*, a dotted line marked in the vertical direction is a connection portion between the connection portion 1000*e* and the inner side surface of the supporting portion 81*e*.

In this embodiment, the guide protrusion 60*e* further includes a plurality of guide ribs 85*e*. Each guide rib 85*e* is arranged on the anti-deformation step 90*e* and is arranged at intervals along the longitudinal direction of the anti-deformation step 90*e*. The bottom end surface of each guide rib 85*e* is connected to the top surface of the limiting plate 70*e*, and the outer side surface of each guide rib 85*e* is connected to the inner side surface of the support portion 81*e*.

Referring to FIG. 90, an included angle C formed between an inner side surface of each guide rib 85*e* and a top surface of the limiting plate 70*e* is 60° ~80°. The inner side surface of each guide rib 85*e* is tangent to the guide arc surface 83*e*. The inner edge of the bottom end of the guide rib 85*e* flushes with the inner surface of the limiting plate 70*e*. The radius R of the arc surface of the guide arc surface 83*e* is 10 mm to 20 mm, the width of the anti-deformation step 90*e* is larger than the width of the limiting plate 70*e*, and the width X of the anti-deformation step 90*e* is 2 mm to 5 mm. The guide protrusion 60*e* further includes a plurality of support ribs 86*e*. Each of the support ribs 86*e* is arranged at intervals on the outer side surface of the guide plate 80*e* and is also arranged from the top surface of the guide portion 82*e* to the outer side surface of the limiting plate 70*e*.

The present disclosure further concerns the following embodiments:

1. A base component, wherein the base component comprises: a base and an overflow cover, the overflow cover includes an overflow cover body, the overflow cover body is provided with an overflow port and a mounting portion, and the overflow cover body has an overflow chamber, the base has an overflow hole and a connection portion engaged with the mounting portion for fixing, the overflow port and the overflow hole are both in communication with the overflow chamber to form an overflow channel between the overflow cover body and the base, one side of the overflow cover, adjacent to the upper surface of the base, is arranged with a water inlet plate communicating with the overflow port, and the water inlet plate is provided with a plurality of filter holes.

2. The base component according to technical solution 1, wherein the overflow cover comprises a cover plate, an extension wall connected to the cover plate, a mounting plate connected to the extension wall, and the water inlet plate; the water inlet plate, the extension wall, and the cover plate are collectively enclosed to form the overflow chamber, and the mounting plate is provided with the mounting portion.

3. The base component according to technical solution 1, wherein the mounting portion comprises a fastening block extended from the mounting plate, and the connecting portion includes a fastening groove fitted with the fastening block to dock with.

4. The base component according to technical solution 1, wherein a filter is installed at the water inlet plate, and the filter is detachably connected to the overflow cover.

5. The base component according to technical solution 1, wherein the base has a side plate, the side plate has a mounting surface perpendicular to the upper surface, and the overflow hole and the connection portion are both provided on the mounting surface, and the water inlet plate is arranged obliquely to the upper surface.

6. The base component according to technical solution 5, wherein a buffer boss is provided on the side plate and located at the overflow hole, and the buffer boss is convex toward one side away from the cover plate.

7. The base component according to any one of technical solutions 1 to 6, wherein the base component further comprises a water distribution component, and the water distribution component comprises a water distribution cover and a water distribution pipeline connected to the water distribution cover, the water distribution cover comprises a water distribution cover body, the water distribution cover body is provided with a water inlet and a water outlet, and the water distribution cover body has a water distribution chamber, both the water inlet and the water outlet communicate with the water distribution chamber to form a water flow channel in the water distribution cover body, and the water inlet and the water outlet are arranged on different sides of the water distribution cover body, and a first inclined surface is formed on an outer wall of the water distribution cover body and is inclined from one side of the water inlet to one side of the water outlet; a second inclined surface is formed on an inner wall of the water distribution chamber, and the second inclined surface corresponds to the first inclined surface, forming a water flow channel with variable cross section in the distribution cover body, and the water distribution pipeline penetrates the base; one end of the water distribution pipeline is connected to the water outlet, and the other end penetrates the base and is used to communicate with the spray arms at different locations.

8. The base component according to technical solution 7, wherein: a reinforcing rib is provided on the first inclined surface and extends from one side of the water inlet to one side of the water outlet; The upper end of the reinforcing rib is provided on the first inclined surface, and the lower end of the reinforcing rib is connected to the outer peripheral wall of the water distribution cover body.

9. The base component according to technical solution 8, wherein the water distribution cover is cylindrical, and the water inlet is formed at an outer peripheral wall of the water distribution cover body, and a first extension portion is provided at the water inlet and laterally extends on the outer peripheral wall of the water distribution cover body, and the water outlet is formed at the bottom of the water distribution cover body, a second extension portion is provide at the water outlet and longitudinally extends outward from the bottom of the water distribution cover body; the inclined surface is inclined from the first extension portion toward one side of the second extension portion.

10. The base component according to technical solution 9, wherein a connection ear is provided at a connection between the reinforcing rib and the water distribution cover body and extends along an outer periphery of the water distribution cover body, and a connection hole is provided on the connection ear.

11. The base component according to technical solution 7, wherein the water distribution pipeline is arranged to be at least two pipelines, and the water distribution pipeline comprises a first water distribution pipeline and a second water distribution pipeline arranged in parallel, and a connection housing is provided outside the first water distribution pipeline and the second water distribution pipeline and is located on the base; the connection housing is docked with the water outlet to form a sealed chamber; a sealing ring is arranged at the connection of the water distribution cover body and the connection housing.

12. The base component according to technical solution 11, wherein the base is provided with a first perforation and a second perforation penetrating through the base; the first water distribution pipeline extends to above and below the base, respectively, along longitudinal direction of the base from the first perforation; the second water distribution pipeline extends to above and below the base, respectively, along the longitudinal direction of the base from the second perforation; the connection housing abuts on the lower surface of the base.

13. The base component according to any one of technical solutions 1-6, wherein the base component further comprises a water distribution component, and the water distribution component comprises a connection housing connected to the base and a water distribution cover connected to the connection housing, a water distribution chamber is formed between the water distribution cover and the connection housing, and at least two water distribution pipelines are connected in the water distribution chamber; one end of each water distribution pipeline is arranged in the water distribution chamber, the other end of each water distribution pipeline penetrates the base and communicates with spray arms at different positions, respectively, and the water distribution cover is connected to the connection housing hermetically.

14. The base component according to technical solution 13, wherein the water distribution pipeline comprises a first water distribution pipeline, a second water distribution pipeline, and a third water distribution pipeline, which are arranged in parallel, and the first water distribution pipeline communicates with the lower spray arms, the second water distribution pipeline communicates with the middle spray arms, and the third water distribution pipeline communicates with the upper spray arms; the ratio of cross-section area of the first water distribution pipeline, the second water distribution pipeline, and the third water distribution pipeline is 1:3:4.

15. The base component according to technical solution 13, wherein the water distribution pipeline comprises a first water distribution pipeline and a second water distribution pipeline which are arranged in parallel, and the first water distribution pipeline communicates with the lower spray arms, the second water distribution pipeline communicates with the middle spray arms; or the second water distribution pipeline communicates with the upper spray arms; or the second water distribution pipeline communicates with the middle spray arms and the upper spray arms at the same time; the ratio of cross section area of the first water distribution pipeline and the second water distribution pipeline is arranged to be 1:5~2:7.

16. The base component according to any one of technical solutions 1-6, wherein the base component further comprises a water distribution component, and the water distribution component comprises a water distribution cover and a water distribution pipeline connected to the water distribution cover; the water distribution cover comprises a water distribution cover body, the water distribution cover body has a water distribution chamber, and the water distribution cover body is provided with at least two water distribution ports, each of water distribution port communicates with the water distribution chamber; the water distribution pipeline penetrates the base and is arranged to at least two pipelines, and one end of each water distribution pipeline is connected to each of the water outlets hermetically, and the other end of each water distribution pipeline penetrates the base and communicates with spray arms at different locations.

17. The base component according to technical solution 16, wherein the water distribution port comprises a first water distribution port and a second water distribution port, and both the first water distribution port and the second water distribution port communicate with the water distribution chamber; the water distribution pipeline comprises a first water distribution pipeline and a second water distribution pipeline which are arranged in parallel, the first water distribution pipeline is connected to the first water distribution port hermetically, and the second water distribution pipeline is connected to the second water distribution port hermetically; the ratio of cross section area of the first water distribution pipeline and the second water distribution pipeline is arranged to be 1:5~2:7.

18. The base component according to technical solution 17, wherein the base is provided with a first perforation and a second perforation penetrating through the base; the first water distribution pipeline extends to above and below the base, respectively, along longitudinal direction of the base from the first perforation; the second water distribution pipeline extends to above and below the base respectively along the longitudinal direction of the base from the second perforation; a first sealing shell is provided outside the first water distribution pipeline and located below the base, and a second sealing shell is provided outside the second water distribution pipeline and located below the base; the first sealing shell is connected to the first sealing tube hermetically; the second sealing shell is connected to the second sealing tube hermetically.

19. The base component according to technical solution 18, wherein a first sealing chamber is formed between the first sealing shell and the first water distribution pipeline, and a second sealing chamber is formed between the second sealing shell and the second water distribution pipeline, one end of the first water distribution pipeline is arranged in the first sealing chamber, and the other end of the first water distribution pipeline penetrates the base and communicates with the lower spray arms; one end of the second water distribution pipeline is arranged in the second sealing chamber, the other end of the second water distribution pipeline penetrates through the base and communicates with the middle spray arms; or, the other end of the second water distribution pipeline communicates with the upper spray arms; or the other end of the second water distribution pipeline communicates with both the middle spray arms and the upper spray arms.

20. The base component according to technical solution 19, wherein a first connection pipe is connected to the first water distribution port, a second connection pipe is connected to the second water distribution port, and a first connection plate extends on the outer periphery of the first connection pipe, and a second connection plate extends on the outer periphery of the second connection pipe; the first connection plate is provided with a first connection hole; the second connection plate is provided with a second connection hole; a positioning column is arranged on the base, the positioning column is fitted with the first connection hole and the second connection hole, the first connection plate abuts with the first sealing shell, and the second connection plate abuts the second sealing shell.

21. The base component according to technical solution 16, wherein the water distribution port comprises a first water distribution port, a second water distribution port, and a third water distribution port, the first water distribution port, the second water distribution port, and the third water distribution port are all communicate with the water distribution chamber; the water distribution pipeline comprises a first water distribution pipeline, a second water distribution pipeline, and a third water distribution pipeline; one end of the first water distribution pipeline is connected to the first water distribution port hermetically, and the other end of the first water distribution pipeline is connected to the spray arms; one end of the second water distribution pipeline is connected to the second water distribution port hermetically, and the other end of the second water distribution pipeline is connected to the spray arms, and one end of the third water distribution pipeline is connected to the third water distribution port hermetically, and the other end of the third water distribution pipeline is connected to the spray arms; the ratio of the cross section area of the first water distribution pipeline, the second water distribution pipeline, and the third water distribution pipeline is arranged to be 1:3:4.

22. The base component according to technical solution 7, wherein the base component further comprises a spray arm, a flow guidance channel is provided on the base, and one end of the flow guidance channel communicates with the water distribution chamber, the other end of the flow guidance channel communicates with the spray arm; the flow guidance channel of the water distribution chamber extends from the outer wall of the water distribution chamber toward the rear end of the base and communicates with the spray arm at the rear end of the base; a spray arm seat is provided between the spray arm and the flow guidance channel; the spray arm seat penetrates through the base, and the spray arm is connected to the top of the spray arm seat and is located above the base to spray water out of spray arm seat, and the flow guidance channel is connected to the bottom of the spray arm and located below the base for introducing water from the water distribution chamber into the spray arm seat.

23. The base component according to technical solution 22, wherein the flow guidance channel comprises a lower channel plate and an upper channel plate connected to the lower channel plate; the lower channel plate and the upper channel plate are enclosed to form an inner chamber.

24. The base component according to technical solution 23, wherein the lower channel plate comprises an annular wall formed by longitudinal extension of the lower surface of the base, and the annular wall is integrally formed with the base.

25. The base component according to technical solution 23, wherein the upper channel plate has an arch shape, and the upper channel plate is welded to the lower channel plate.

26. The base component according to any one of technical solutions 22-25, wherein the flow guidance channel is one of two flow guidance channels; and the two flow guidance channels each have one end communicating with the water distribution chamber and the other end connected to the spray arms respectively, and the spray arm seats are connected to two spray arms respectively; and the two spray arms are arranged on both sides of the base respectively.

27. The base component according to technical solution 26, wherein the two flow guidance channels are distributed on the base in a V-shape.

28. The base component according to technical solution 7, wherein the water distribution component comprises a water distribution cover, a water distribution pipeline connected to the water distribution cover, and a water distribution mechanism arranged in the water distribution cover and a sealing cover connected to the water distribution cover and used to seal the water distribution mechanism; the water distribution cover has a water distribution chamber, the water distribution mechanism is arranged in the water distribution chamber, and the water distribution cover body is provided with at least two water distribution port, each of water distribution port communicates with the water distribution chamber respectively; the water distribution pipeline penetrates the base and is arranged to be at least two pipelines, and one end of each water distribution pipeline communicates with each of the water distribution ports respectively; the water distribution mechanism includes a wheel supportive mechanism installed in the water distribution chamber, a rotating shaft connected to the wheel supportive mechanism, and an impeller fitted on the rotating shaft and rotating around the rotating shaft and a water distribution plate connected to the impeller; the water distribution plate is driven by the impeller to rotate to open or close water distribution port.

29. The base component according to technical solution 28, wherein the wheel supportive mechanism comprises a first support portion connected to one end of the rotating shaft and located at the sealing cover, and a second support portion connected to the other end of rotating shaft; the impeller is fitted on the rotating shaft and is located between the first support portion and the second support portion, and the water distribution plate is connected to the first support part and located outside the impeller, the water distribution plate is arranged along the axial direction of the impeller and is extended to one side of the second support portion.

30. The base component according to technical solution 29, wherein the water distribution port comprises a first water distribution port and a second water distribution port, and both the first water distribution port and the second water distribution port communicates with the water distribution chamber; the water distribution pipeline comprises a first water distribution pipeline and a second water distribution pipeline which are arranged in parallel, the first water distribution pipeline is connected to the first water distribution port hermetically, and the second water distribution pipeline is connected to the second water distribution port hermetically; the water distribution plate comprises a first water distribution plate for blocking the first water distribution pipeline and a second water distribution plate for blocking the second water distribution pipeline; the first water distribution plate is spaced from the second water distribution plate at intervals.

31. The base component according to technical solution 30, wherein a connector is provided on the first water distribution plate and/or the second water distribution plate, and a connection port is provided on the connector, and a connection block is provided on the first support portion and is inserted into the connection port; a connection rib is formed at the connection port, and the connection block is provided with a gap fitting with the connection rib.

32. The base component according to technical solution 1, wherein the base component further comprises an electric control box, and an installation structure for installing the electric control box is installed on the base, and the installation structure comprises a bottom plate, a side plate arranged on the bottom plate and a mounting plate connecting the bottom plate and the side plate; the bottom plate, the side plate, and the mounting plate are jointly enclosed to form an installation space, and the electric control box is installed in the installation space; the bottom plate has a support surface, the side plate has a first positioning surface, the mounting plate has a second positioning surface; the support surface, the first positioning surface, and the second positioning surfaces are connected to each other; a inserting portion is provided on the first positioning surface for inserting the electric control box along the longitudinal direction of the side plate to position the first side plate of the electric control box; a latching portion is provided on the second positioning surface for latching the electric control box to the mounting plate along the lateral direction of the side plate to position the second side plate of the electric control box; both inserting portion and latching portion are fitted with the electric control box to install the electric control box in the installation space.

33. The base component according to technical solution 32, wherein the inserting portion is arranged adjacent to a connection between the first positioning surface and the support surface; and the latching portion is arranged away from the connection between the second positioning surface and the support surface.

34. The base component according to technical solution 32, wherein the inserting portion comprises a first positioning protrusion and a second positioning protrusion opposite to the first positioning protrusion; an insertion groove is formed between the first positioning protrusion and the second positioning protrusion for inserting the electric control box.

35. The base component according to technical solution 34, wherein a connection platform is further provided on the support surface and located at a connection between the support surface and the first positioning surface; both the first positioning protrusion and the second positioning protrusion extend along the longitudinal direction of the side plate; the lower end of the first positioning protrusion abuts with the lower end of the second positioning protrusion at the connection platform.

36. The base component according to technical solution 34, wherein the first positioning protrusion includes a first vertical plate connected to the first positioning surface perpendicularly and a first extension plate connected to the first vertical plate perpendicularly; the second positioning protrusion comprises a second vertical plate connected to the first positioning surface perpendicularly and a second extension plate connected to the second vertical plate perpendicularly; the insertion groove is formed among the first vertical plate, the first extension plate, the second extension plate, and the second vertical plate.

37. The base component according to technical solution 36, a chamfered portion is provided on the first extension plate and/or the second extension plate and is away from the connection between the first positioning surface and the support surface.

38. The base component according to any one of technical solutions 32-37, wherein the latching portion is arranged as a latching hole penetrating through the second positioning surface to latch the electric control box.

39. The base component according to any one of technical solutions 32-37, wherein the mounting plate comprises a first mounting plate and a second mounting plate which are oppositely arranged; the first mounting plate and the second mounting plate, the bottom plate, and the side plate collectively define the installation space, and the first mounting plate and the second mounting plate each has the second positioning surface; all the second positioning surfaces are provided with a latching portion.

40. The base component according to technical solution 39, wherein a bent portion is arranged on the first mounting plate and/or the second mounting plate and in which an end portion away from the side plate is bent toward one side away from the inserting portion.

41. The base component according to technical solution 32, wherein the first side surface of the electric control box is provided with a guide block which fits with the inserting portion for positioning; the second side surface of the electric control box is provided with a buckle which fits with the latching portion to position; the support ribs are also provided on the first side surface of the electric control box and located on both sides of the guide block to fit with the first positioning surface for positioning.

42. The base component according to technical solution 41, wherein the support rib extends along the longitudinal direction of the first side surface, and one end of the support rib is connected to a support post.

43. The base component according to technical solution 42, wherein the guide block comprises a guide rib extending along a longitudinal direction of the first side surface and used for inserting into the inserting portion, and the chamfer is provided on the guide rib.

44. The base component according to technical solution 1, wherein the base component further comprises an electric control box, and an installation structure for installing the electric control box is provided on the base, and the installation structure comprises a bottom plate, a side plate provided on the bottom plate and a mounting plate connecting the bottom plate and the side plate; the bottom plate, the side plate, and the mounting plate are collectively enclosed to form an installation space, and the electric control box is installed in the installation space; the bottom plate has a support surface, the side plate has a first positioning surface, the mounting plate has a second positioning surface; the support surface, the first positioning surface, and the second positioning surfaces are connected to each other; the first positioning surface is provided with a latching portion for engaging with the electric control box and a first groove body extending longitudinally along the side plate and configured to support the first side surface of the electric control box, the second positioning surface is provided with a second groove body for receiving the second side surface of the electric control box; the first groove body and the second groove body fit with the electric control box so that the electric control box slides into the installation space along the longitudinal direction of the side plate and is engaged with the latching portion.

45. The base component according to technical solution 1, wherein the base component further comprises an electric control box, and an installation structure for installing the electric control box is installed on the base, and the installation structure includes a bottom plate, a side plate provided on the bottom plate and a mounting plate connecting the bottom plate and the side plate; the mounting plate comprises a first mounting plate and a second mounting plate opposite to each other; the side plate, the first mounting plate, and the second mounting plate are collectively enclosed to form an installation space, and the electric control box is installed in the installation space; the bottom plate has a first support surface, and the side plate has the second support surface, the first mounting plate has a first positioning surface, and the second mounting plate has a second positioning surface; the first positioning surface, the first support surface and the second support surface is connected to each other, the second positioning surface, the first support surface, and the second support surface are connected to each other, and the first positioning surface and the second positioning surface are in parallel; a first slide groove is provided on the positioning surface and extends along the longitudinal direction of the first mounting plate, a first latching portion is provided in the first slide groove, and the second slide groove is provided on the second positioning surface and extends along longitudinal direction of the second mounting plate, and a second latching portion is provided in the second side groove; both the first slide groove and the second slide groove match with the electric control box so that the electric control box slides into the installation space along the first slide groove and the second slide groove, and the two sides of the electric control box are latched to the first latching portion and the second latching portion respectively.

46. The base component according to technical solution 45, the first latching portion is arranged as a first latching hole penetrating the first sliding groove, and the second latching portion is arranged as a second latching hole penetrating the second slide groove; the first latching hole and the second latching hole are arranged opposite to each other; the upper end of the first slide groove penetrates the top surface of the first mounting plate, and the upper end of the second slide groove penetrates the top surface of the second mounting plate; The first slide groove and the second slide groove are oppositely arranged 47. The base component according to technical solution 45, wherein the first latching hole is provided at a lower end of the first slide groove, and the second latching hole is provided at a lower end of the second slide groove; the first slide groove and the second slide groove are arranged on one side close to the side plate.

48. The base component according to technical solution 45, wherein the first side surface of the electric control box is provided with a first guide rib which fits with the first slide groove and a first positioning protrusion connected to one end of the first guide rib and latched with the first latching portion; the second side surface of the electric control box is provided with a second guide rib which fits with the second slide groove and a second positioning protrusion connected to the second guide rib and latched with the second latching portion.

49. The base component according to technical solution 1, wherein the base component further comprises an electric control box, and the base is provided with an installation structure for installing the electric control box; the installation structure comprises a bottom plate, a side plate provided on the bottom plate and a mounting plate connecting the bottom plate and the side plate; the bottom plate, the side plate, and the mounting plate are collectively enclosed to form an installation space, and the electric control box is installed in the installation space; the bottom plate has a first support surface, the side plate has a second support surface, the mounting plate has a positioning surface; the first support surface, the second support surface, and the positioning surface are connected to each other; the first positioning surface is provided with an fastening portion for fastening the electric control box 8 to position the bottom surface of the electric control box, the slide groove is provided on the positioning surface and extends along the longitudinal direction of mounting plate for accommodating the side surface of the electric control box, the slide groove matches with electric control box to make the electric control box slide into the installation space along the slide groove.

50. The base component according to technical solution 49, wherein the fastening portion is arranged to a lock groove penetrating through the first support surface to fasten the bottom surface of the electric control box.

51. The base component according to technical solution 49, wherein the fastening portion is configured as a hook connected to the first support surface and used to fasten the electric control box, and the hook comprises a vertical rod connected to the first support surface perpendicularly and a guide protrusion connected to the other end of the vertical rod and used to fasten the electric control box, and the guide protrusion is inclinedly arranged toward one side of the vertical rod.

52. The base component according to technical solution 50, wherein the lock groove is provided at the connection between the bottom plate and the side plate; the lock groove comprises a groove wall connected to the second support surface, the groove wall is a slope-shaped structure inclined from the second support surface toward one side of the lock groove.

53. The base component according to technical solution 1, wherein the base component also comprises a counterweight, and a rear end of base is provided with an installation groove which matches with the shape of the counterweight; the installation groove comprises a bottom wall, a top wall, a groove inner wall and two groove side walls; two sides of base are provided with screw installation holes which penetrate the two groove side walls, respectively and communicate with the installation groove; the counterweight is provided with counterweight screws hole at both ends in the length direction; the counterweight are arranged in the installation groove, the counterweight and the surfaces of the counterweight corresponding to the groove bottom wall, the groove top wall, the groove inner wall and the groove side wall abut with the groove bottom wall, the groove top wall, the groove inner wall and the groove side wall respectively, the counterweight screws hole corresponds to the position of the screw installation hole and the locking screw is connected to the counterweight screws hole through the screw installation hole.

54. The base component according to technical solution 1, wherein the base component further comprises a counterweight, and a rear end of the base is provided with an installation groove which matches the shape of the counterweight, and the installation groove comprises a groove bottom wall, a groove top wall, a groove inner wall, and two groove side walls; the counterweight is accommodated in the installation groove and the counterweight and the surfaces of the counterweight corresponding to the groove bottom wall, the groove top wall, the groove inner wall and the groove side wall abut with the groove bottom wall, the groove top wall, the groove inner wall and the groove side wall respectively; the base component also include a strip stopper, the opposite ends of the strip stopper are installed on the base and prevents the counterweight from coming out of the installation groove.

55. The base component according to technical solution 54, wherein the rear end of base located on both sides in the longitudinal direction of the installation groove is provided with a stopper installation hole, and the strip stopper is provided with stopper positioning hole 224 near the two ends in the longitudinal direction, the strip stopper is arranged outside the opening of the installation groove and spans to both sides of the installation groove in longitudinal direction along the longitudinal direction of the installation groove, the two stopper positioning holes correspond to the two stopper installation holes, the stopper positioning holes and the stopper installation holes are connected by the locking screw passing through the stopper positioning hole and the stopper installation hole.

56. The base component according to technical solution 1, wherein the base component further comprises a counterweight, and a rear end of base is provided with an installation groove matched with the shape of the counterweight, and the counterweight is arranged within the installation groove; the base component also comprises a first block and a second block, the first block comprises a first fixed end and a first free end, the second block comprises a second fixed end and a second free end; the first fixed end and the second fixed end are fixed to the rear end of base, and the first free end and the second free end both extend toward the opening of the installation groove and are oppositely arranged to collectively restrict the counterweight from coming out of the installation groove.

57. The base component according to technical solution 56, wherein one side of the rear end of base is provided with at least one left lock groove, and the first fixed end of the first block is provided with a left buckle corresponding to the position of each left lock groove; each left buckle is engaged to each left lock groove correspondingly; the right side of the rear end of base is provided with at least one right lock groove, and the second fixed end of the second block is provided with each right buckle corresponding to the positions of the right lock groove, and each right buckle is engaged to each right lock groove correspondingly.

58. The base component according to technical solution 56, wherein the installation groove comprises a groove bottom wall, a groove top wall, a groove inner wall, and two groove side walls; the counterweight and the surfaces of the counterweight corresponding to the groove bottom wall, the groove top wall, the groove inner wall and the groove side wall abut with the groove bottom wall, the groove top wall, the groove inner wall and the groove side wall, respectively.

59. The base component according to technical solution 1, wherein the base component further comprises a counterweight, and a rear end of base is provided with an installation groove matched with the shape of the counterweight and a rocking cover located at one side of the installation groove and flexibly connected to base for use in covering the opening of installation groove; the installation groove comprises a groove bottom wall, a groove top wall, a groove inner wall, and two groove side walls; the counterweight is accommodated in the installation groove; the counterweight and the surfaces of counterweight corresponding to the positions of groove bottom wall, the groove top wall, the groove inner wall, and the groove side wall abut with the groove bottom wall, the groove top wall, the groove inner wall, and the groove side wall, respectively; the rocking cover covers the opening of the installation groove and is connected to the base fixedly.

60. The base component according to technical solution 59, wherein the rear end of base located on both sides of the installation groove in the longitudinal direction are provided with rocking cover installation holes; the rocking cover is provided with rocking cover positioning holes near the two ends in the longitudinal direction, two rocking cover positioning holes correspond to the positions of the two rocking cover installation holes and are connected to the rocking cover installation holes by the locking screws passing through the rocking cover positioning hole and the rocking cover installation holes.

61. The base component according to technical solution 59, wherein the rocking cover can be connected to the side edge near the groove bottom wall of the base rotatably.

62. The base component according to technical solution 59, wherein the rocking cover is formed with base integrally, and a bending groove is provided at the connection between the rocking cover and base to facilitate rotation of the rocking cover relative to the base.

63. The base component according to technical solution 1, wherein the base component also comprises a counterweight, and on the one side between the front end and the rear end of the base, the installation groove is provided near the rear end of the base with a side opening; the shape of counterweight matches with that of the installation groove, the installation groove includes groove bottom wall, groove top wall, groove inner wall, groove outer wall, and groove side wall; the counterweight extends into the installation groove from the side opening, and the side ends of the counterweight opposite to the side opening abut with the groove side wall; the base component also comprises locking screws, the side ends of the counterweight opposite to the side opening are provided with counterweight screw holes, and the groove side wall is provided with a base positioning hole; the locking screw passes through the base positioning hole and are tightly connected with the counterweight screw hole to restrict the counterweight from coming out of the installation groove.

64. The base component according to technical solution 1, wherein the base component also comprises a counterweight, and on the one side between the front end and the rear end of the base, the installation groove is provided near the rear end of the base with a side opening; the shape of counterweight matches with that of the installation groove, the counterweight is accommodated and restricted in the installation groove; the base component also comprises a sealing cover, the shape of sealing cover matches the shape of the side opening, and the sealing cover seals the side opening and connects with base fixedly to restrict the counterweight from coming out of the installation groove.

65. The base component according to technical solution 64, wherein the opposite sides of the installation groove close to the side opening are respectively provided with a first lock groove and a second lock groove, and the opposite sides of the sealing cover are provided with a first buckle and a second buckle, respectively; the first buckles engaged with the first lock groove, and the second buckle is engaged with the second lock groove.

66. The base component according to technical solution 1, wherein base component also comprises a counterweight, base is injection molded by molten plastic placed in a mold, and the counterweight is provided in the mold and integrated with base by injection molding; an installation chamber for accommodating the counterweight is formed inside the base near its rear end.

67. The base component according to technical solution 1, wherein the base component also comprises a counterweight, base is provided with an installation groove near the rear end of base and extending from the top of base toward the bottom of base; the shape of the installation groove fits with that of the counterweight, and the counterweight is accommodated within the installation groove; the base component also comprises a sealing ring and a cover plate; the cover plate seals the opening of the installation groove and is fixedly connected to the base to restrict the counterweight from coming out of installation groove, and the seal ring is clamped between the cover plate and the counterweight.

68. The base component according to technical solution 67, wherein a plate buckle is provided on a peripheral side of the cover plate, and a plate groove fastened to the plate buckle is provided at a position of the groove wall of the installation groove corresponding to the plate buckle.

69. The base component according to technical solution 1, wherein the base component further comprises a counterweight body, a counterweight chamber is formed inside the base near the rear end thereof, and an injection port communicating with the counterweight chamber is provided on the base, the counterweight body is injected into the counterweight chamber through the injection port; the base component also comprises a sealing fixed cover, which seals the injection port and is fixedly connected to base to restrict the discharge of the counterweight body from the injection port to outside of the counterweight chamber.

70. The base component according to technical solution 69, wherein a plurality of fixing lock grooves is provided on the periphery of the injection port on the base; a fixing buckle engaged with fixing lock groove is provided on the positions of the sealing fixed cover corresponding to the fixing lock groove.

71. The base component according to technical solution 69, wherein the base is provided with a plurality of fastening holes on the periphery of the injection port, and the sealing and fixing cover corresponds to each of the fastening holes. A positioning hole is provided on the sealing fixed cover at the position corresponding to the fastening holes, the sealing fixed cover is tightly connected to the fastening hole by a fixing mechanism passing through the positioning hole.

72. The base component according to technical solution 69, wherein the injection port is located at a rear end of the base.

73. The base component according to technical solution 1, wherein the base component further comprises a counterweight, and the rear end of base is provided with an installation groove matched with the shape of the counterweight; the installation groove comprises a groove bottom wall; at least one groove bottom slideway extending from the outer end of the groove bottom wall toward the inner end of the groove bottom wall is provided on the groove bottom wall; the end of the groove bottom slideway is provided with an installation groove; an installation hook corresponding to the position of the groove bottom slideway is provided on bottom of the counterweight; the installation hook slides along the groove bottom slideway to accommodate and restrict the counterweight within the installation groove, and the installation hook and the installation groove are engaged to restrict the counterweight from coming out of the installation groove.

74. The base component according to technical solution 73, wherein each installation hook comprises a vertical post and a horizontal slide, the vertical post is located at the bottom of the counterweight and is vertically connected to the counterweight, the horizontal slide is vertically connected to the bottom end of the vertical post, the horizontal slide extends toward the outer end of the counterweight.

75. The base component according to technical solution 53 or 54 or 58 or 59 or 63, wherein the groove top wall is provided with a plurality of abutting ribs protruding toward the groove bottom wall, each of the abutting ribs is arranged at intervals along the longitudinal direction of the groove top wall, and each of the abutting ribs abuts on the top of the counterweight.

76. The base component according to technical solution 75, wherein an arc-shaped chamfer is provided at the front end of each abutting rib.

77. The base component according to technical solution 53 or 54 or 58 or 59 or 63 or 67 or 73, wherein the groove bottom wall is provided with a plurality of buffer ribs facing the groove top wall, each buffer rib is arranged at intervals along the longitudinal direction of the groove bottom wall, and each of the buffer ribs abut with the bottom of the counterweight.

78. The base component according to technical solution 77, wherein each of the buffer rib is arranged at equal interval along the longitudinal direction of the groove bottom wall.

79. The base component according to technical solution 77, wherein the buffer rib comprises an upper bottom edge, a lower bottom edge, and a waist edge connected between the upper bottom edge and the lower bottom edge, the width L of the upper bottom edge is 0.4 mm to 0.9 mm, the distance H between the upper bottom edge and the lower bottom edge is 2 mm to 5 mm, and the included angle Z between the waist edge and the lower bottom edge is 75°~85°.

80. The base component according to technical solution 77, wherein the buffer rib comprises a lower buffer rib portion and an upper buffer rib portion, and the upper buffer rib portion extends obliquely upward from the top of the lower buffer rib portion 214, the included angle Y between the upper buffer rib portion and the lower buffer rib portion 214 is 35°~70°.

81. The base component according to technical solution 80, wherein the upper buffer rib portion comprises a top surface, and the lower buffer rib portion comprises a bottom surface, the distance h between the top surface and the bottom surface is 3 mm~7 mm, and the distance 1 from the end of the upper buffer rib portion to the side end of the lower buffer rib portion opposite to extending direction of the upper buffer rib portion is 4 mm~10 mm.

82. The base component according to technical solution 53 or 54 or 58 or 59 or 63 or 67, wherein the surface of the counterweight is provided with a buffer cushion.

83. The base component according to technical solution 1, wherein the base component further comprises an outer plate located outside the base at intervals, and a top support mechanism connected to the outside of the base and used to support the outer plate; among them, the top support mechanism comprises a first top support plate and a second top support plate, which are connected end to end and extend from base to the outer plate with elastic recovery; at least one first top support plate and one second top support plate are provided, in which any two adjacent first support plates and second support plates are arranged at an angle and form a V-shaped spacing groove, and the opening directions of the spacing grooves are parallel to the outer plate.

84. The base component according to technical solution 83, wherein at least one pair of adjacent first and second top support plates, in which both the first and second top support plates are staggered with the outer plate;

alternatively, at least one pair of adjacent first and second top support plates, in which the first and second top support plates are arranged symmetrically to the plane, parallel to outer plate and passing through the intersection of the first and second top support plates.

85. The base component according to technical solution 83, wherein the top support mechanism comprises at least one first connection plate, and any two adjacent first and second top support plates pass through the first connection plate and the first connection plate is perpendicular to the outer plate.

86. The base component according to technical solution 1, wherein the base component further comprises an outer plate located outside the base at intervals, and a top support mechanism connected to the outside of base and used to support the outer plate; the top support mechanism comprises at least one top support tube, the at least one top support tube is sequentially stacked in the direction from the base to the outer plate; each the top support tube comprises a first top support plate, a second top support plate, a third top support plate, and a fourth top support plate with elastic recovery; the first support plate and the second support plate are arranged at an angle, and form a first V-shaped spacing groove, and the third support plate and the fourth support plate are arranged at an angle and form a second V-shaped spacing groove, the opening directions of the first spacing groove and the second spacing groove are opposite to each other, and are parallel to the outer plate, plate edges of the first top support plate and the fourth top support plate facing the base together forms a first side edge, and plate edges of the third top support plate and the second top support plate facing the outer plate together form a second side edge; in any two adjacent top support tubes, the second side edge of a top support tube adjacent to the base is connected to the first side plate of a top support plate adjacent to the outer plate.

87. The base component according to technical solution 86, wherein the top support tube comprises a fifth overlap plate connecting the second top support plate and the third top support plate, and the fifth overlap plate is arranged in parallel with the outer plate; the first top support plate and the fourth top support plate are arranged at interval, the first top support plate and the fourth top support plate are connected through base, the first top support plate and the fourth top support plate is arranged symmetrically to the reference plane, which passes through the midpoint of the fifth overlap plate and are perpendicular to the fifth overlap plate; the second top support plate and the third top support plate is arranged symmetrically to the reference plane, which passes through the midpoint of the fifth overlap plate and are perpendicular to the fifth overlap plate.

88. The base component according to technical solution 1, wherein the base component also comprises a guide rail structure for use with a bowl basket, the bowl basket comprise a bowl frame for carrying a bowl and a roller connected to the bowl frame, the direction of the scroll axis of the roller is from left to right; the guide rail structure comprises a guide rail base, the guide rail base has a guide rail surface located on the upper side thereof and arranged linearly in the front-rear direction; the guide rail surface is arranged parallel to the horizontal plane; the guide rail base is provided with a plurality of side water guide groove; One notch of the side water guide groove is arranged on the guide rail surface and the other one is arranged on the left or right side of the guide rail base; each side water guide groove is arranged at interval along the extending direction of the guide rail surface; the ratio of the groove width of the side water guide groove to the wheel diameter of the roller is less than ½, and the ratio of the groove depth of the side water guide groove in the guide surface to the width of the guide rail surface is less than 1.

89. The base component according to technical solution 88, wherein the ratio of the groove depth of any side water guide groove in the guide rail surface to the width of the guide rail surface is less than ½.

90. The base component according to technical solution 88, wherein the guide rail structure comprises a pair of limiting stopper connected to the guide rail base and located on the guide rail surface; the extension direction of the two limiting stoppers is parallel to the extension direction of the guide rail surface; the spacing between the two limiting stoppers is slightly greater than or equal to the wheel width of the roller.

91. The base component according to technical solution 90, wherein the two limiting stoppers are cut off when passing through the side water guide groove.

92. The base component according to any one of technical solutions 88-91, wherein the side water guide groove is collectively formed by a groove bottom wall surface in a flat shape and a pair of groove side wall surfaces which are oppositely arranged in a flat shape, both the groove side wall surfaces are perpendicular to the groove bottom wall surface.

93. The base component according to technical solution 1, wherein the base component also comprises an installation base for installing a motor and a hanging structure for hanging the motor on the installation base, wherein the motor comprises a main body and two sets of hanging post groups that are connected to the outside of the main body and arranged at interval; the two sets of hanging post groups each comprises a pair of first hanging post and a second hanging post which are connected to the outside of the main body and extend in a horizontal direction in opposite directions; the two first hanging posts are arranged in parallel, the hanging structure comprises a hanging chassis connected to the installation base and a hanging body connected to the hanging chassis and used for hanging the motor and made of flexible soft rubber material; the hanging body is located on the lower side of the hanging chassis; each of the hanging body comprises a connection arm connected to the chassis and a hanging arm connected to the connection arm and hanging with one hanging post group, the hanging arms are provided with a hanging hole for use of latching the first hanging post and the second hanging post, and the width of the hanging holes in the direction parallel to the horizontal plane is smaller than the spacing distance between the two free ends of the first hanging post and the second hanging post, the width of the hanging hole in the direction perpendicular to the horizontal plane is larger than the diameter of either the first hanging post or the second hanging post.

94. The base component according to technical solution 93, wherein the width of the hanging hole in a direction parallel to a horizontal plane is equal to or slightly smaller than the spacing distance between the first hanging post and the second hanging post.

95. The base component according to technical solution 93, wherein the hook chassis comprises a disk body connected to the installation base and a pair of base disk hooks connected to the disk body and arranged at an interval; each of two hook connection arms is provided with hook hole matching with base disk hook.

96. The base component according to technical solution 95, wherein each base disk hook comprises a hook connection portion connected to the disk body and extending downward, and a hook support portion connected to the free end of the hook connection portion and extending to one side; the two hook support portions extend in the opposite direction, two hook support portions pass through a hook hole, respectively.

97. The base component according to technical solution 96, each base disk hook comprises a hook portion formed by connecting to the free end of the hook support portion and extending upward.

98. The base component according to technical solution 96, wherein each of the hook support portions is arranged in a flat plate shape, parallel to the horizontal plane; the plate width of the hook support portion in the direction perpendicular to the opening direction of the hook hole is slightly larger than or equal to the width of the hook hole parallel to the hook support portions; the width of the hook hole in the direction perpendicular to the plate surface of the hook support portion is greater than the plate thickness of the hook support portion.

99. The base component according to technical solution 98, wherein the connection arm is provided with a via hole which is arranged in parallel with the hook hole and is located below the hook hole and communicating with the hook hole; the width of the via hole in a direction parallel to the hook support portion is larger than the width of the hook hole in a direction parallel to the hook support portion.

100. The base component according to technical solution 96, the hanging body comprises an intermediate connection arm for connecting the two connection arms, and the intermediate connection arm is connected to an end of the two connection arms facing away from the hanging base disk.

101. The base component according to technical solution 1, wherein the base component also comprises an installation base for installing a motor and a hanging structure for hanging the motor on the installation base, wherein the motor comprises a main body and two sets of hanging post groups that are connected to the outside of the main body and arranged at interval; each of the two sets of hanging post groups comprises a pair of first hanging post and a second hanging post which are connected to the outside of the main body and extend in a horizontal direction in opposite directions; the two first hanging posts are arranged in parallel, the hanging structure comprises a hanging chassis connected to the installation base and a hanging body connected to the hanging chassis and used for hanging the motor and made of flexible soft rubber material; the hanging body is located on the lower side of the hanging chassis; the hanging body comprises two hanging members which are matched with a group of hanging post respectively; the hanging member comprises a hanging connection portion connected to the chassis, a first hanging support arm connected to the hanging connection portion and the first hanging post, and a second hanging support arm connected to hanging connection portion and the second hanging post and spaced from the first hanging support arm, the first hanging support arm is provided with a first hanging hole for fitting with the first hanging post by inserting, and the second hanging support arm is provided with a second hanging hole for fitting with the second hanging post by inserting; the distance of the opposite hole opening between the first hanging hole and the second hanging hole is smaller than the spacing distance between the free end of the first hanging post and the free end of the second hanging post.

102. A dishwasher, wherein the dishwasher comprises: a liner and the base component according to any one of technical solutions 1~101, the liner is arranged above the base and is assembled and connected with the base.

103. The dishwasher according to technical solution 102, wherein the dishwasher also comprises a hinge support mechanism and a hinge screw; the hinge support mechanism comprises a vertical plate and a cross-folded plate connected to each other; the liner comprises a side plate, the side plate is provided with a liner fastening hole at the place close to the front end of side plate, the side of base is provided with a base fastening hole corresponding to the position of the liner fastening hole, the vertical plate is provided with a hinge fastening hole, and a hinge screw sequentially passes through the liner fastening holes, the base fastening holes, and the hinge fastening holes to fasten the side plates, base and the hinge support mechanism, and the vertical plate extends upward and is connected with the liner fixedly, the horizontal folded plate is connected to the rear end of the vertical plate and extends toward the rear end of base and is connected to the side of base fixedly.

104. The dishwasher according to technical solution 103, wherein the top of base near the rear end of base is convexly provided with an upwardly extending installation protrusion, and the side plate near the rear end of the side plate is extended with a connection plate corresponding to the position of the installation protrusion; the installation protrusion is provided with a base installation hole, and a connection plate is provided with a liner installation hole corresponding to the position of the base installation hole, and the connection plate passes through the liner installation holes and the base installation holes through an axial screw to fasten the installation protrusion.

105. The dishwasher according to technical solution 103, wherein an inserting mechanism is provided at the bottom of the side plate, and the inserting mechanism is arranged along the longitudinal direction of the bottom of the side plate, and the base facing the top of the liner is provided with a positioning protrusion and a guide protrusion arranged at intervals, a base groove is formed between the positioning protrusion and the guide protrusion, and the inserting mechanism is inserted in the base groove.

106. The dishwasher according to technical solution 105, the guide protrusion comprises a limiting plate and a guide plate, the top of the limiting plate is connected to the top of base and is arranged in a vertical direction; the guide plate comprises a support portion and a guide portion; the support portion is connected to the outside the limiting plate; an anti-deformation step is formed between the inner surface of the support portion and the top surface of the limiting plate; the guide portion extends upward from the top surface of the support portion, and a guide arc surface is formed on the inner side surface of the guide portion from the top end surface of the guide portion to the bottom end surface of the guide portion.

The objective of the embodiment of the present application lies in: in the first aspect, a base component is provided to solve the technical problems that the overflow structure of the dishwasher in the prior art is easily clogged and is not convenient for timely cleaning.

In the second aspect, a dishwasher is provided to solve the technical problems that the overflow structure of the dishwasher in the prior art is easily clogged and is not convenient for timely cleaning.

To solve the above technical problems, the technical solutions adopted in the embodiments of the present application are:

In the first aspect, a base component is provided, including a base and an overflow cover. The overflow cover includes an overflow cover body. The overflow cover body is arranged with an overflow port and a mounting portion. The overflow cover body has an overflow chamber. The base has an overflow hole and a fixed connection portion that is docked with the mounting portion; the overflow port and the overflow hole are both in communication with the overflow chamber to form an overflow channel between the overflow cover body and the bases; a side of the overflow cover and adjacent to the upper surface of the base has a water inlet plate communicating with the overflow port, and the water inlet plates arranged with a plurality of filter holes.

In the second aspect, a dishwasher is provided, which includes the above-mentioned base component, and the inner liner is arranged above the base and is connected to the base assembly.

Compared with the prior art, the present application has the beneficial effects that the base component of the present application is applicable to dishwasher. The overflow cover of the present application has an overflow chamber and is installed on the base, which has a function of splashing prevention and flow guidance. Due to the arrangement of the water inlet plate, there are a plurality of filter holes on the water inlet plate. Through the water inlet plate, pollutants can be trapped to prevent the pollutants from directly entering the overflow channel and prevent the overflow channel from being clogged. Under the premise that the overflow cover is removed, it is easy to observe and intuitively and visually know whether there are pollutants attached to the water inlet surface of the overflow cover. Whenever there are pollutants, you can remove the overflow cover for cleaning, thus, it is convenient to clean pollutants timely and avoid odor.

The above are only exemplary embodiments of the present application, and are not intended to limit the present application. Any modification, equivalent replacement, and improvement made within the spirit and principle of the present application should be included in the protection scope of the present application.

What is claimed is:

1. A guide rail structure, for use with a bowl basket, the bowl basket comprising a bowl frame for carrying a bowl and a roller connected to the bowl frame, a direction of a scroll axis of the roller being from left to right; the guide rail structure comprising a guide rail base, the guide rail base having a guide rail surface which is located on an upper side of the guide rail base and arranged linearly in a front-rear direction; the guide rail surface being arranged parallel to a horizontal plane;

wherein the guide rail base is provided with a plurality of side water guide grooves;

each of the plurality of side water guide grooves has one notch defined in the guide rail surface and another notch arranged on a left side or a right side of the guide rail base;

the plurality of side water guide grooves are arranged at an interval along an extension direction of the guide rail surface; and a ratio of a groove width of each of the plurality of side water guide grooves to a wheel diameter of the roller is less than ½, and a ratio of a groove depth of each of the plurality of side water guide grooves defined in the guide surface to a width of the guide rail surface is less than 1.

2. The guide rail structure of claim 1, wherein the ratio of the groove depth of each of the plurality of side water guide grooves defined in the guide surface to the width of the guide rail surface is less than ½.

3. The guide rail structure of claim 1, wherein the guide rail structure comprises two limiting stoppers connected to the guide rail base and located on the guide rail surface;

extension directions of the two limiting stoppers are parallel to the extension direction of the guide rail surface; and a spacing between the two limiting stoppers is greater than or equal to the wheel width of the roller.

4. The guide rail structure of claim 1, wherein the two limiting stoppers are cut off when passing through the plurality of side water guide grooves.

5. The guide rail structure of claim 4, wherein each of the plurality of side water guide grooves is collectively formed by a groove bottom wall surface which is in a flat shape and two groove side wall surfaces which are oppositely arranged in flat shapes, and both the two groove side wall surfaces are perpendicular to the groove bottom wall surface.

6. The guide rail structure of claim 1, wherein each of the plurality of side water guide grooves is collectively formed by a groove bottom wall surface which is in a flat shape and two groove side wall surfaces which are oppositely arranged in flat shapes, and both the two groove side wall surfaces are perpendicular to the groove bottom wall surface.

7. The guide rail structure of claim 6, wherein the groove bottom wall surface is parallel to the extension direction of the guide rail surface.

8. The guide rail structure of claim 6, wherein an angle formed between the groove bottom wall surface and the horizontal plane is between 60 degrees and 70 degrees.

9. The guide rail structure of claim 1, wherein a spacing between any adjacent two of the plurality of side water guide grooves is greater than the wheel diameter of the roller.

10. The guide rail structure according to claim 1, further comprising a non-slip rubber layer which is laid on the guide rail surface.

11. A dishwasher, comprising a guide rail structure, for use with a bowl basket, the bowl basket comprising a bowl frame for carrying a bowl and a roller connected to the bowl frame, a direction of a scroll axis of the roller being from left to right; the guide rail structure comprising a guide rail base, the guide rail base having a guide rail surface which is located on an upper side of the guide rail base and arranged linearly in a front-rear direction; the guide rail surface being arranged parallel to a horizontal plane;

wherein the guide rail base is provided with a plurality of side water guide grooves;

each of the plurality of side water guide grooves has one notch defined in the guide rail surface and another notch arranged on a left side or a right side of the guide rail base;

the plurality of side water guide grooves are arranged at an interval along an extension direction of the guide rail surface;

a ratio of a groove width of each of the plurality of side water guide grooves to a wheel diameter of the roller is less than ½, and a ratio of a groove depth of each of the plurality of side water guide grooves defined in the guide surface to a width of the guide rail surface is less than 1.

12. The dishwasher of claim 11, wherein the ratio of the groove depth of each of the plurality of side water guide grooves defined in the guide surface to the width of the guide rail surface is less than ½.

13. The dishwasher of claim 11, wherein the guide rail structure comprises two limiting stoppers connected to the guide rail base and located on the guide rail surface;

extension directions of the two limiting stoppers are parallel to the extension direction of the guide rail surface; and a spacing between the two limiting stoppers is greater than or equal to the wheel width of the roller.

14. The dishwasher of claim 11, wherein the two limiting stoppers are cut off when passing through the plurality of side water guide grooves.

15. The dishwasher of claim 14, wherein each of the plurality of side water guide grooves is collectively formed by a groove bottom wall surface which is in a flat shape and two groove side wall surfaces which are oppositely arranged in flat shapes, and both the two groove side wall surfaces are perpendicular to the groove bottom wall surface.

16. The dishwasher of claim 11, wherein each of the plurality of side water guide grooves is collectively formed by a groove bottom wall surface which is in a flat shape and two groove side wall surfaces which are oppositely arranged in flat shapes, and both the two groove side wall surfaces are perpendicular to the groove bottom wall surface.

17. The dishwasher of claim 16, wherein the groove bottom wall surface is parallel to the extension direction of the guide rail surface.

18. The dishwasher of claim 16, wherein an angle formed between the groove bottom wall surface and the horizontal plane is between 60 degrees and 70 degrees.

19. The dishwasher of claim 11, wherein a spacing between any adjacent two of the plurality of side water guide grooves is greater than the wheel diameter of the roller.

20. The dishwasher according to claim 11, further comprising a non-slip rubber layer which is laid on the guide rail surface.

* * * * *